US006273115B1

(12) United States Patent
Guggisberg

(10) Patent No.: US 6,273,115 B1
(45) Date of Patent: Aug. 14, 2001

(54) WIND AND WEATHER PROTECTIVE DEVICE IN THE FORM OF A FOLDING ROOF AND/OR PARTITION

(76) Inventor: Urs Guggisberg, Oberdort 114, CH-4584 Lütersville (CH)

( * ) Notice: Subject to any disclaimer, the term of this patent is extended or adjusted under 35 U.S.C. 154(b) by 0 days.

(21) Appl. No.: 09/380,257

(22) PCT Filed: Feb. 26, 1998

(86) PCT No.: PCT/CH98/00079

§ 371 Date: Aug. 26, 1999

§ 102(e) Date: Aug. 26, 1999

(87) PCT Pub. No.: WO98/38400

PCT Pub. Date: Sep. 3, 1998

(30) Foreign Application Priority Data

| | | |
|---|---|---|
| Feb. 27, 1997 | (CH) | 459/97 |
| Apr. 16, 1997 | (CH) | 883/97 |
| Jan. 21, 1998 | (CH) | 131/98 |

(51) Int. Cl.[7] ..... E04F 10/04; A45B 23/00; E04H 15/48

(52) U.S. Cl. ..... 135/135; 135/98; 135/90; 52/63; 52/82; 52/74; 160/81; 160/134

(58) Field of Search ..... 135/90, 98, 21, 135/135; 52/63, 74, 75, 76, 77, 82; 160/134, 77, 81, 53, 46, 84.07

(56) References Cited

U.S. PATENT DOCUMENTS

| | | | | |
|---|---|---|---|---|
| 706,605 | * | 8/1902 | Slyder | 135/98 X |
| 779,446 | * | 1/1905 | Schram | 52/82 X |
| 2,465,140 | | 3/1949 | Vila . | |
| 3,118,186 | * | 1/1964 | Moss | 52/82 X |
| 3,134,426 | * | 5/1964 | Cherubin | 160/81 |
| 3,156,497 | * | 11/1964 | Lessard | 135/90 X |
| 3,333,373 | * | 8/1967 | Taylor et al. | 52/63 |
| 4,630,627 | | 12/1986 | Windows et al. . | |
| 4,836,232 | * | 6/1989 | De Rosa et al. | 135/99 |
| 5,490,533 | | 2/1996 | Carter . | |
| 5,918,615 | * | 7/1999 | Stuck, Sr. | 135/135 |

FOREIGN PATENT DOCUMENTS

| | | | | |
|---|---|---|---|---|
| 879 924 | | 5/1980 | (BE) . | |
| 678 875 A5 | | 11/1991 | (CH) . | |
| 1184930 | * | 1/1965 | (DE) | 160/77 |
| 1 207 560 | | 12/1965 | (DE) . | |
| 2 150 198 | | 6/1972 | (DE) . | |
| 34 18 994 A1 | | 11/1985 | (DE) . | |
| 85 33 632 | | 3/1986 | (DE) . | |
| 37 21 738 A1 | | 1/1988 | (DE) . | |
| 37 30 696 A1 | | 4/1988 | (DE) . | |
| 43 22 417 A1 | | 1/1995 | (DE) . | |
| 296 16 314 | | 1/1997 | (DE) . | |
| 0 011 041 | | 5/1980 | (EP) . | |
| 0 567 922 A1 | | 11/1993 | (EP) . | |
| 0 587 529 | | 3/1994 | (EP) . | |
| 802 857 | | 9/1936 | (FR) . | |
| 1488351 | * | 10/1977 | (GB) | 135/90 |
| 79 156 | | 4/1955 | (NL) . | |

OTHER PUBLICATIONS

International Search Report with mail date of Nov. 4, 1998.

* cited by examiner

*Primary Examiner*—Laura A. Callo
(74) *Attorney, Agent, or Firm*—Brown & Wood, LLP

(57) ABSTRACT

A proposed wind and weather protection device is designed in the form of a collapsible pavilion. The collapsible pavilion is provided with a collapsible roof (1) formed from circular segments. In two preferential design variants, the maximum opening angle of the pavilion is 180°, 90° or 270°. The roof (1) consists of a central nodal element (2) on which several roof spars (11) are fixed. The roof spars (11) support a covering element (21) in the form of a circular segment. To extend the roof (1), at least one tensioning device is provided. The pavilion can have vertical side supports. Each side support is positioned at the outer end of each roof spar. Furthermore, the pavilion can be equipped with a side wall. A gathering device can be used to ensure that the covering element (21) does not hang too far down when folded.

12 Claims, 40 Drawing Sheets

Figure 1A:
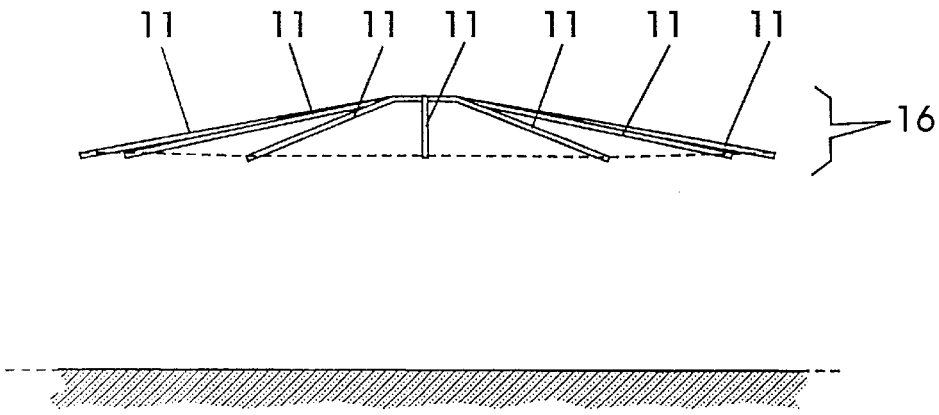

WIND AND WEATHER PROTECTIVE DEVICE IN THE FORM OF A FOLDING ROOF AND/OR PARTITION

The present invention concerns a wind and weather protection device in the form of a detachable partition or side wall for attachment to a wind and weather protection device in the form of a collapsible roof.

In order to be able to use outdoor sitting areas in inclement weather, they are commonly provided with protection equipment.

Probably the most common protection equipment consists of awnings that may be rolled up. However, awnings have the disadvantage that they must be rolled up when there is a strong wind to prevent them from breakage.

Awnings capable of withstanding strong wind loads are provided with strong guide bars or run in permanently mounted fixtures. They have the disadvantage that in order to erect them either a wall must be built, or fixed and permanently anchored mountings must be provided. This is time-consuming and correspondingly expensive.

Tents are also well known as weather protection devices. Tents that may be quickly erected and taken down are particularly user-friendly. A tent of this kind is for example the subject of the Patent EP 0 567 922 (publication date Nov. 3, 1993). This tent consists of two roof elements lying on hoops at opposite sides of a frame. These roof elements may be collapsed or extended by moving them along guide bars. The guide bars are assembled from several parts. Furthermore, the roof elements may be collapsed and stored in the frame. The roof elements are intended for tents with a rectangular base. They are carried on supports and are preferentially ridge-shaped. Tents of this type have the particular disadvantage of complex construction and are therefore expensive. In addition, they cannot be employed without vertical supports. For this reason, they are not very suitable as protection equipment for outdoor sitting areas. In addition, the U.S. Pat. No. 4,630,627 (publication date Dec. 23, 1986) proposes a collapsible frame for the erection of a tent with ridge roof having an upper and a lower frame. The upper and lower frames are connected by means of several hinged struts. The hinged struts are folded inwards in order to lower the upper frame relative to the lower frame. They are folded outwards to raise the upper frame relative to the lower frame. The hinged struts may be collapsed or extended with the aid of winches attached to the lower frame. This structure also has the disadvantage of relative complex construction and is therefore expensive. A further significant disadvantage is that the two frames cannot be folded together. This framework thus requires extensive storage space even when folded.

The U.S. Pat. No. 5,490,533 (publication date Feb. 1–3, 1996) describes a collapsible shelter with a raised roof covering.

The roof covering has at least three sides and three corners. It is supported by at least three vertically positioned supports, whereby each support is located under a corner of the roof covering. The roof covering has a framework that folds upwards. This framework consists of several stays. Each stay consists of two stay elements. The stay elements are arranged in an outer and an inner sector. The outer end of the outer sector is connected to the upper end of a vertical support. The inner end of the inner sector is connected to a long, central, mounting element. Each of the two sectors of a stay element consists of two bar-shaped elements that cross each other and are connected together at their centers so as to be rotatable. The stays can be moved from a collapsed position to an extended position. In the extended position, the stays lie above the vertical supports. In the collapsed position, they are located between the vertical supports. This shelter also has the disadvantage of relatively complex construction, and is therefore expensive. It is unsuitable for mounting on the wall of a building. Although the height of the stays can be reduced, their length remains unchanged. The shelter thus requires relatively extensive storage space even when folded.

A covering for large open spaces is proposed in the published applications DE 37 21 738 (day of disclosure Jan. 21, 1988) and DE 37 30 696 (day of disclosure Apr. 14, 1988). This covering comprises several vertical masts. Cables are suspended between these masts.

U-shaped profile guides are mounted on the cables in that holes are provided in the guides through which the cables may be passed, enabling the guides to be displaced along the cables. The ends of the guides are rolled up to form outward-facing tubes. Strips are attached to the U-shaped profile guides at their ends and extend over the entire length of the profile guides. The edges of the strips are rolled up to form a tube. Cables are passed through these tubes.

The tubes are inserted in the tube-shaped ends of the guides. The covering may be opened or closed by means of tension cables attached to the guides that may be moved back and forth via motorized shafts, rollers and guide pulleys. The covering can be reinforced with the aid of stabilizing cables. This covering is also unsuitable for mounting on the wall of a building.

A further tent construction is the subject of the published application DE 34 18 994 (day of disclosure Nov. 28, 1985). This tent design comprises a supporting framework consisting in the main of vertically positioned side supports and horizontally positioned or tilted roof spars. The side supports are positioned on the ground at equal intervals. The roof spars extend radially from at least one central nodal element to the upper ends of the side supports, and are connected to these. They are designed to telescope and may be adjusted to any desired length. At the free end of each spar, i.e. at the end opposite the central nodal element, peripheral nodal elements having three axes of rotation are positioned, one of which is attached to a side support and the other two to transverse horizontal spars. These transverse spars are positioned between the free ends of the roof spars. The central nodal element is attached to a vertical support or to a wall structure. The tent design also has side walls and a roof. The side walls are supported by the side supports, and the roof by the roof spars. The side walls and the roof consist of interconnected tent material elements.

This tent design is not collapsible. To erect it or take it down, the individual parts must be connected together or taken apart. This is relatively time-consuming.

The published application DE 43 22 417 (day of disclosure Jan, 12, 1995), which corresponds to the status of technology pertaining in the characterizing portion of Patent claim 1, proposes a folding roof whose base consists of a frame. A cylinder having a vertical axis is attached to the center of one of the transverse sides of this frame. Several roof stays are attached radially to this cylinder. The roof stays are grouped together above and below at each side of the center line of the frame and connected by strap hinges next to the cylinder. Each group of roof stays is assigned a swivel arm that is attached radially to a shaft positioned near the cylinder so that it can rotate, and whose other end is attached to a hinge fixed to the outer roof stay of the group, in such a way that when the arm is swiveled beyond the frame, the roof stays of a group assume a radial position within a semicircle, whereby the strap hinge is in contact with the cylinder and tensions a roof covering element to form a semicircle. The frame can be permanently mounted on columns or posts. It may also however be mounted on a mobile sales stand. This folding roof is primarily intended as a roof for exhibition stands or for solar protection for balconies and restaurants. Since the folding roof is circular, it is not suitable for mounting on the wall of a building. A further disadvantage of this folding roof lies in the relatively unstable attachment of the roof stays by means of strap hinges. This folding roof does not provide sufficient resistance against high wind loads.

Finally, the Patent CH 678875 (publication date Nov. 15, 1991) proposes an umbrella-shaped folding roof in which swivel arms are attached to a central nodal element by means of a hinge. Each two adjacent swivel arms are connected to each other by means of a covering element in the form of a circular segment, so that when the swivel arms are flared out, an umbrella roof i5 formed. The swivel arms are held in a horizontal position by means of tension cables at each end. However, neither a radial tensioning device, nor a gathering device for the covering, nor side supports, are included. A further disadvantage is that when collapsed, the arms are positioned above each other, and this is unsatisfactory from an aesthetic point of view. Finally, the arms are not self-supporting but must be held in a horizontal position by a complicated tensioning procedure.

In DE-B-1 207 560, a protection device for balconies and terraces is described whose mounting device takes the form of a central nodal element with two horizontal support plates positioned at a certain distance above each other. This protection device is so designed that it can also be mounted on a vertical wall. In the particular case of an opening angle of 180° or more, a protection device of this kind does not however offer adequate wind protection.

In the EP-A1-0 011 041, a weather protection device that may be mounted for example on a camping van is described whose mounting device is designed similarly to that of the document mentioned immediately above. This weather protection in the form of an extendable umbrella-shaped device also does not offer adequate wind protection.

The BE-A-879 924 shows a form of awning whereby for one particular design variant two approximately vertical supports are provided at the outer edge of the awning that secure the free end of the awning at the ground.

The object of the present invention is to provide a wind and weather protection device providing shelter for an outdoor sitting area and having adequate resistance and providing good protection against high wind loads, whose erection and taking down is simple and quick, and whose manufacturing costs are lower than the manufacturing costs of customary wind and weather protection devices.

This task is accomplished with the aid of the features claimed in the invention.

In one version, the proposed wind and weather protection device takes the form of a collapsible pavilion. It has a circular, segmented, foldable roof. In another version, it can take the form of a wind protecting partition used as a side wall. In two of the preferred extended versions, the maximum opening angle of the pavilion is 180° or 90°. However, other extended versions with other maximum opening angles, as for example 360° or 270° are included. The version with a maximum opening angle of 180° is suitable for mounting to the wall of a house. The version with a maximum opening angle of 90° is suitable for mounting on a re-entrant corner of a building. The-version with an opening angle of 360° can be mounted on a single central mast. The design variant with a maximum opening angle of 270° is suitable for mounting on the corner of a building.

The roof consists of a central nodal element to which several roof spars are attached. In the design variant with an opening angle of 180°, the central roof spar is fixed permanently to the nodal element, preferentially by welding or screwing. The other roof spars are attached to the nodal element so as to be horizontally rotatable. When folded together, all the roof spars rest parallel to one-another. When flared out, they extend radially outwards from the central nodal element at regular angular intervals. Each roof spar has a long main stay. For a reinforced version of the roof spars, a short strut may be attached to the main stay. The strut is positioned at the inner part of the main stay and is inclined downwards from this. The inner end of the main stay and the strut lie in the same plane. The main stay and the strut can also be connected to each other by at least one reinforcing strut. For the design variants with opening angles of 90° or 180°, the nodal element consists of two horizontal support plates in the form of circular segments positioned above each other. The angle of the circular segment corresponds to the maximum opening angle of the roof.

In the version with an opening angle of 270°, the nodal element comprises a large part and a small part. These two parts are connected to each other so as to be rotatable. Each part consists of two horizontal support plates in the form of circular segments positioned above each other. For the large nodal element part, the angle of the circular segment is 180°, and for the small nodal element part 90°.

The distance between the support plates is so chosen that the inner ends of the roof spars can be inserted between the support plates. For the unreinforced version of the roof spars, the lower edge of the main stay is in contact with the lower support plate and the upper edge of the main stay with the upper support plate. For the reinforced design variant of the roof spars, the upper edge of the main stay is in contact with the lower side of the upper support plate and the lower edge of the strut with the upper side of the lower support plate. Each of the main stays, or accordingly the main stays and the struts, are connected to the respective support plate by a hinge. In order to correct for manufacturing tolerances, the struts are adjustable in length. In the version with an opening angle of 90°, both of the support plates are rigidly attached to at least one mounting plate. The mounting plate is used to connect the strait edges of the two support plates that lie above each other. The mounting plate is fixed to the wall of a building. For the version with an opening angle of 180°, both support plates are attached to a mounting plate so as to be horizontally rotatable. They are connected to the mounting plate via a hinge positioned at one side of the support plates. The support plate is attached to the wall of a building. By virtue of this design, all of the roof spars may be folded together and swiveled towards the wall. For the version with an opening angle of 270°, the two support plates of the large nodal element part are connected to a mounting plate so as to be horizontally rotatable. They are connected to the mounting plate via a hinge positioned at one side of the support plates. The mounting plate forms a right-angle and is fixed to the corner of a building. Each of the support plates of the small nodal element part are connected to a free corner of a support plate of the large nodal element part so as to be rotatable. They are connected to the support plates of the large nodal element part via a hinge positioned at a corner of each support plate of the small nodal element part.

A protective cover in the form of a circular segment can be positioned above the nodal element. The opening angle of the protective cover corresponds to the maximum opening angle of the foldable roof.

The roof spars are covered by covering material in the form of a circular segment. The opening angle of the circular segment corresponds to the maximum opening angle of the roof. The radius of the covering material corresponds to the length of the roof spars. In order to fix the covering material, the upper edges of the roof spars are provided with an undercut longitudinal groove. The covering material is pressed into these longitudinal grooves and fixed by means of rods inserted into the longitudinal grooves from one end. To extend the roof, at least one tensioning device is provided. The tensioning device consists of a tension cable attached to the outer end of one of the outer roof spars, a deflecting pulley and a winch. A gathering device is used to ensure that when folded, the covering material does not hang too far down. Preferentially, a flounce is attached to the edges of the roof covering that conceals the roof spars from view.

A vertical side support is attached to the outer end of each roof spar of the entire pavilion or of a section of the pavilion as claimed in the invention. The outer section of each roof spar is attached to the upper end of a vertical side support. The side supports each carry a wheel or a quick fastener with an eyelet or a bush. When the pavilion is extended, the wheels rest on the ground. In order to collapse the pavilion, the outer side supports are suspended on the central support so that only the wheel belonging to the central support is in contact with the ground. To permit the side supports to be raised, the roof spars are provided with a compensating hinge in one of their upper sections. However, this is only the case if the side supports are provided with wheels for the purpose of compensating uneven ground.

The pavilion has at least one side wall. The side wall may extend along the entire periphery of the pavilion or along only part of it. In the section along which the side wall extends, a vertical side support is positioned at the outer end of each roof spar. Each side support is attached to the corresponding roof spar via a bolt and groove connection. The lower end of each side support is likewise connected via a bolt and groove connection to a rail or bush let into the ground. Each side support carries a fixture at its upper end section. The fixtures of two adjacent side supports carry a transverse support. Between two adjacent side supports, one or several rectangular wall elements are grouped together, and attached at the top to the transverse support and at the bottom to the rail or retaining bush. The wall elements consist of a frame and frame covering. The frame covering can be of acrylic glass or textile material.

Figure 1B:
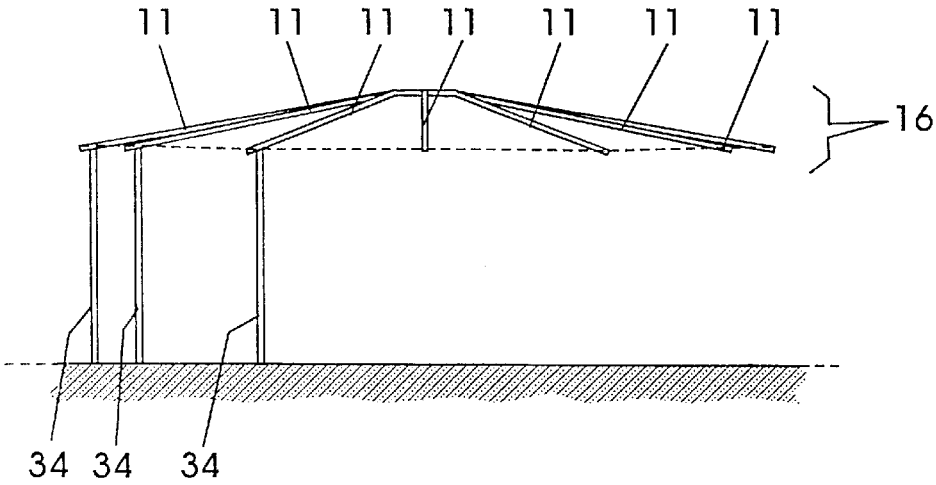
Figure 1C:
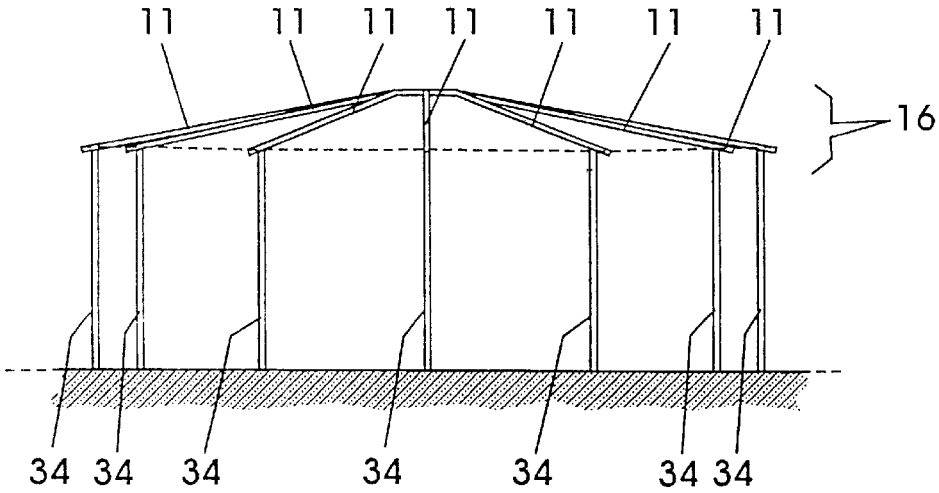
Figure 2A:
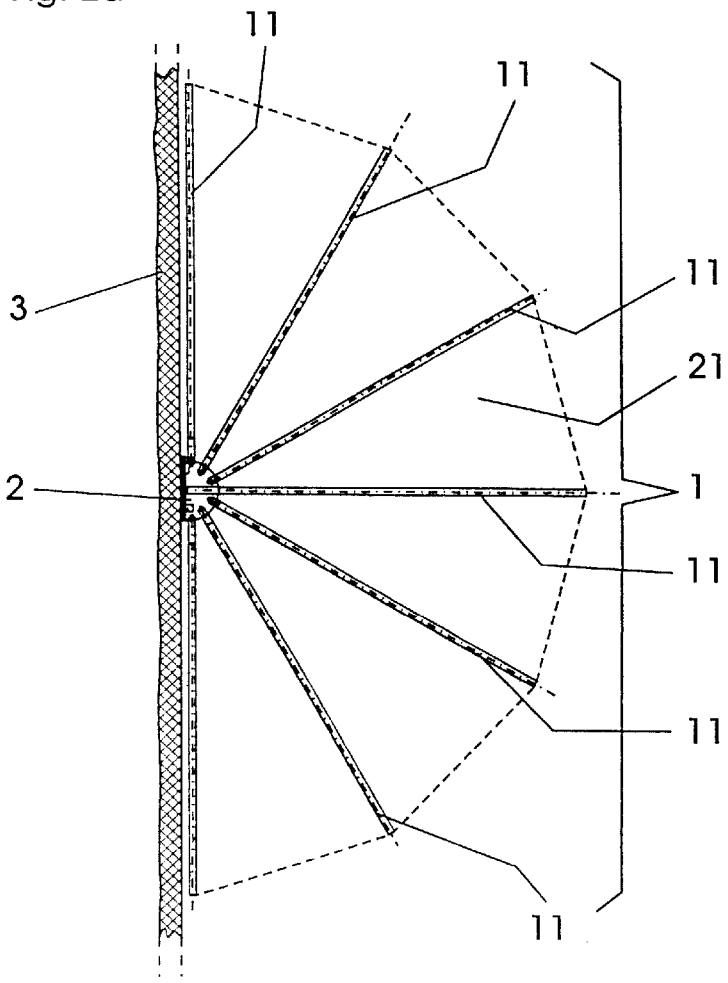

The invention is described in more detail in the following design examples. It is also described, among other things, in the figures. These show:

FIG. 1*a* a side view of an extended pavilion with a maximum opening angle of 180° and without a side wall, whereby the pavilion shown does not represent an embodiment as claimed in the invention;

FIG. 1*b* a side view of an extended pavilion with a maximum opening angle of 180° and a side wall extending over one third of the periphery of the pavilion;

FIG. 1*c* a side view of an extended pavilion with a maximum opening angle of 180° and a side wall extending over the entire periphery of the pavilion;

FIG. 2*a* a top view of an extended pavilion as in FIG. 1*a;*

Figure 2C:
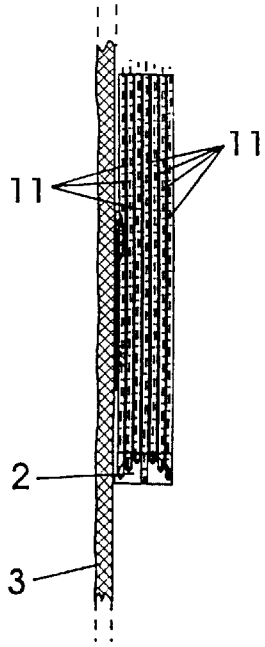
Figure 2B:
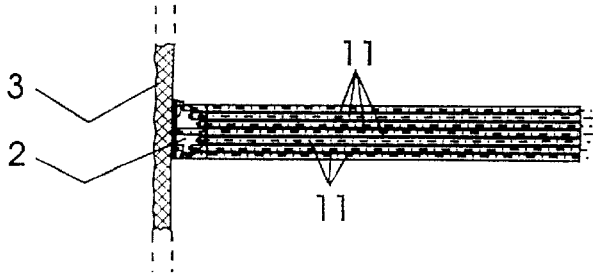
Figure 3A:
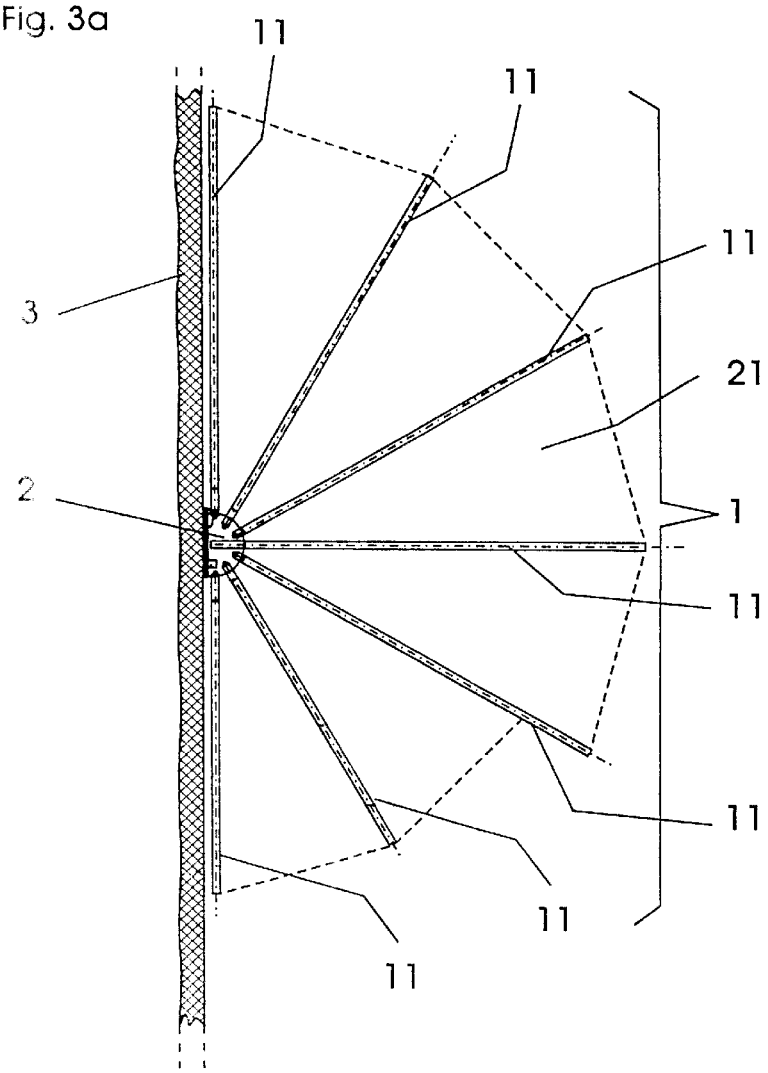
Figure 3C:
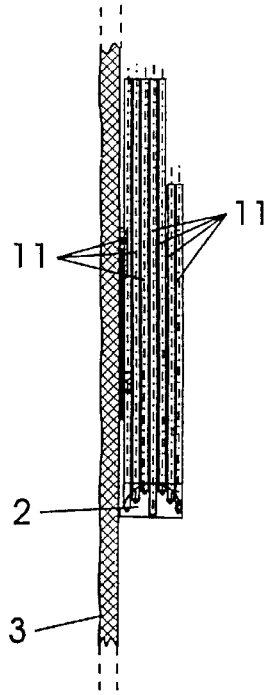
Figure 3B:
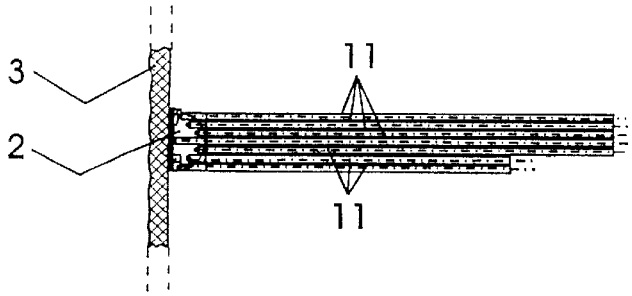
Figure 4A:
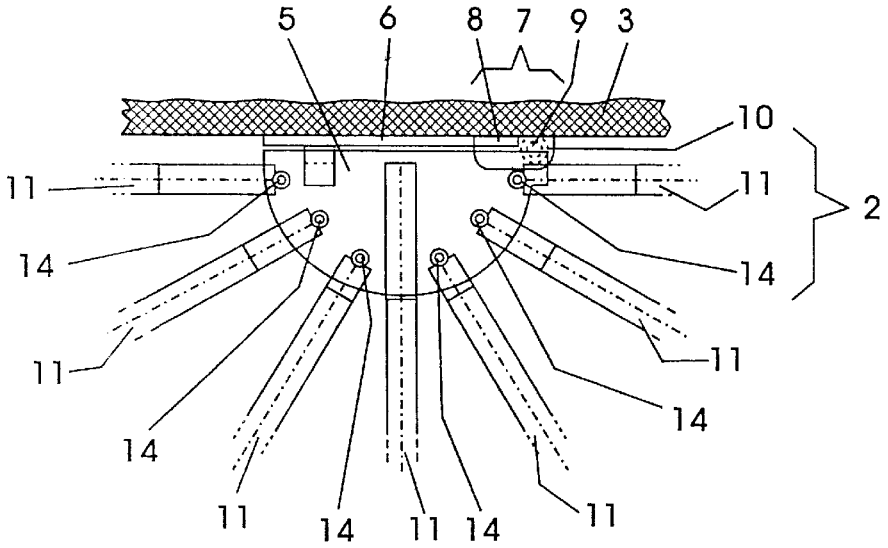

FIG. 2*b* a top view of a pavilion as in FIG. 2*a* with its roof spars folded together;

FIG. 2*c* a top view of a pavilion as in FIG. 2*a* whose roof spars are folded together and swiveled towards the wall;

FIG. 3*a* a top view of an extended pavilion with an opening angle of 180° and two shortened roof spars;

FIG. 3*b* a top view of a pavilion as in FIG. 3*a* whose roof spars are folded together;

FIG. 3*c* a top view of a pavilion as in FIG. 3*a* whose roof spars are folded together and swiveled against the wall;

FIG. 4*a* a top view of a nodal element of an extended pavilion as in FIGS. 2*a* and 3*a;*

Figure 4B:
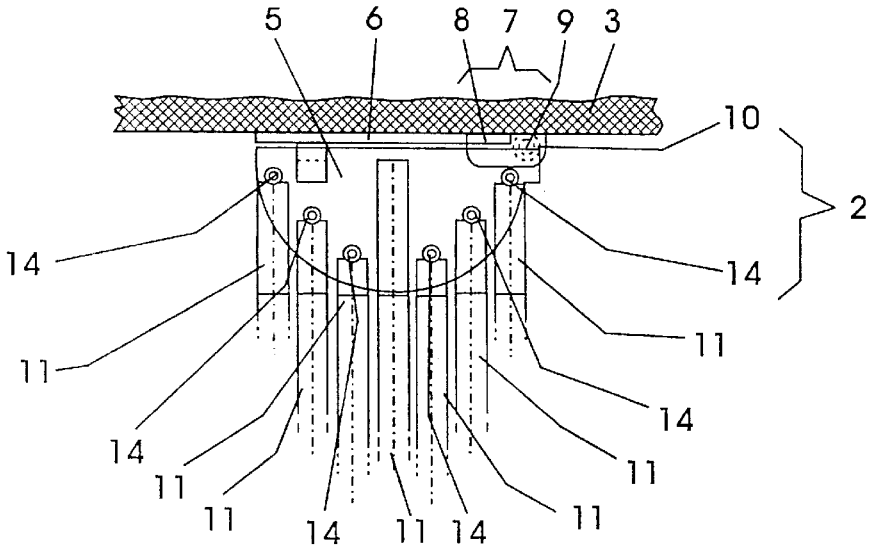
Figure 4C:
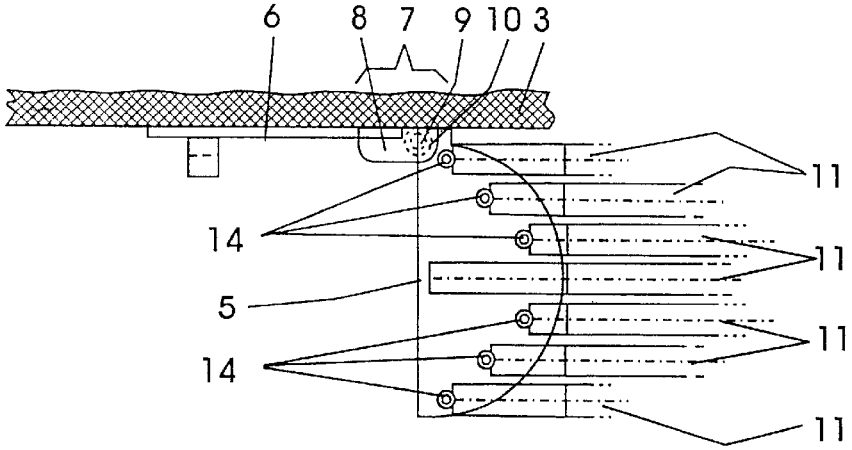
Figure 5A:
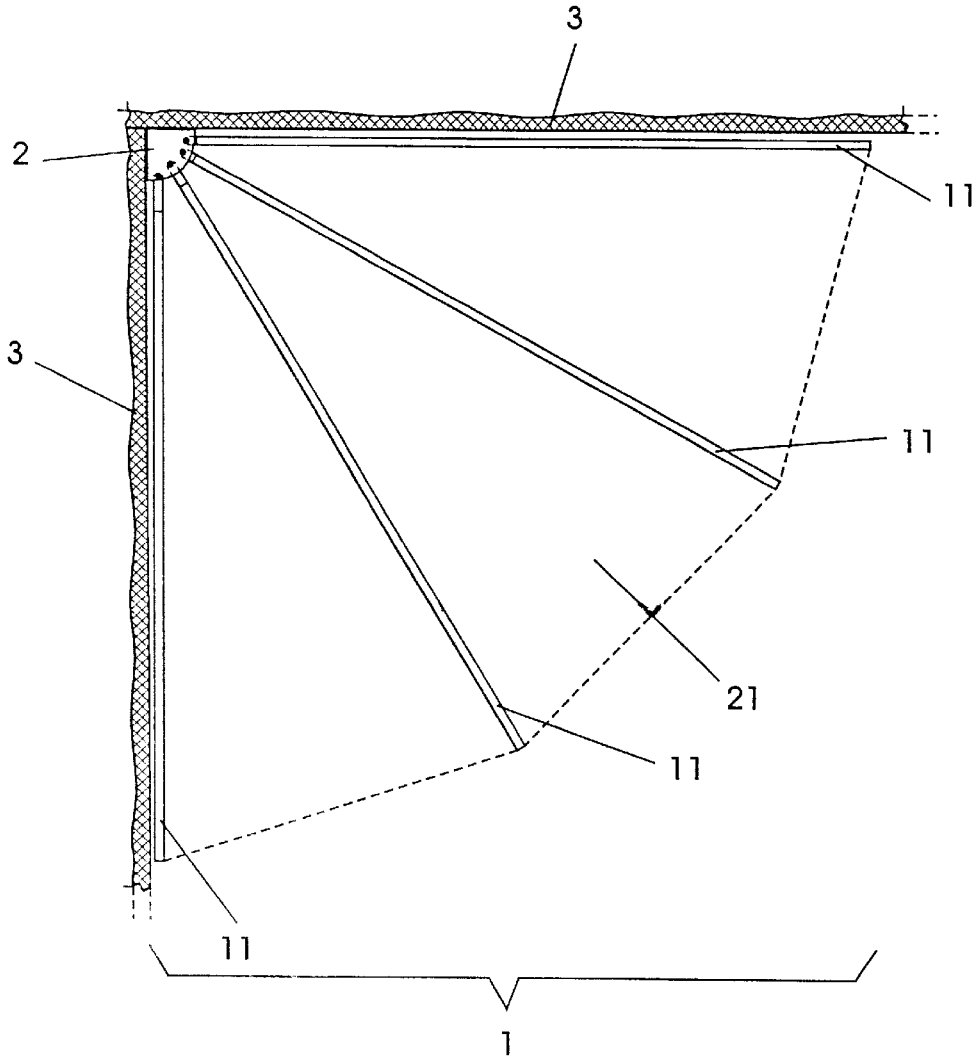
Figure 5B:
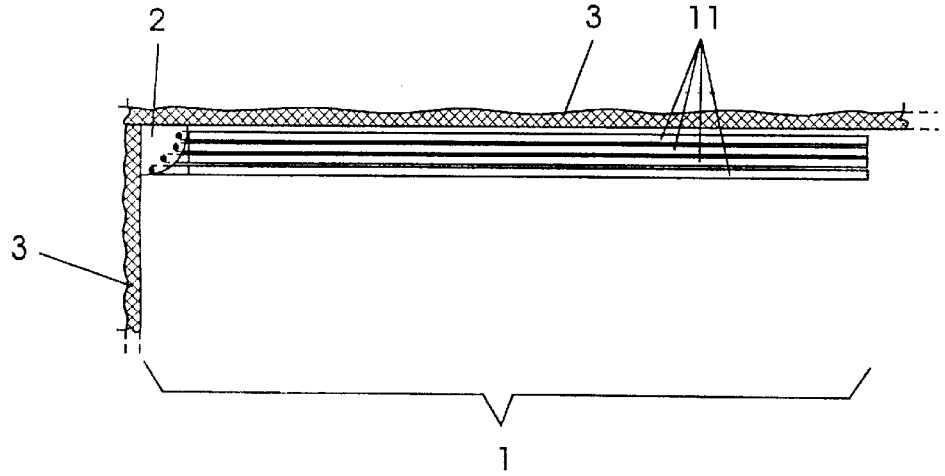
Figure 6A:
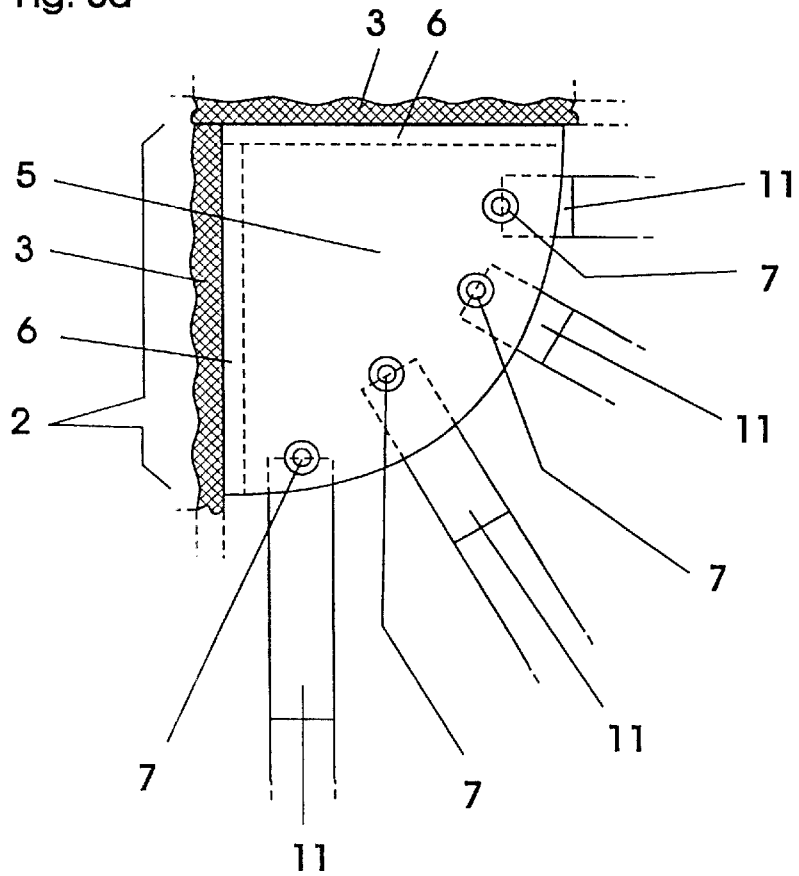

FIG. 4*b* a top view of a nodal element of a pavilion as in FIGS. 2*b* and 3*b* whose roof spars are folded together;

FIG. 4*c* a top view of a nodal element of a pavilion as in FIGS. 2*c* and 3*c* whose roof spars are folded together and swiveled against the wall;

FIG. 5*a* a top view of an extended pavilion with a maximum opening angle of 90°;

FIG. 5*b* a top view of a pavilion as in FIG. 5*a* whose roof spars are folded together;

FIG. 6*a* a top view of a nodal element of an extended pavilion as in FIG. 5*a;*

Figure 6B:
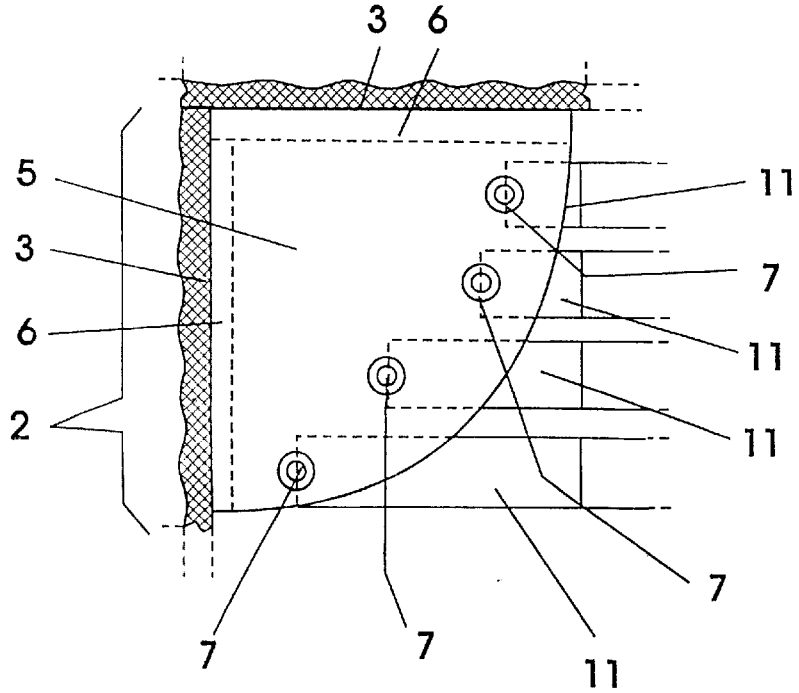

FIG. 6*b* a top view of a nodal element of a collapsed pavilion as in FIG. 5*b;*

Figure 7A:
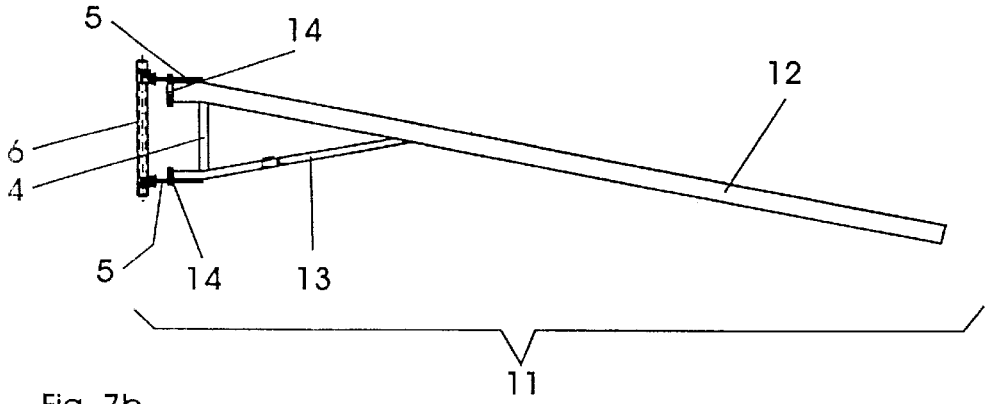
Figure 7B:
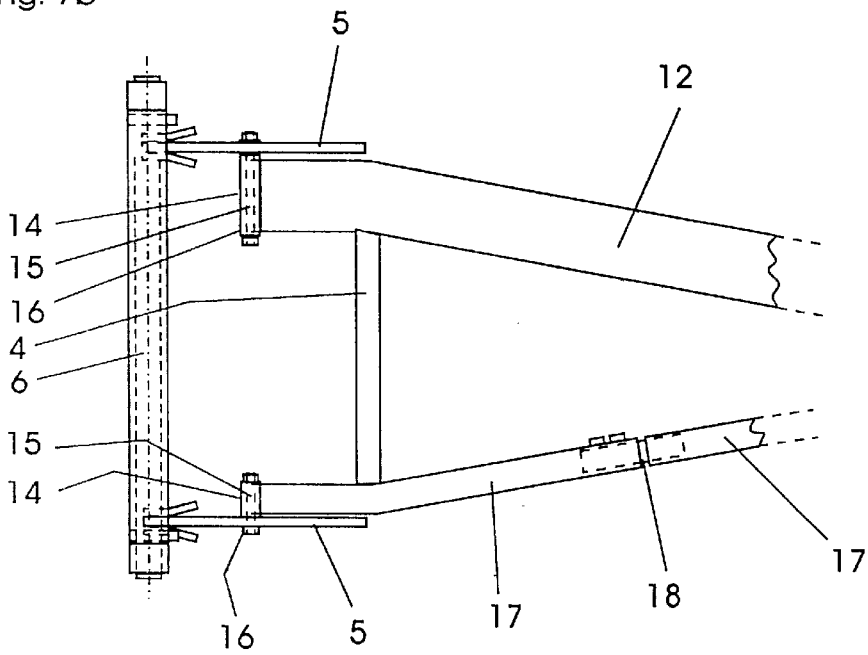

FIG. 7*a* a side view of a reinforced roof spar of the second design variant with the framework on the underside;

FIG. 7*b* a side view of the upper section of a roof spar as in FIG. 7*a;*

Figure 7C:
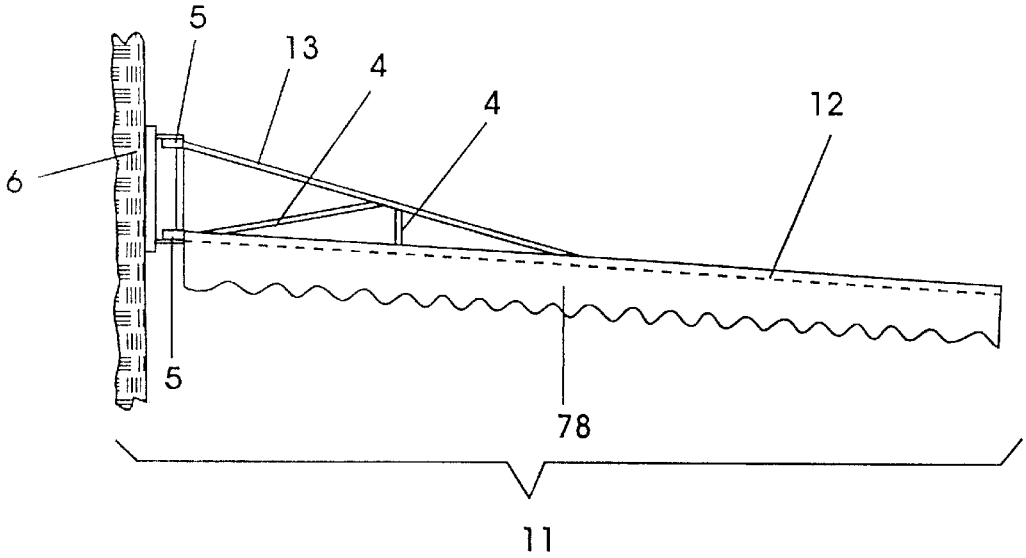
Figure 7D:
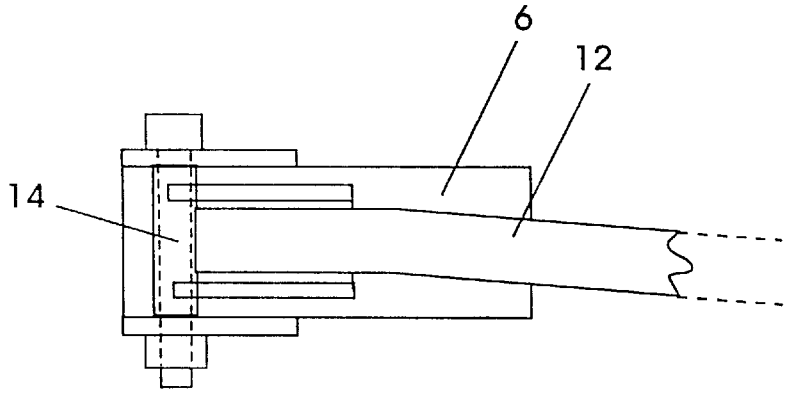
Figure 7E:
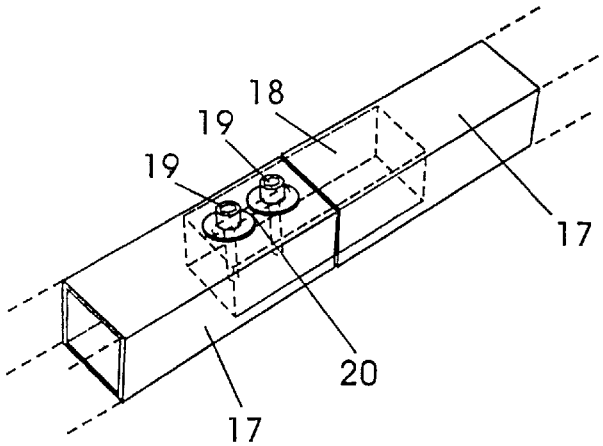

FIG. 7*c* a side view of a roof spar of the reinforced design variant with the framework on the upper side;

FIG. 7*d* a side view of a roof spar of the unreinforced design variant;

FIG. 7*e* a perspective view of an initial design variant of the device for adjusting the length of a strut of a roof spar as in FIGS. 7*a* and 7*b;*

Figure 7F:
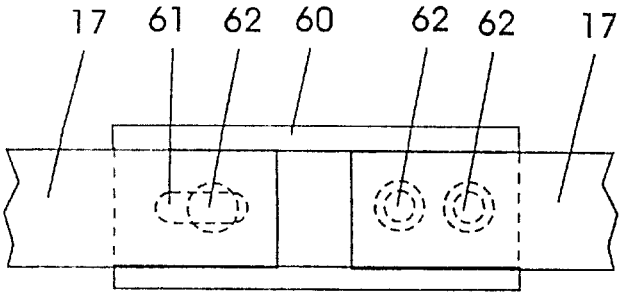
Figure 7G:
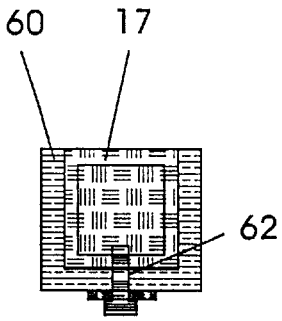

FIG. 7*f* a top view of a second design variant of the device for adjusting the length of the strut of a roof spar;

FIG. 7*g* a cross-section through the device for adjusting the length of a strut of a roof spar as in FIG. 7*f;*

Figure 7H:
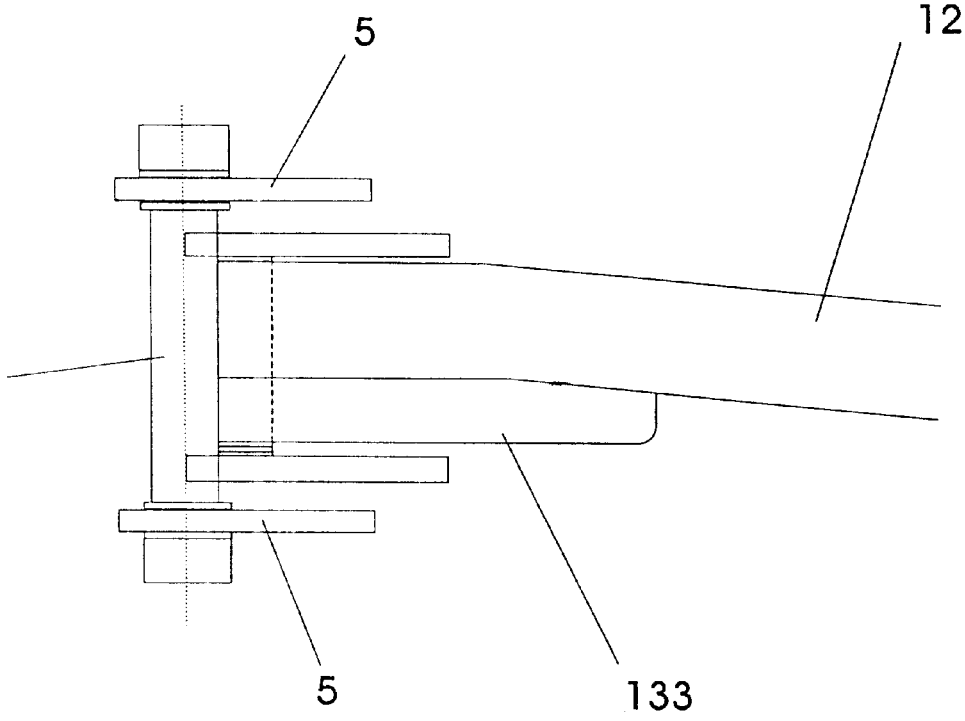
Figure 7I:
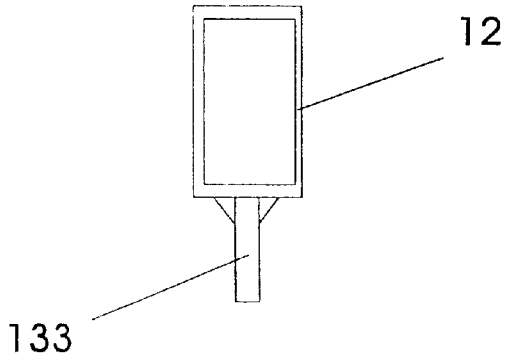

FIG. 7*h* a side view of a reinforced roof spar of an initial design variant;

FIG. 7*i* a cross-section through a reinforced roof spar of an initial design variant as in FIG. 7*h;*

Figure 8A:
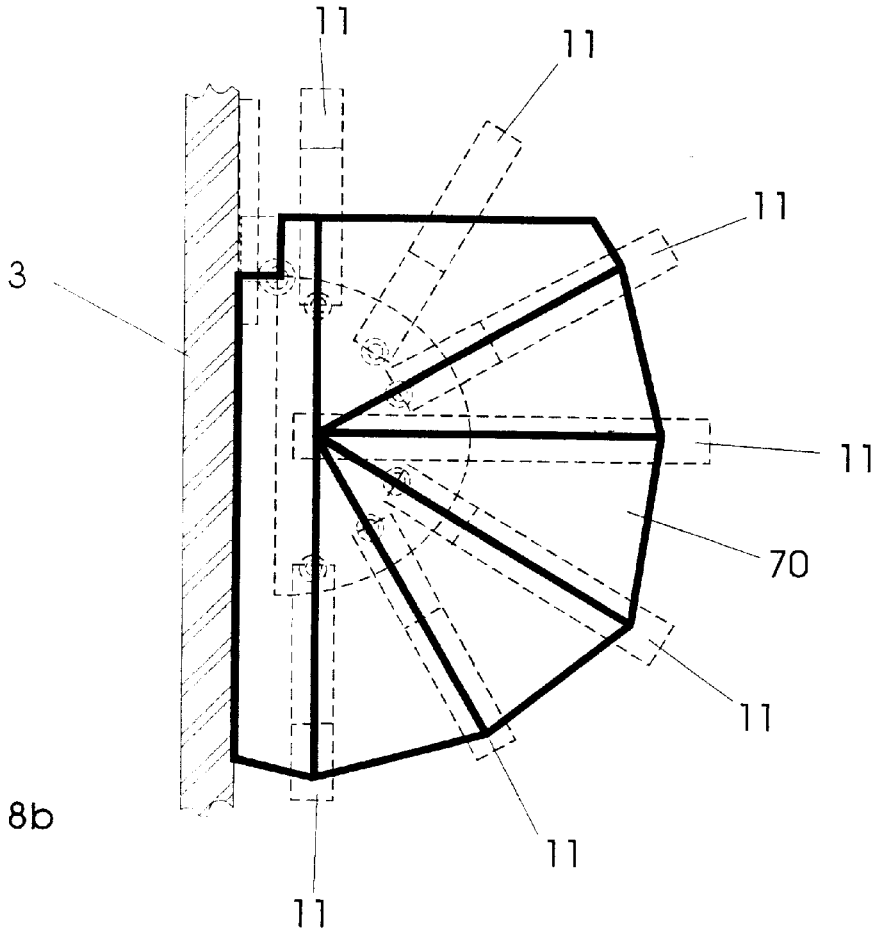
Figure 8B:
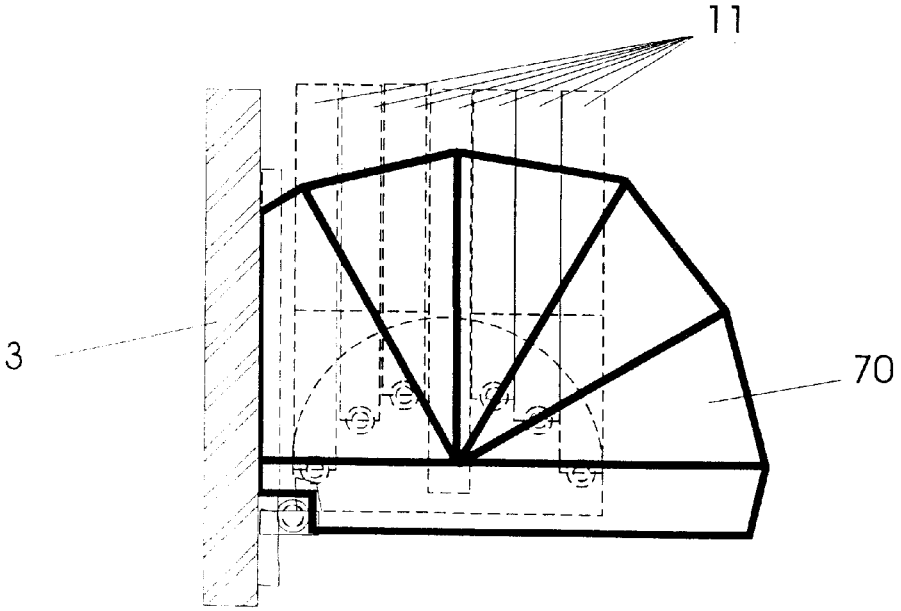
Figure 8C:
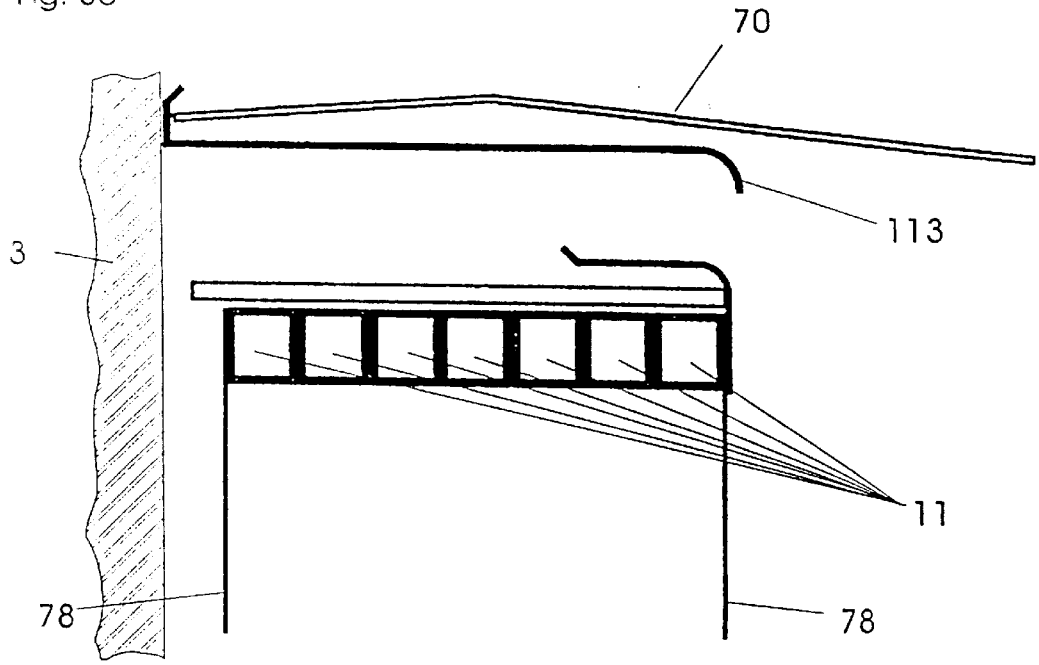

FIG. 8*a* a top view of a roof of the first design variant with an umbrella roof in the extended position;

FIG. 8*b* a top view of a roof of the first design variant with an umbrella roof in the folded position;

FIG. 8*c* a view C of a roof as in FIG. 8*b;*

Figure 8D:
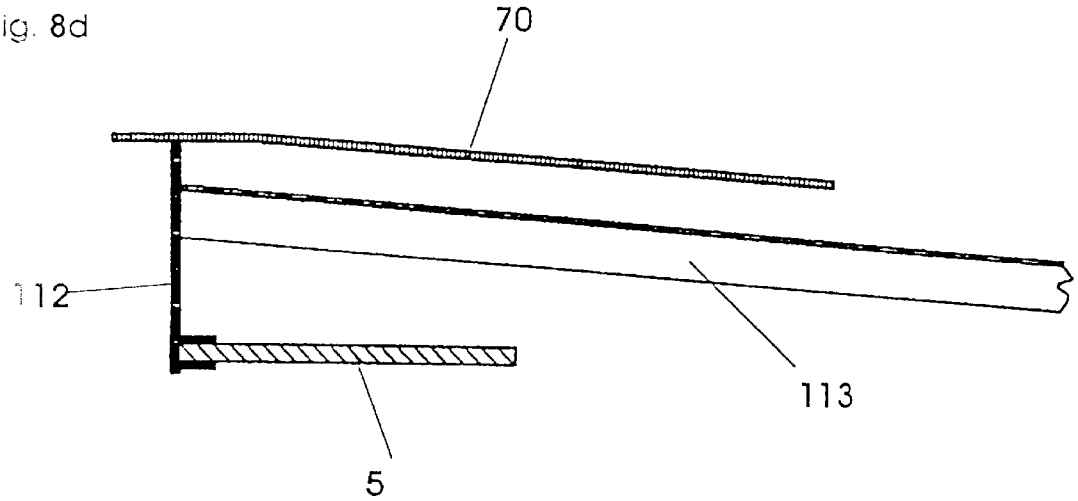
Figure 9:
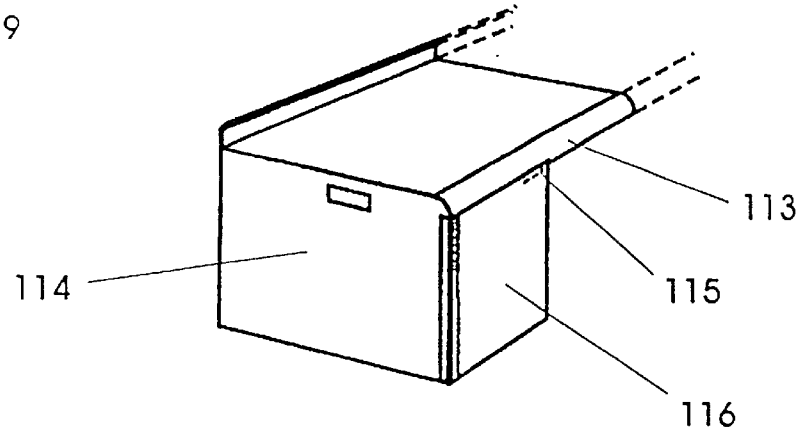
Figure 10:
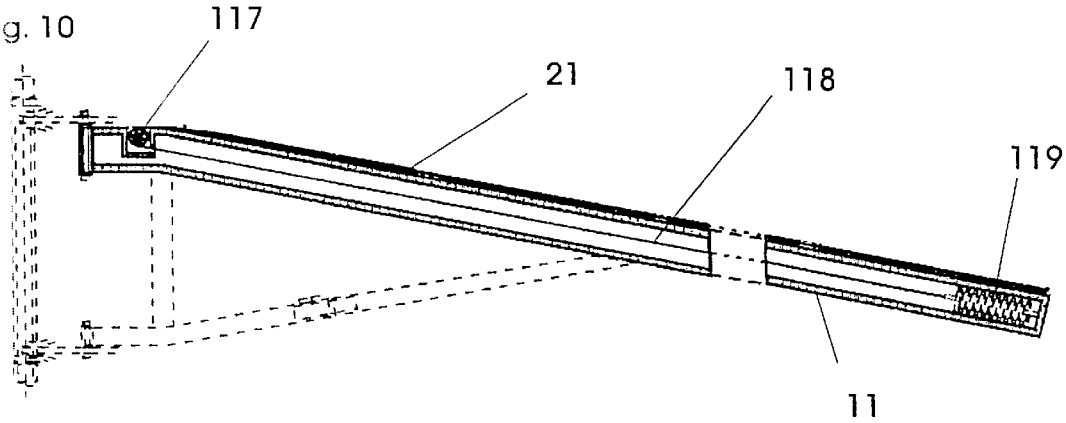
Figure 11A:
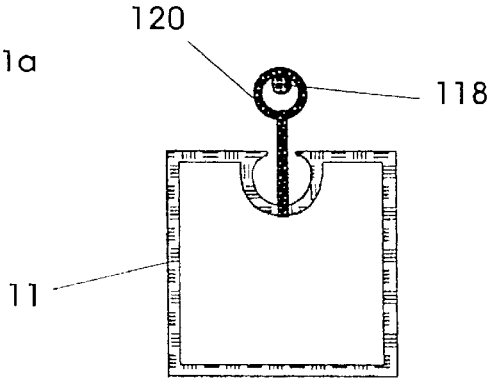
Figure 11B:
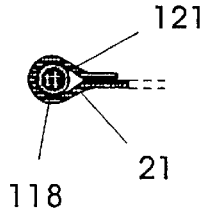
Figure 12:
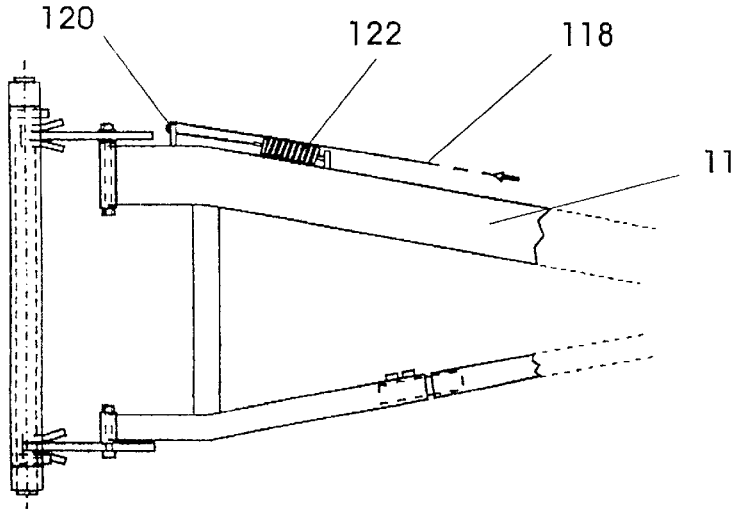
Figure 13A:
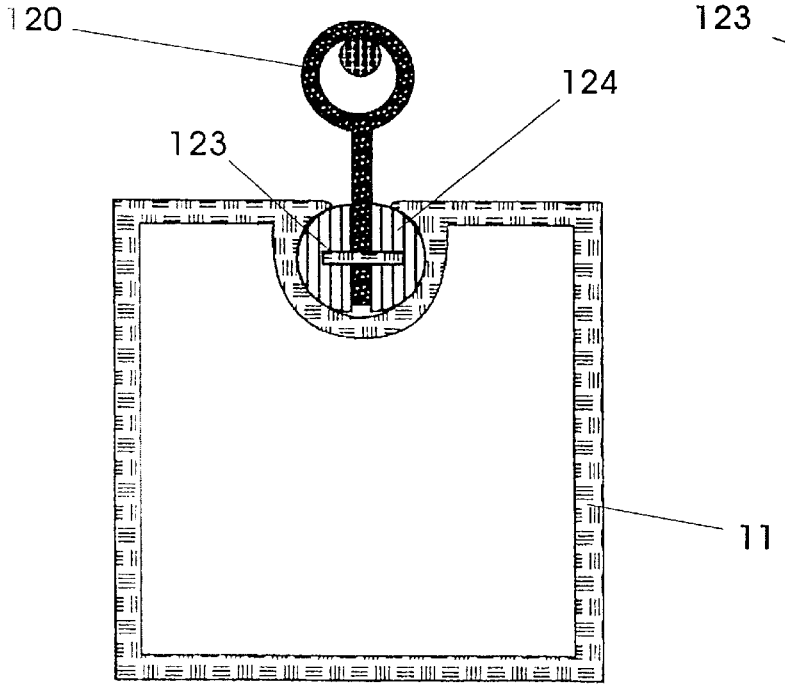
Figure 13B:
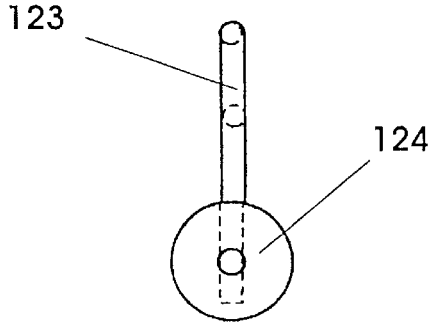

FIG. 8*d* a cross-section through a roof as in FIG. 8*b*; roof spars 11 swiveled against the wall not shown FIG. 9 a perspective view of part of the cover;

FIG. 10 a longitudinal cross-section through a spar with a radial tensioning device of an initial design variant of the roof covering;

FIG. 11*a* a cross-section through a spar as in FIG. 10 in the vicinity of a guide eyelet;

FIG. 11*b* a cross-section through the seam of the roof covering;

FIG. 12 a side view of the upper section of a radial tensioning device of a second design variant for the roof covering;

FIG. 13*a* a cross-section through a spar with a guide for the roof covering;

FIG. 13*b* a side view of a runner of the guide as in FIG. 13*a;*

Figure 14A:
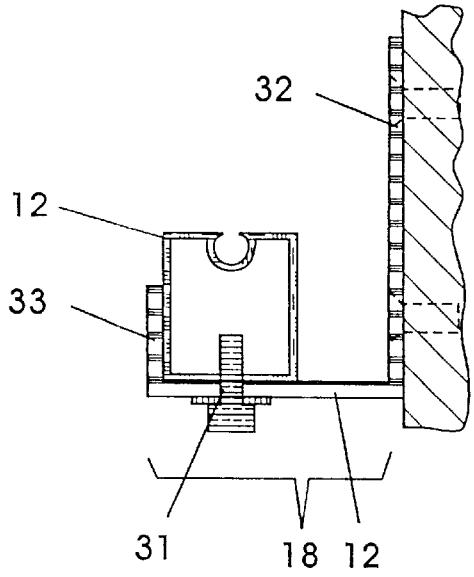
Figure 14B:
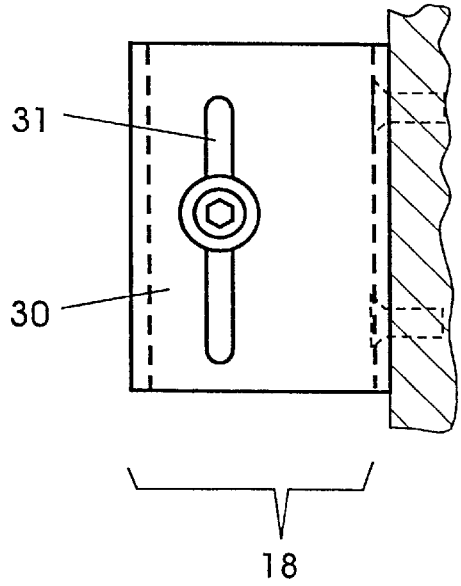

FIG. 14*a* a cross-section through the mounting of the fixed outer roof spar;

FIG. 14*b* a bottom view of the mounting as in FIG. 14*a;*

Figure 15:
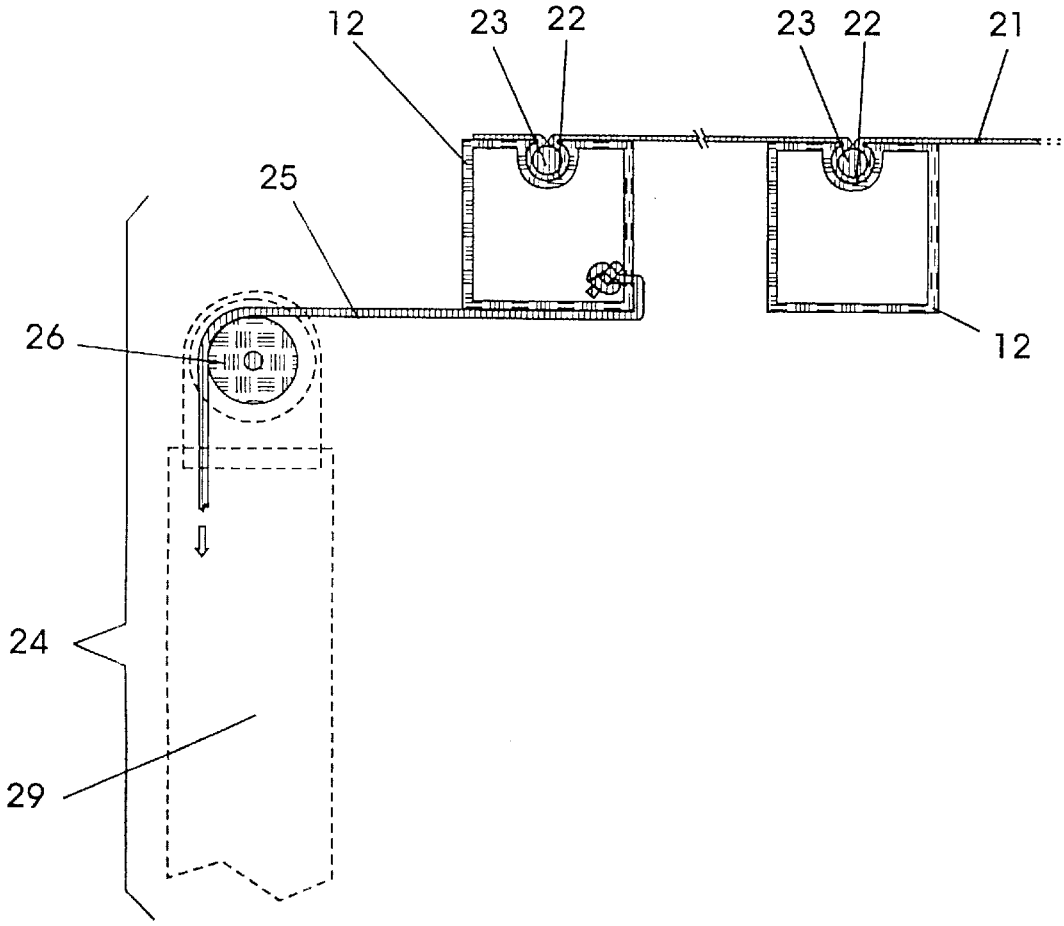
Figure 16:
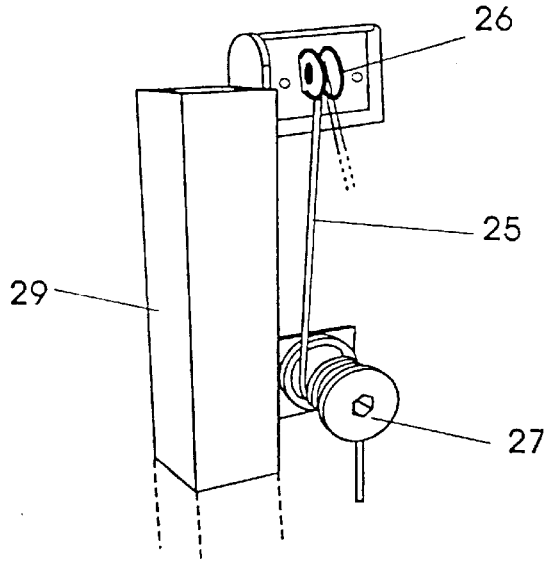
Figure 17:
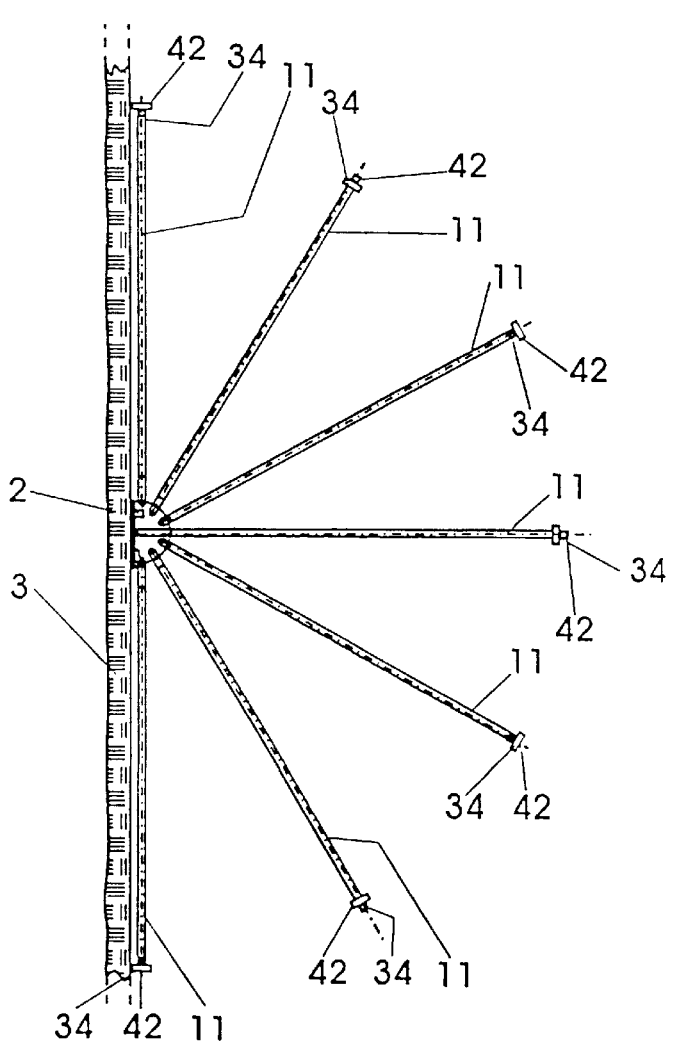
Figure 18A:
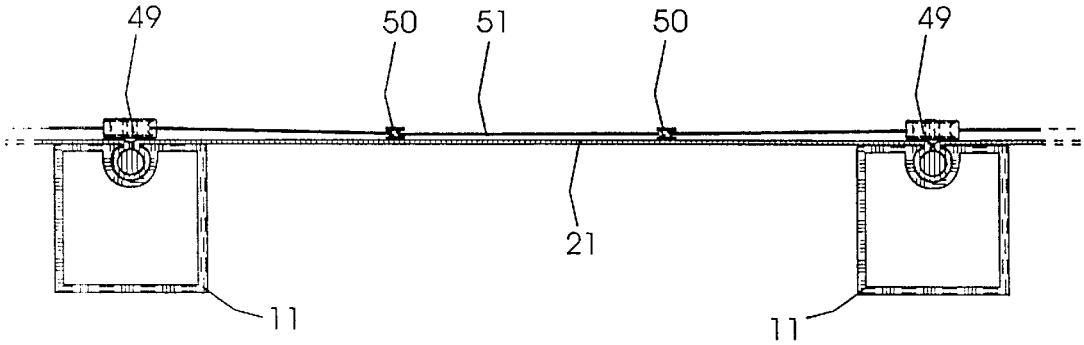
Figure 18B:
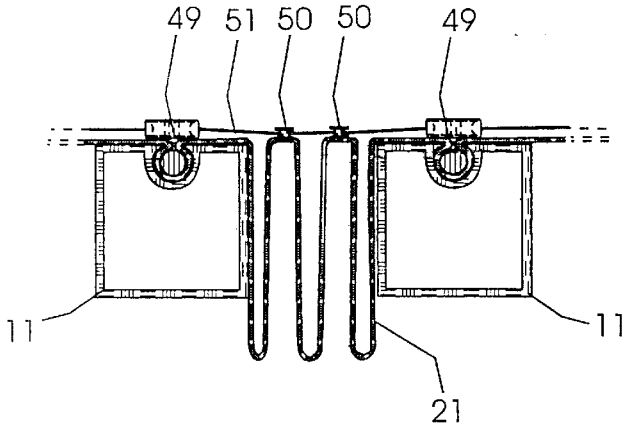
Figure 19:
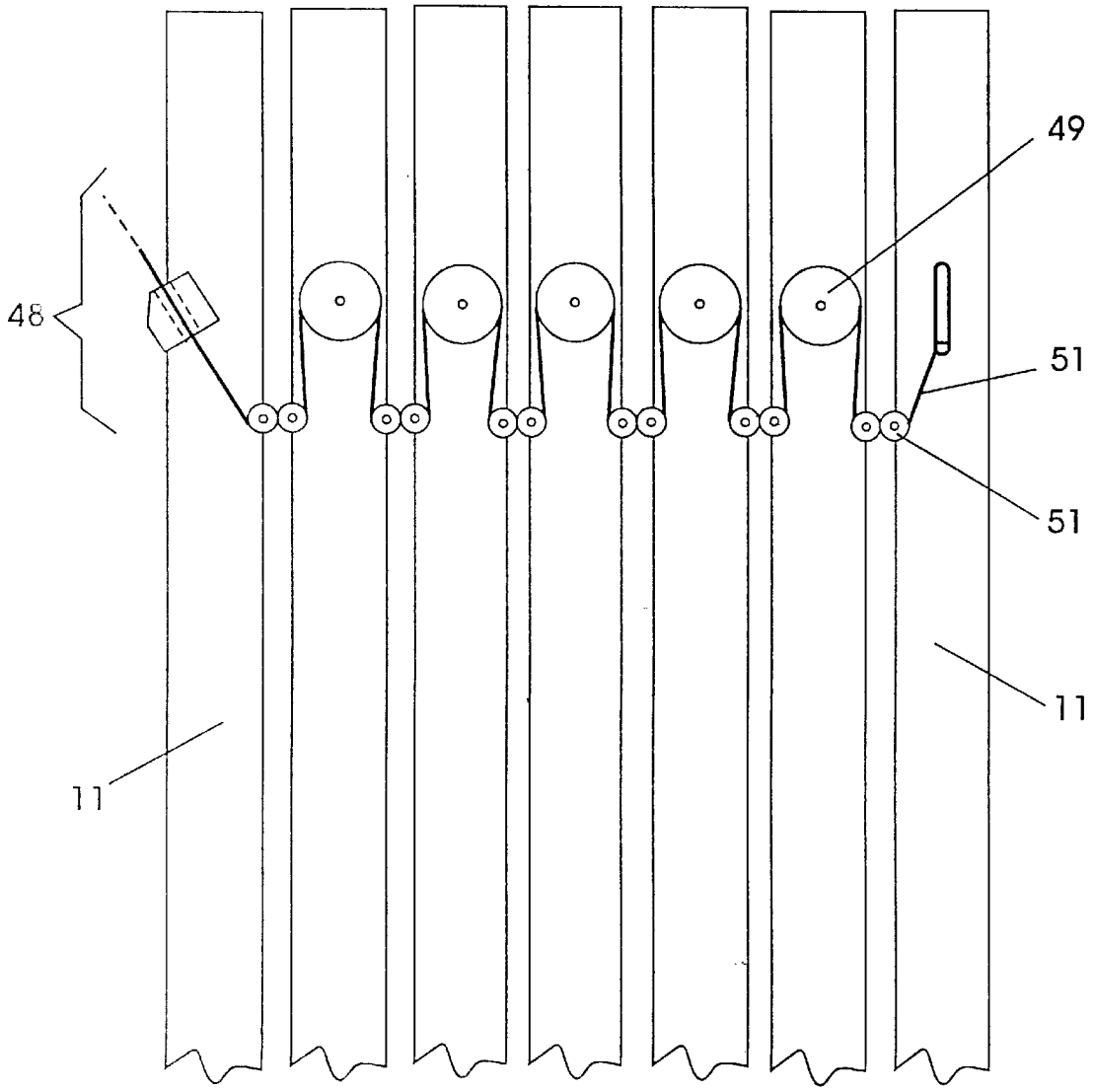
Figure 20:
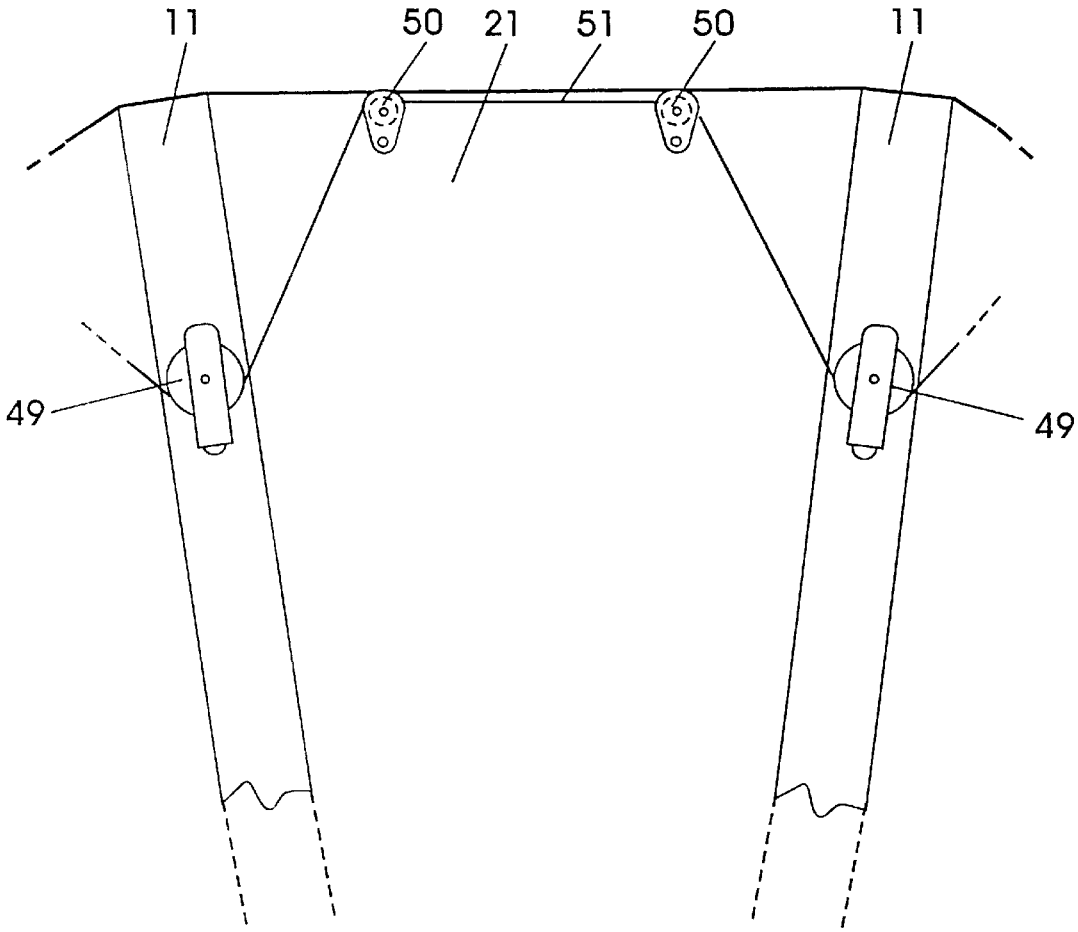
Figure 21:
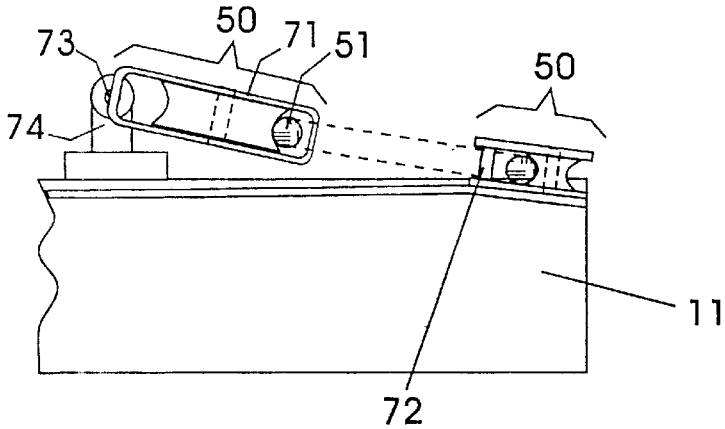
Figure 22:
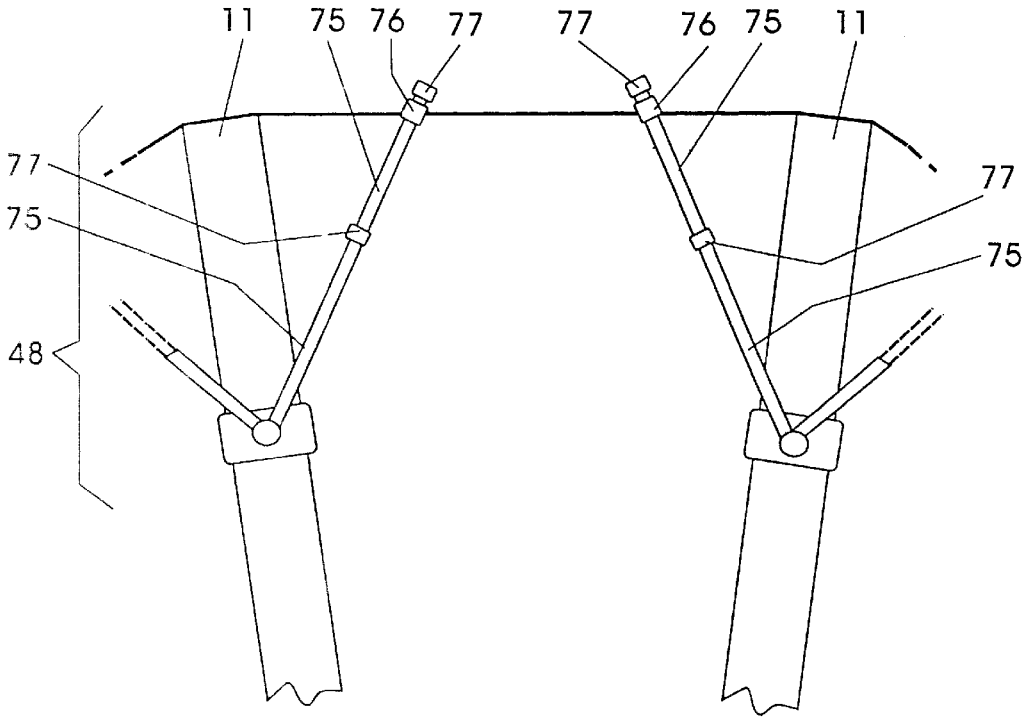
Figure 23:
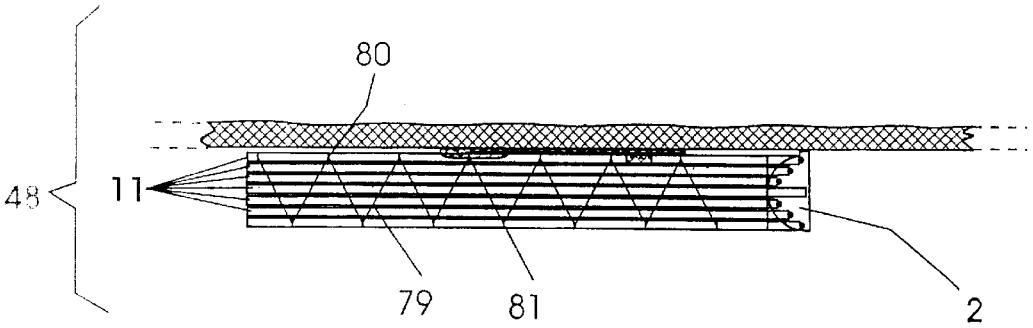
Figure 24:
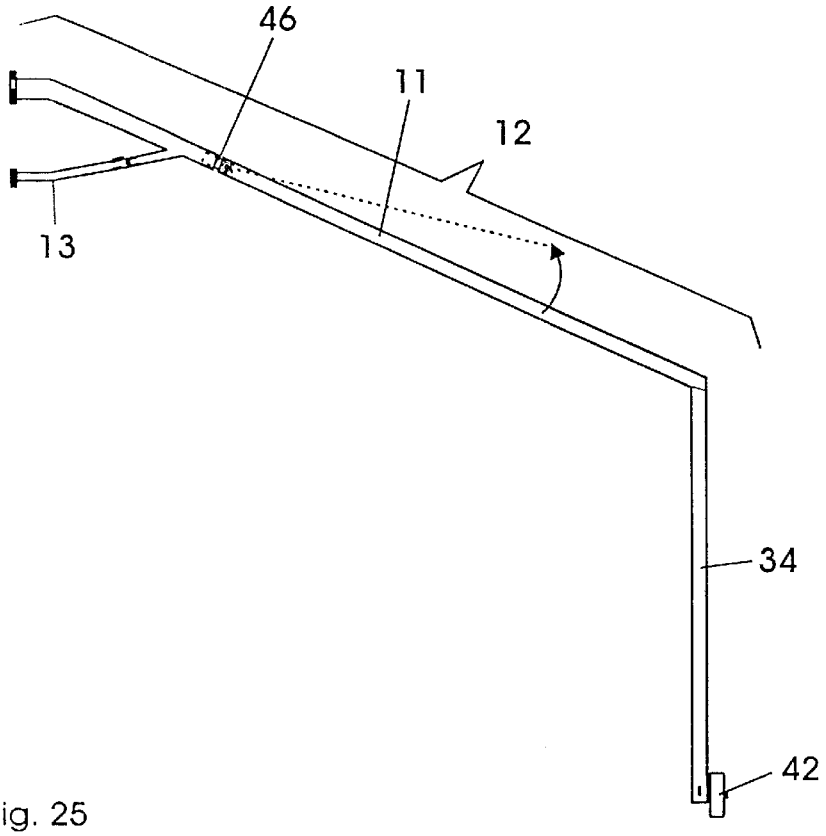
Figure 25:
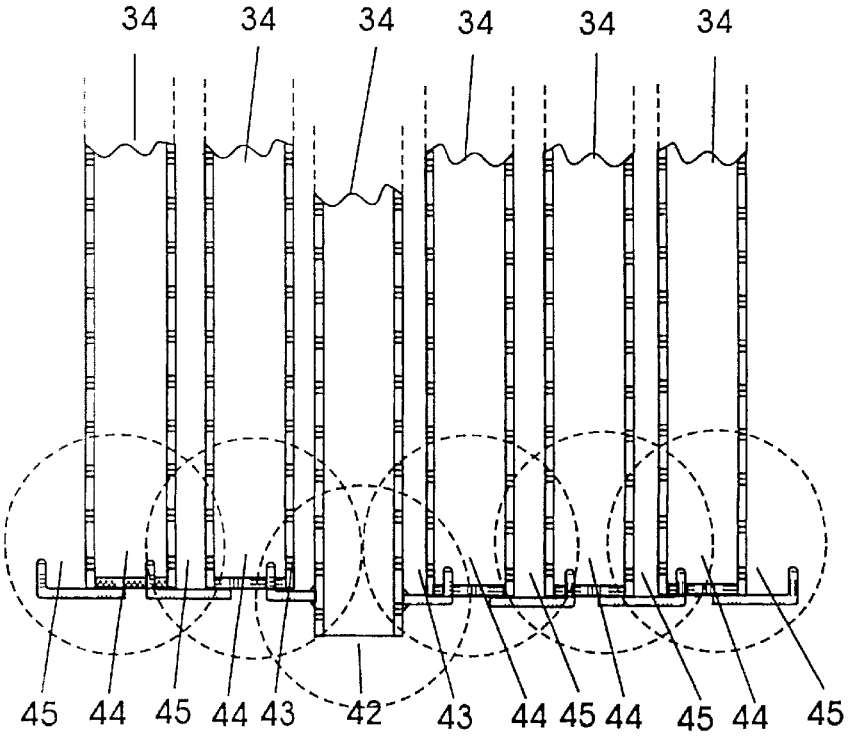
Figure 26:
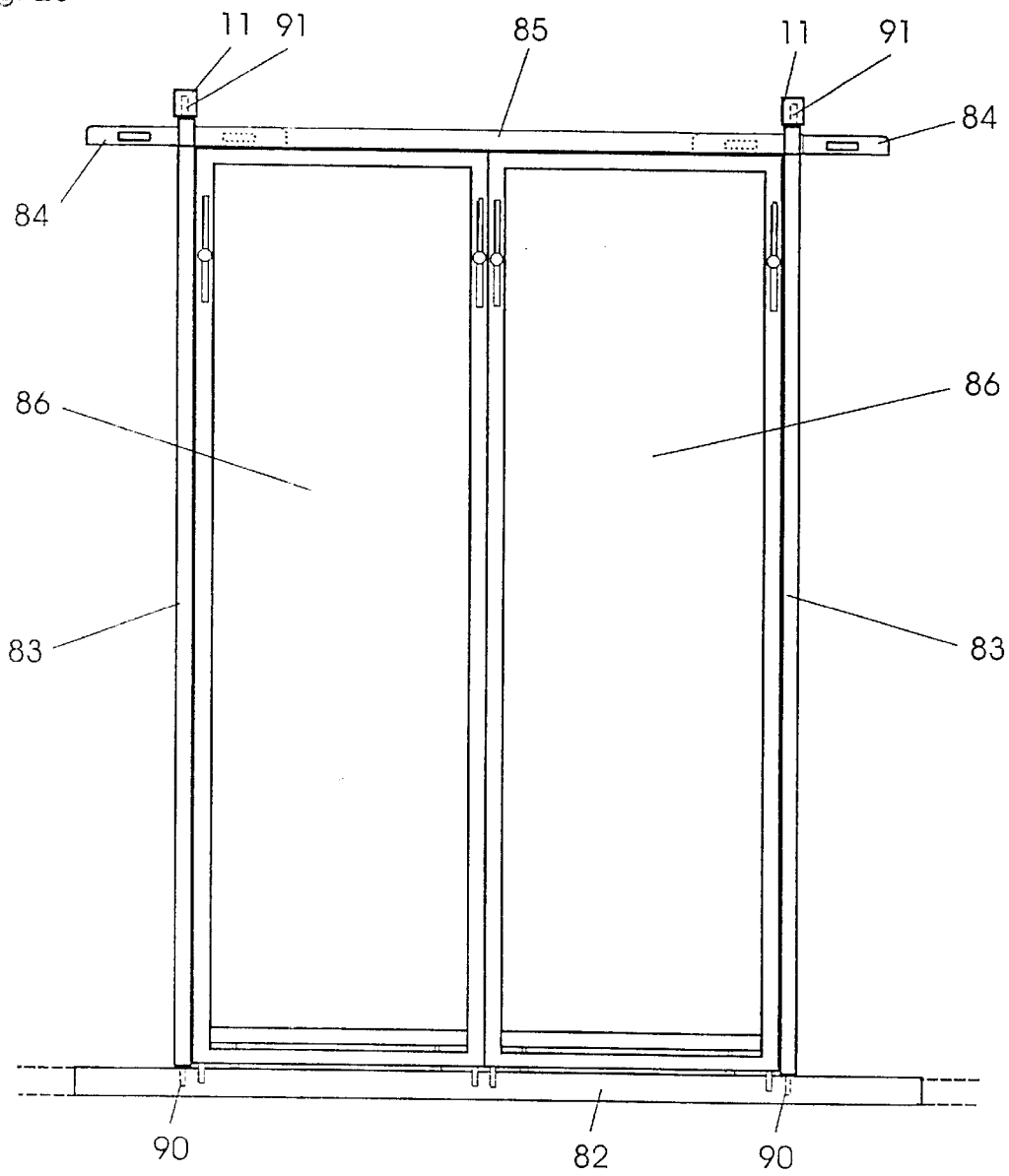
Figure 27:
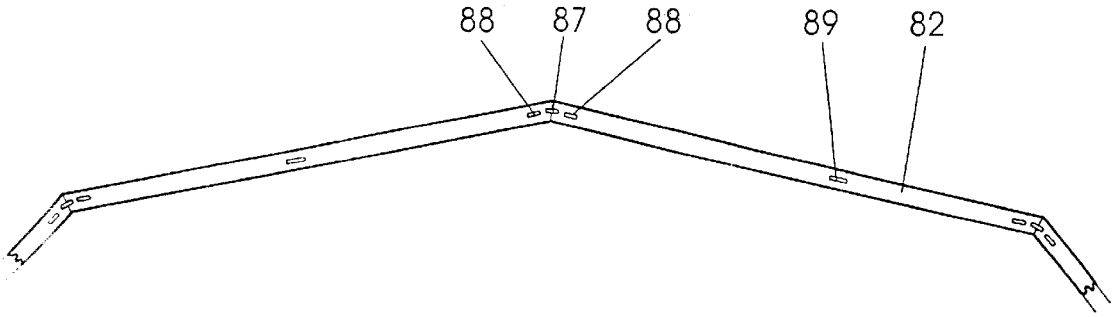
Figure 28:
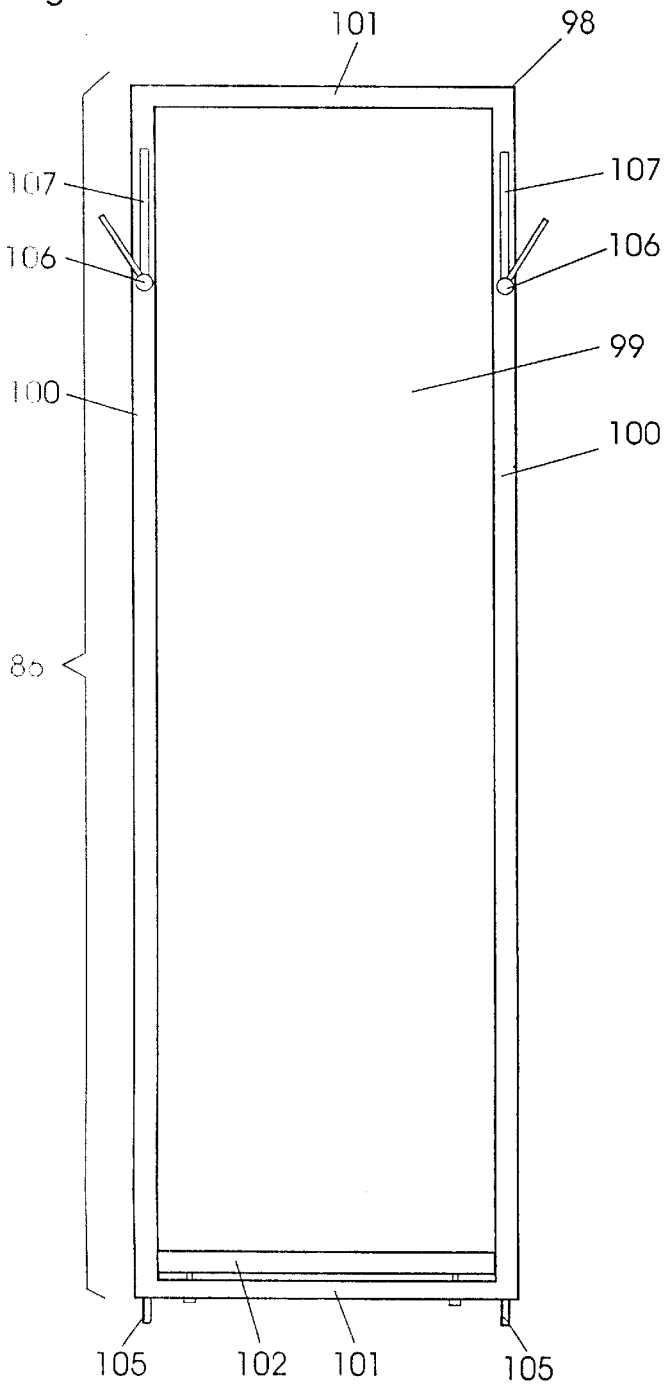
Figure 29:
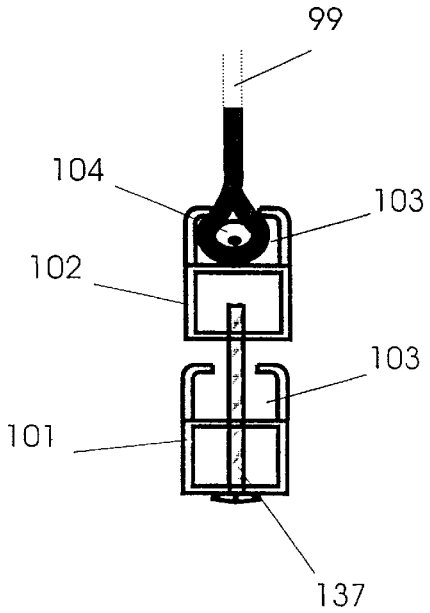
Figure 30A:
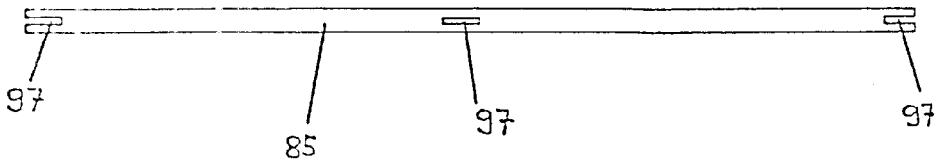
Figure 30B:
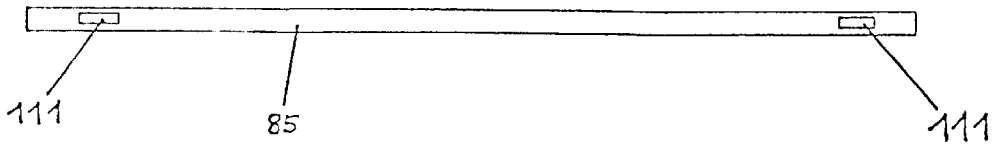

FIG. 15 a cross-section through the tension cable and the deflecting pulley of a tensioning device;

FIG. 16 a perspective view of the deflecting pulley and the winch of a tensioning device;

FIG. 17 a top view of the roof spars of an extended pavilion with side supports;

FIG. 18*a* a cross-section through the gathering device of an initial design variant of the end section of two roof spars swiveled apart;

FIG. 18*b* a cross-section through the gathering device of the first design variant of the outer end section of two roof spars swiveled apart;

FIG. 19 a top view of the gathering device of the first design variant with pavilion roof collapsed;

FIG. 20 a top view of part of the gathering device of the first design variant showing two roof spars swiveled apart;

FIG. 21 a side view of a large and a small deflecting pulley of a gathering device of the first design variant;

FIG. 22 a top view of a gathering device of a second design variant;

FIG. 23 a bottom view of a gathering device of a third design variant;

FIG. 24 a side view of a roof spar and a side support;

FIG. 25 a longitudinal section through the lower part of several side supports that are suspended on the central side support;

FIG. 26 a front view of part of a side wall between two vertical side supports;

FIG. 27 a top view of part of the rail to which the side supports and the wall elements are attached;

FIG. 28 a front view of a wall element;

FIG. 29 a cross-section through the lower transverse bar of a wall element and the corresponding tensioning bar;

FIG. 30*a* a top view of a transverse strut;

FIG. 30*b* a side view of a transverse strut as in FIG. 30*a;*

Figure 31A:
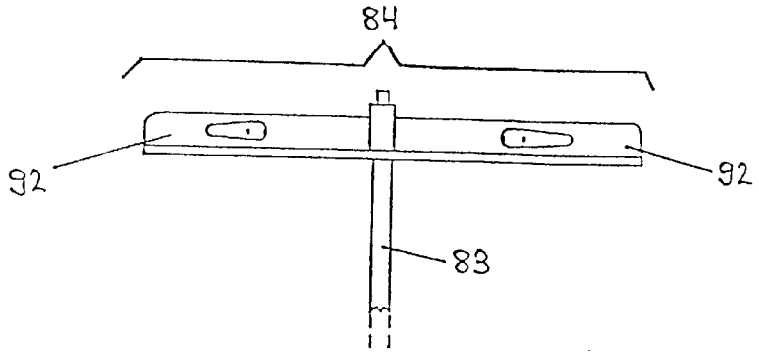
Figure 31B:
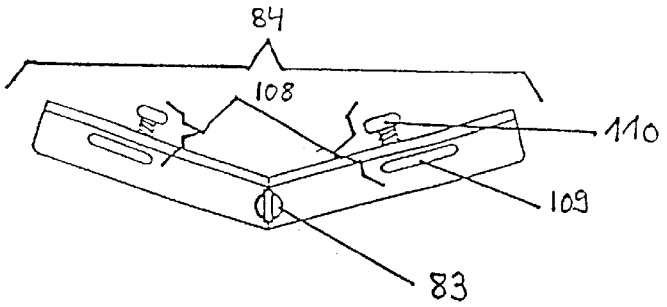
Figure 31C:
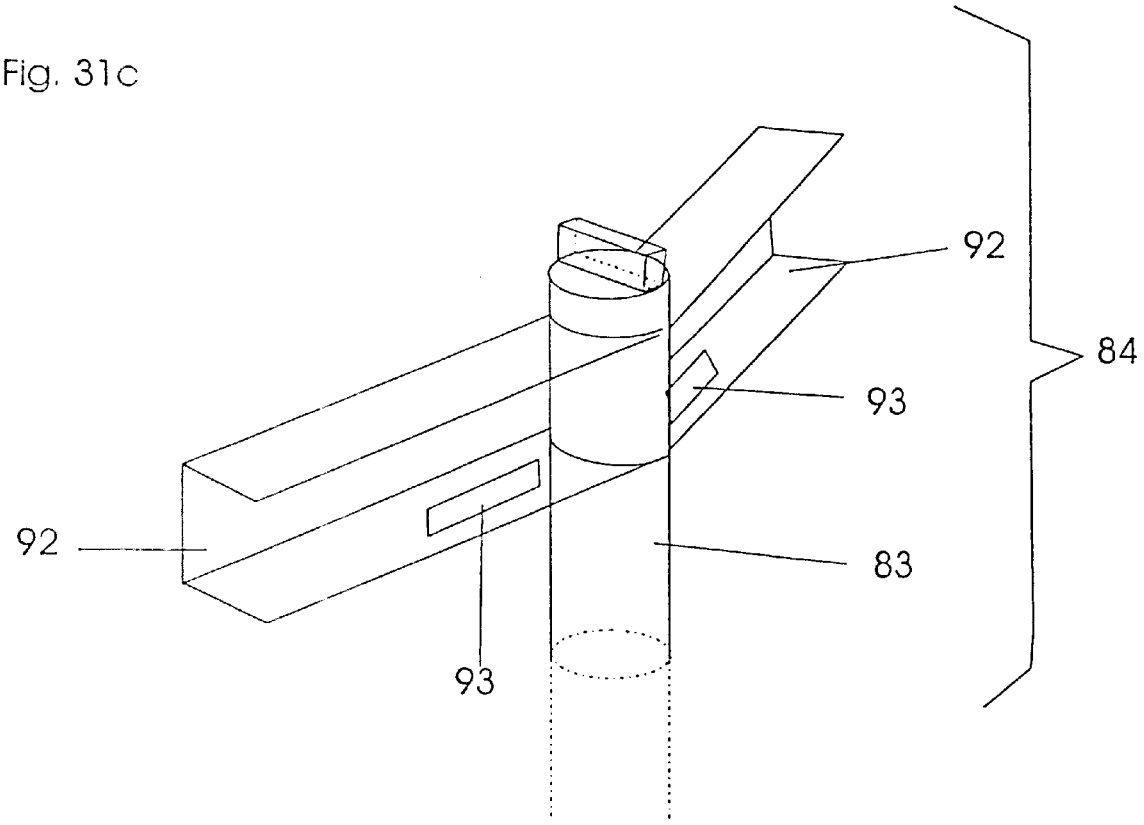

FIG. 31*a* a side view of a fixture on a side support;

FIG. 31*b* a top view of a fixture as in FIG. 31*a* (the upper transverse bar of the U-profile has been omitted for clarity);

FIG. 31*c* a perspective view of the fixture as in FIG. 31*a;*

Figure 32:
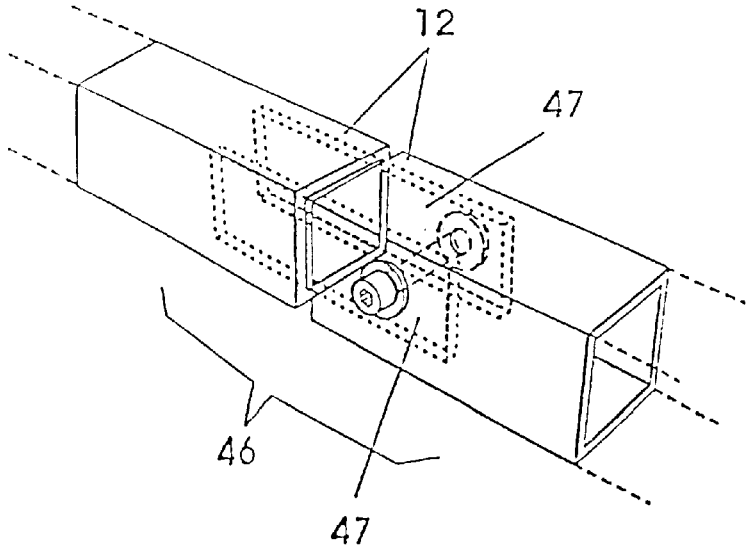
Figure 33A:
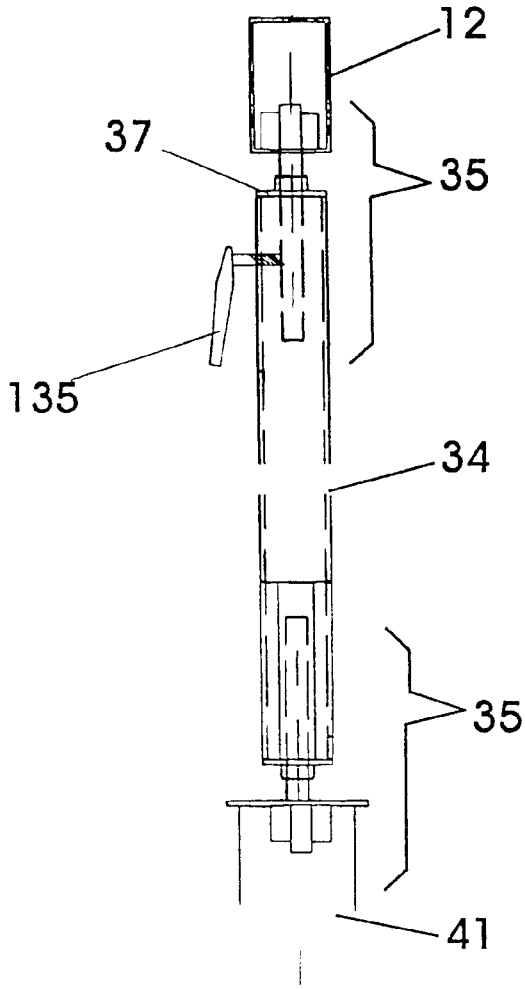
Figure 33B:
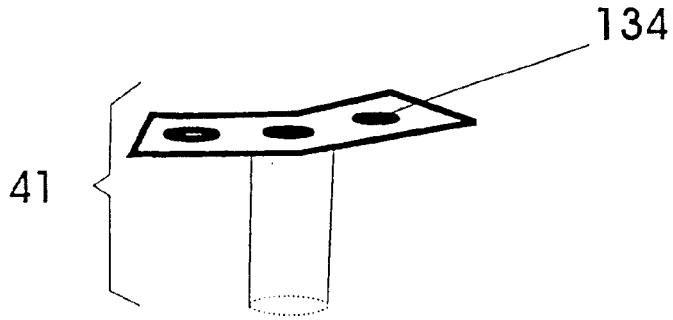
Figure 34:
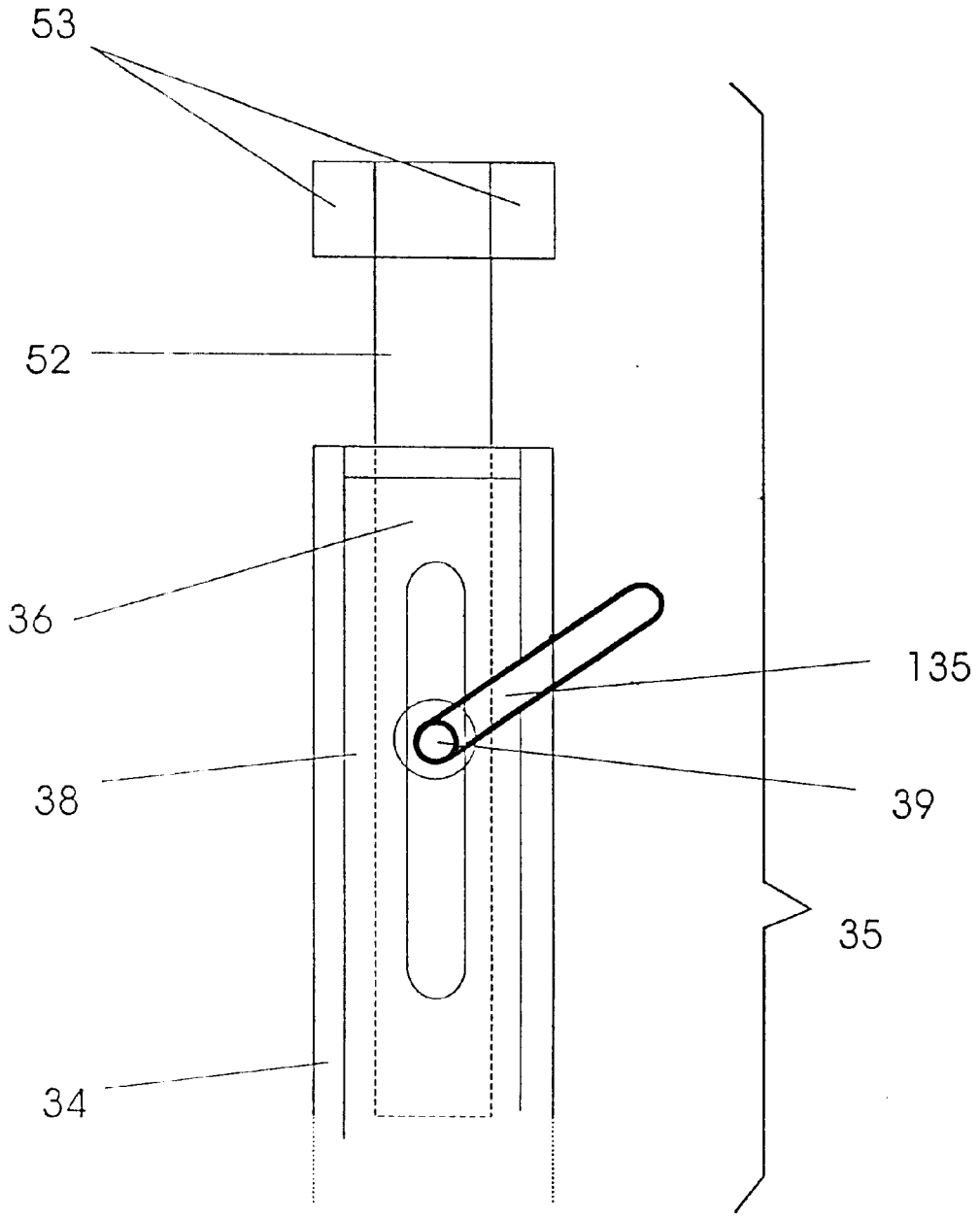
Figure 35:
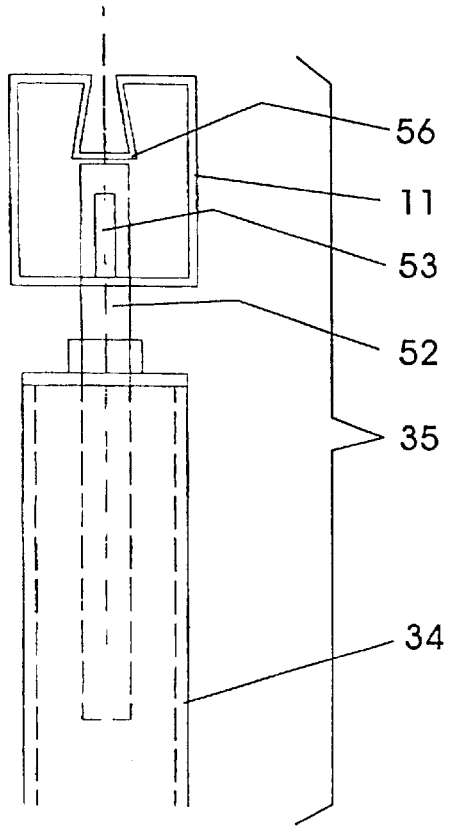
Figure 36:
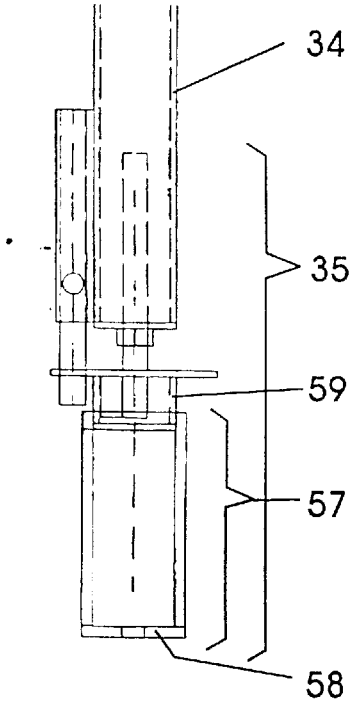
Figure 37A:
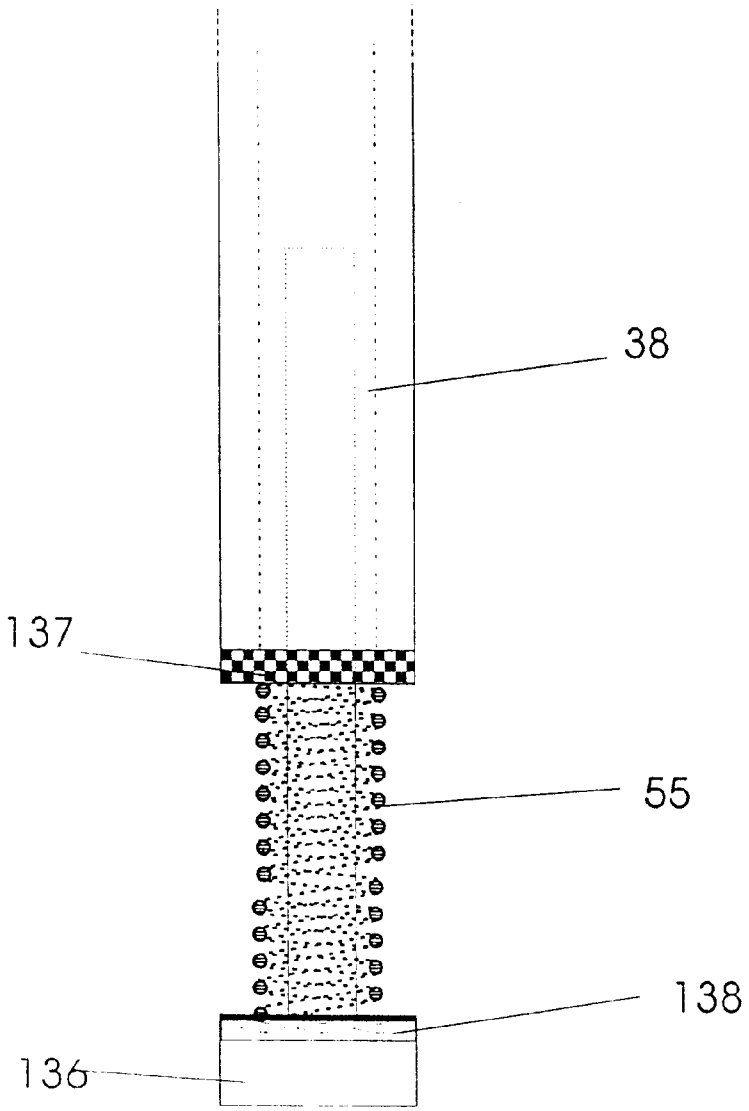
Figure 37B:
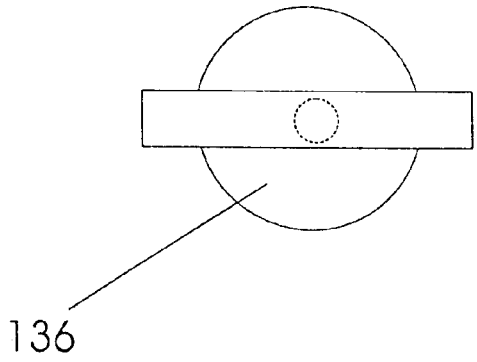

FIG. 32 a perspective view of the compensating hinge of a roof spar;

FIG. 33*a* a side view of the upper and lower quick fastening device of a side support, whereby both the upper and the lower quick fastening devices are assembled and closed;

FIG. 33*b* a perspective view of the ground element for fixing the side support;

FIG. 34 a longitudinal section through the key side of a quick fastening device;

FIG. 35 a quick fastener of a second design variant at the upper end of a side support;

FIG. 36 a quick fastener of a second design variant at the lower end of a side support;

FIG. 37*a* a quick fastener of a third design variant with a tensioning spring;

FIG. 37*b* a top view of a quick fastener as in FIG. 37*a;*

Figure 38:
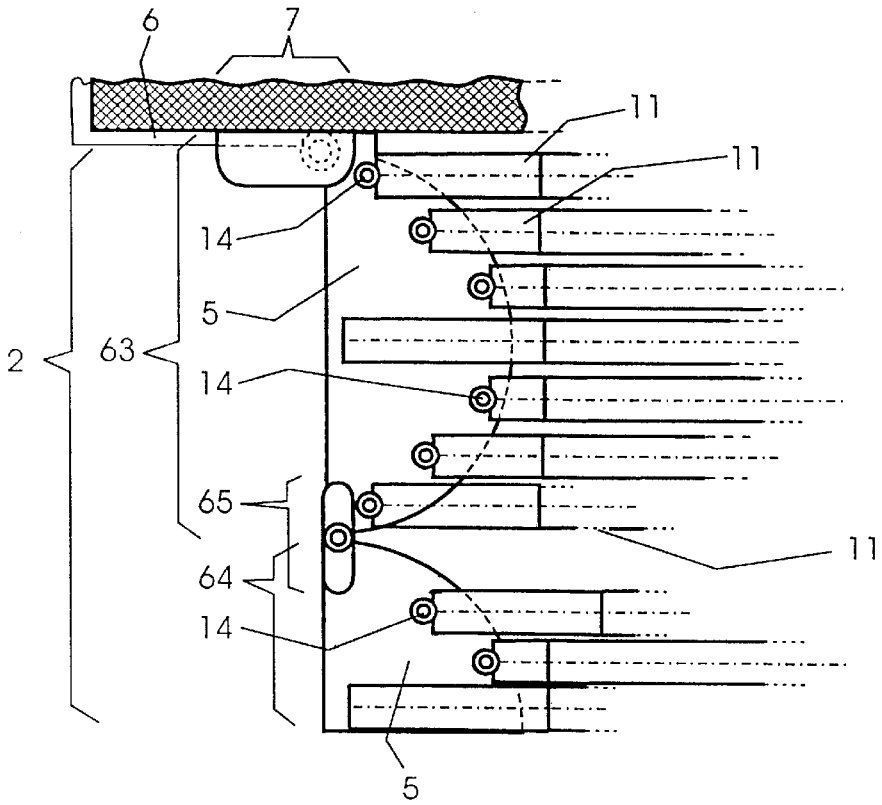
Figure 39:
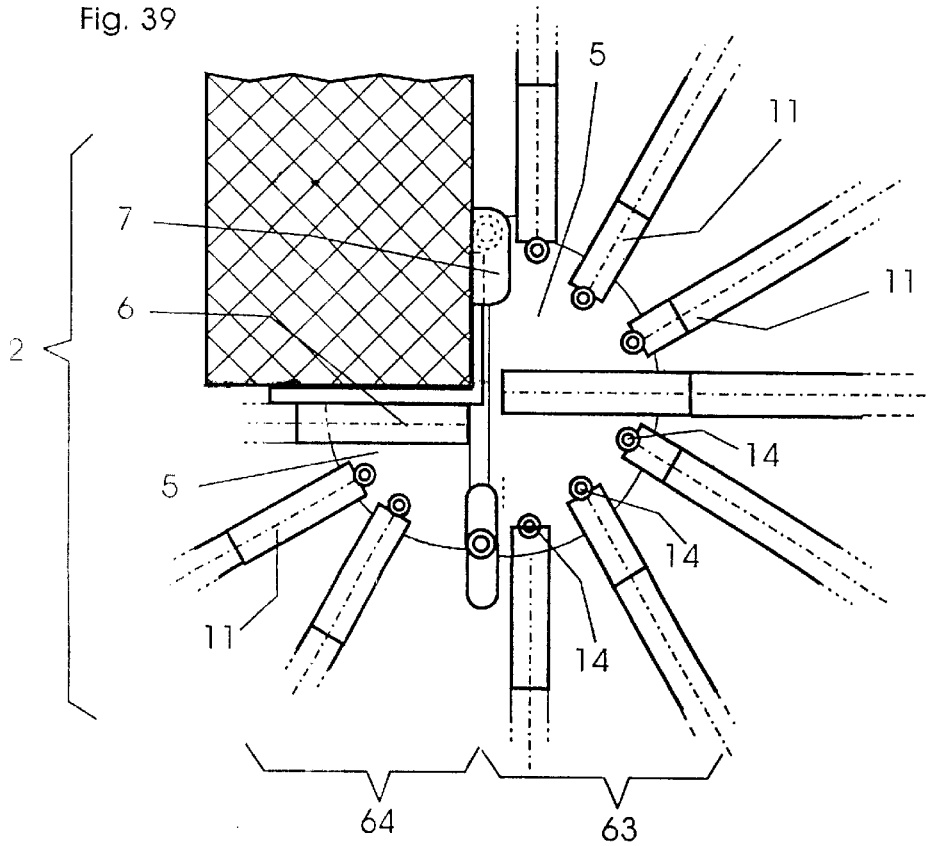
Figure 40:
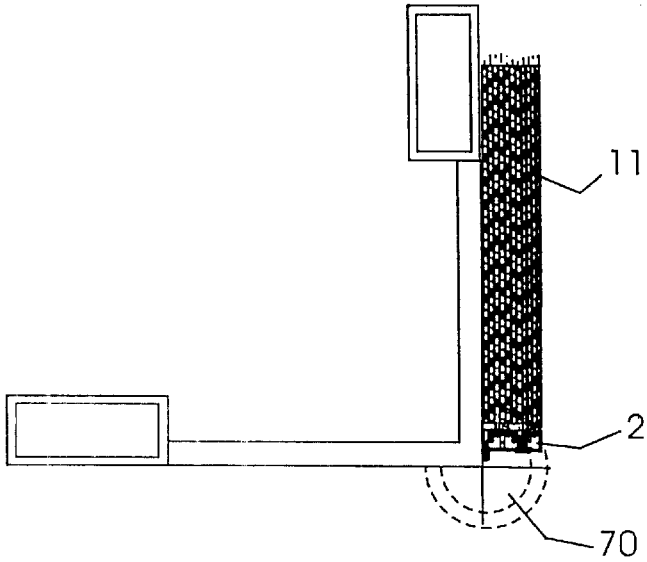
Figure 41:
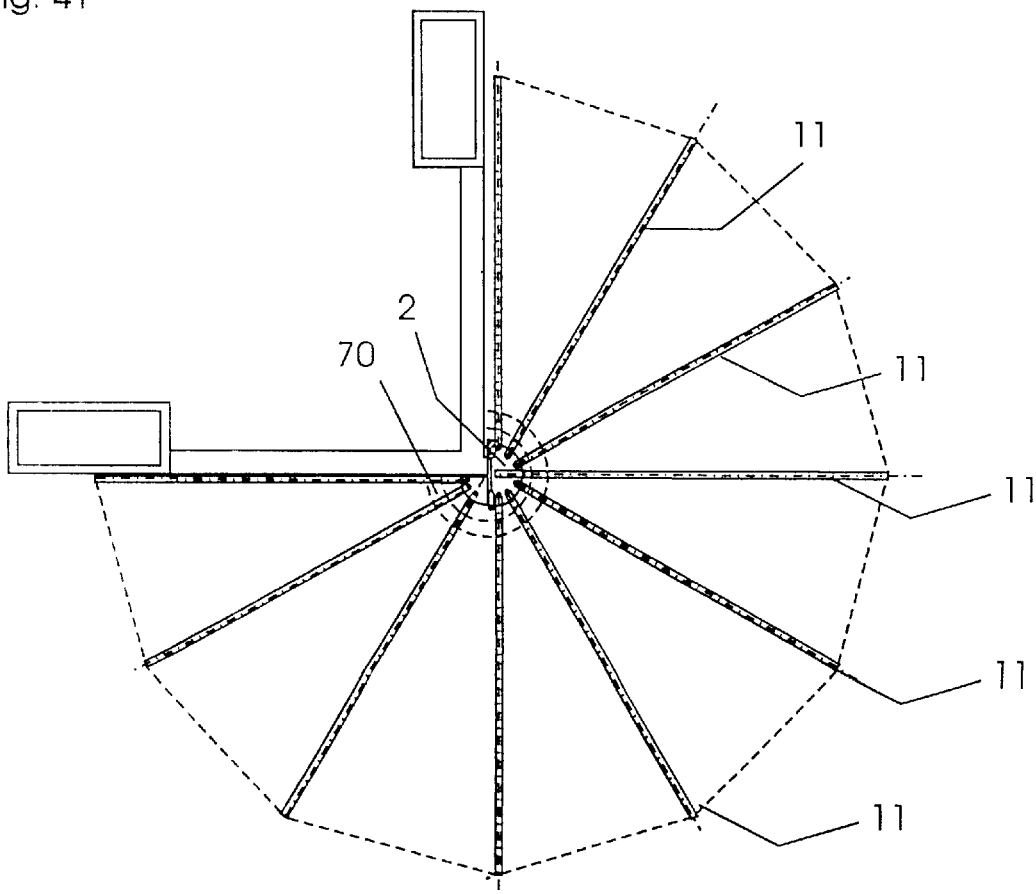
Figure 42:
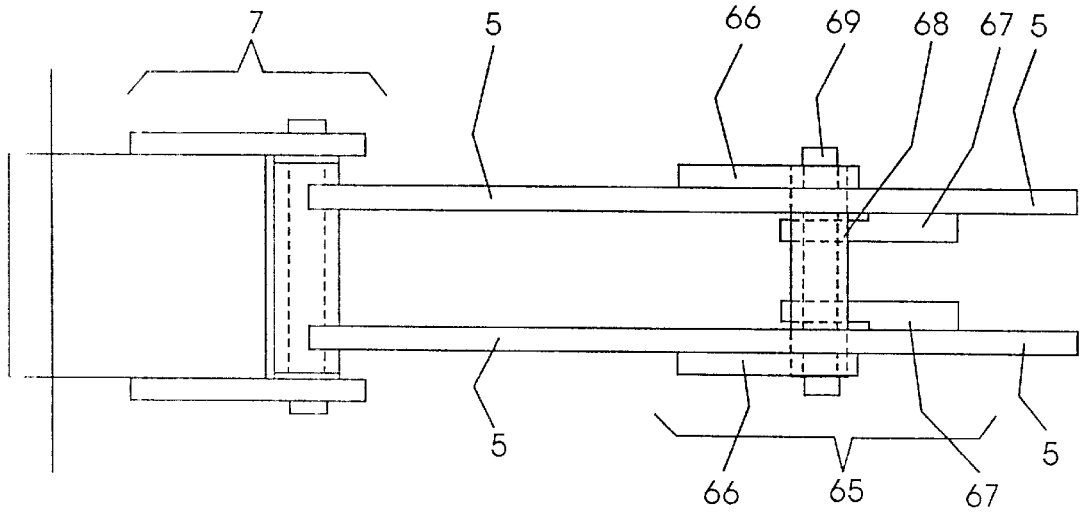
Figure 43:
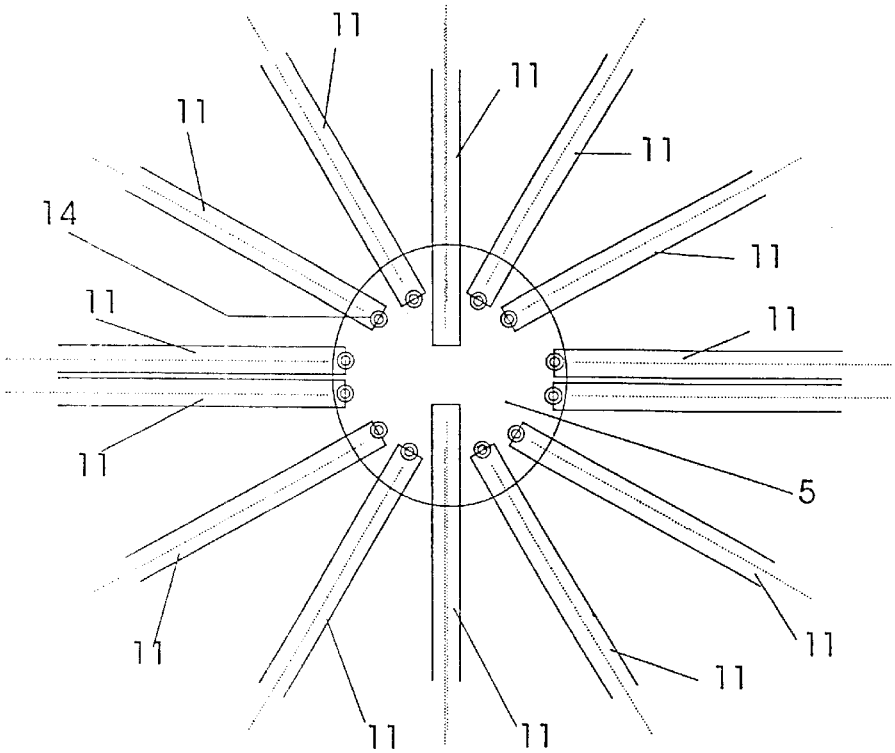
Figure 44:
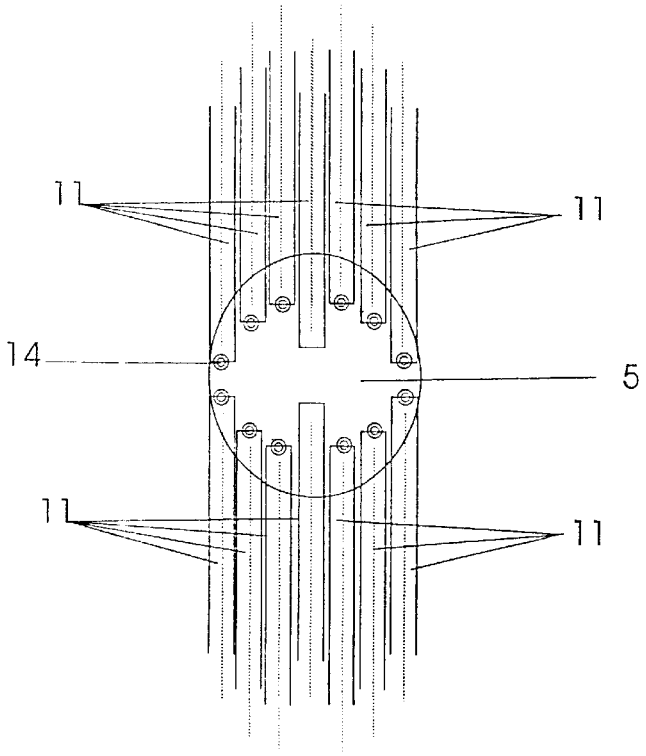
Figure 45:
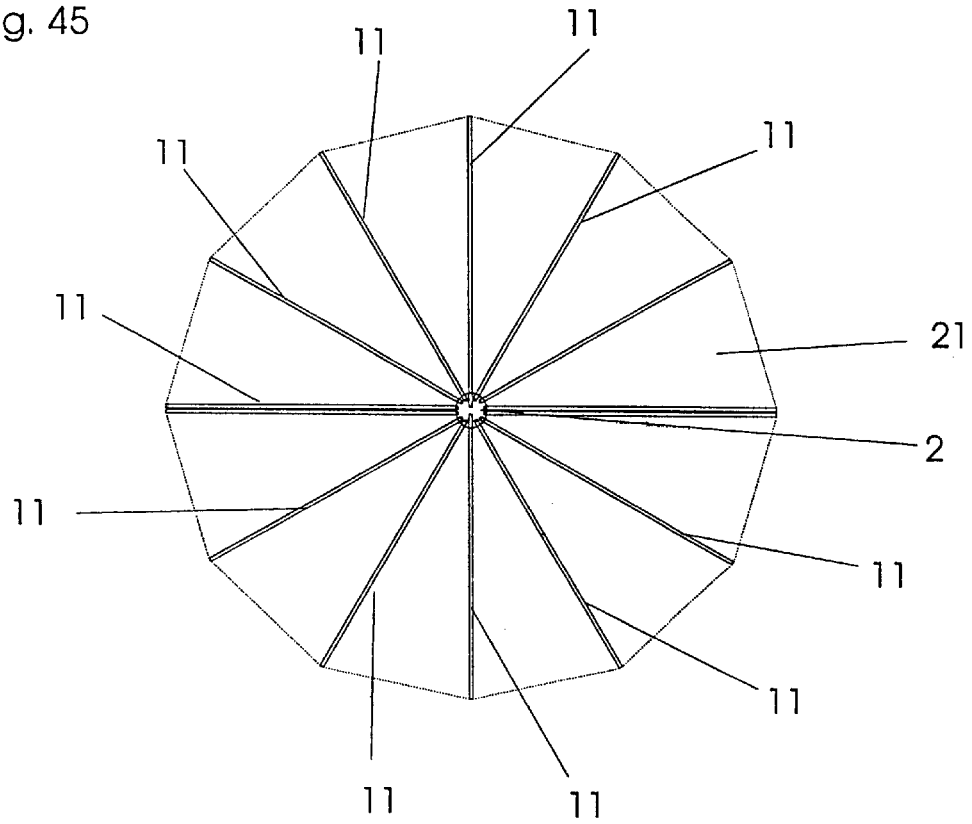
Figure 46:
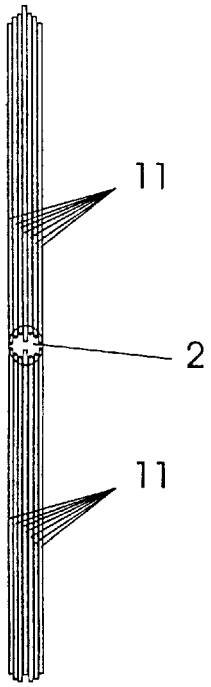
Figure 47A:
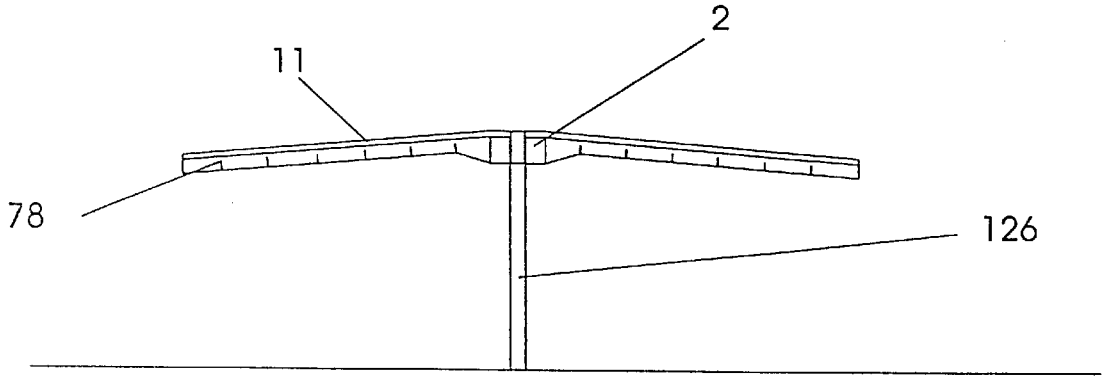
Figure 47B:
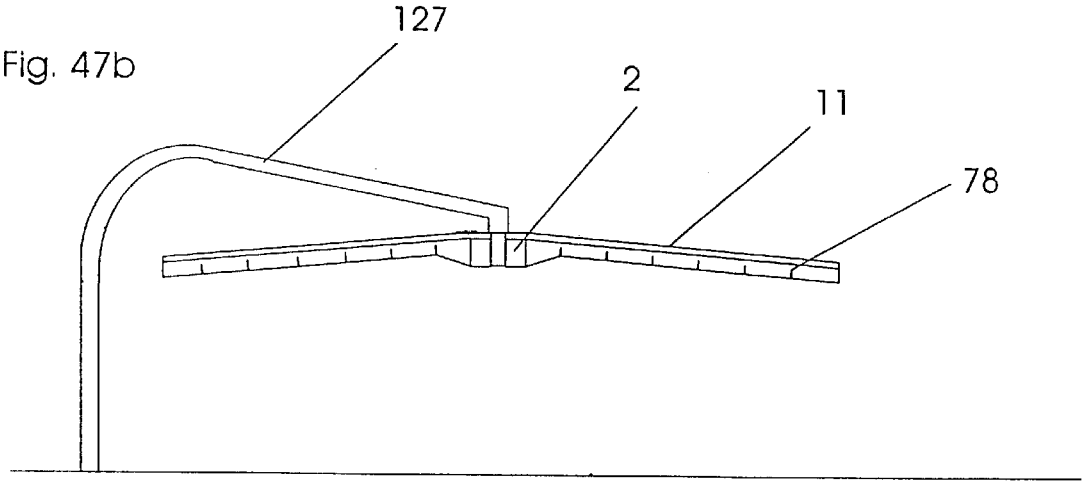
Figure 48:
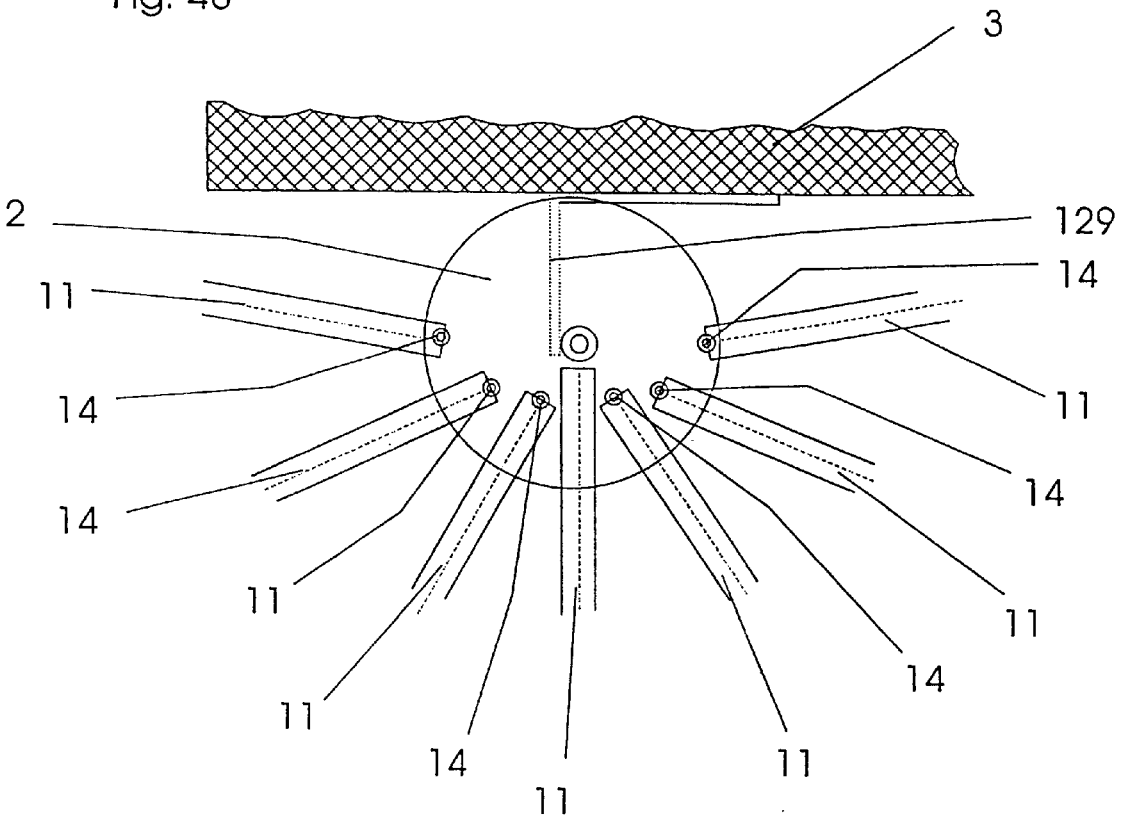
Figure 49:
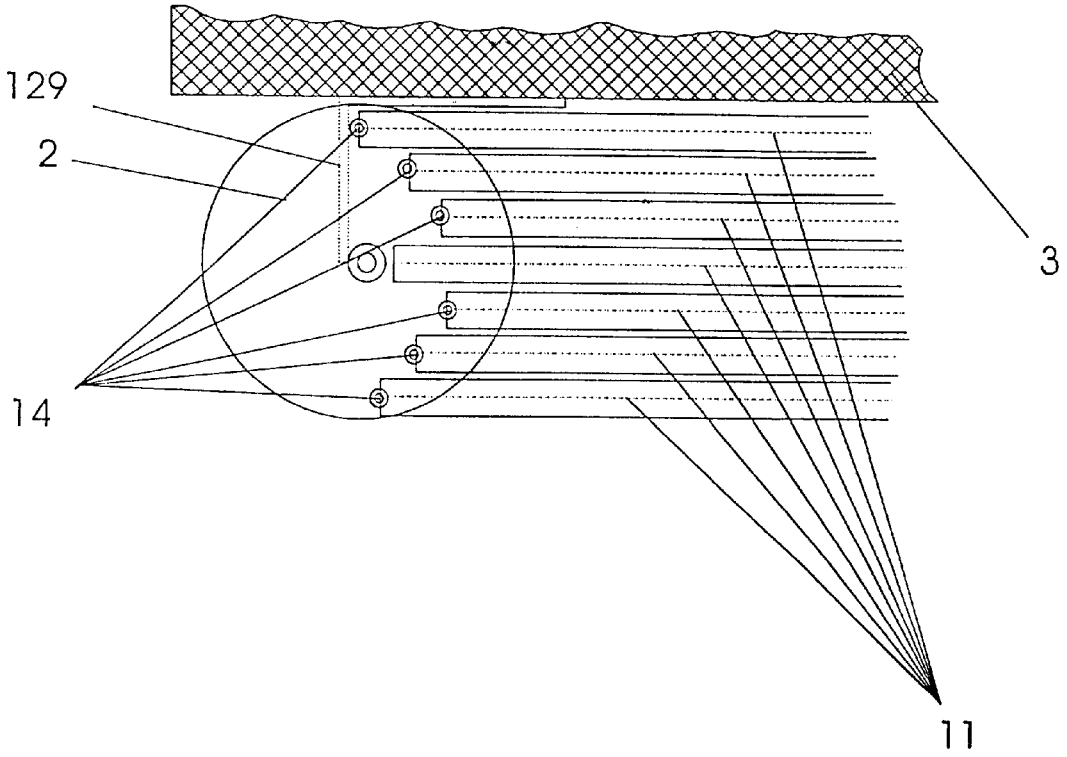
Figure 50:
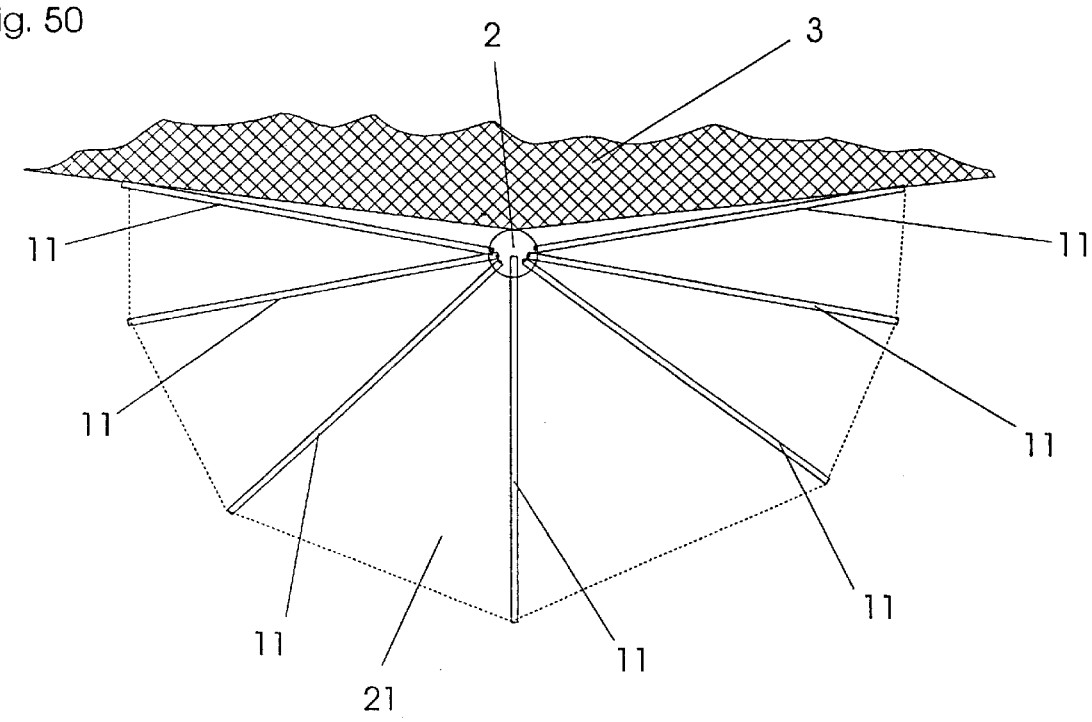
Figure 51:
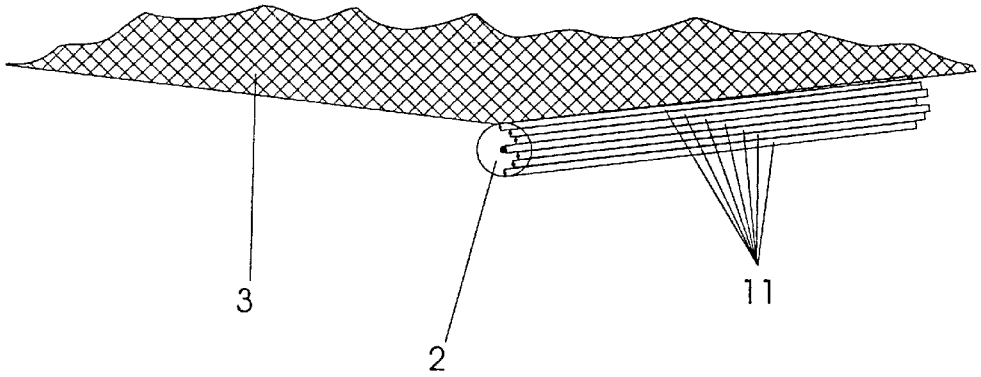
Figure 52:
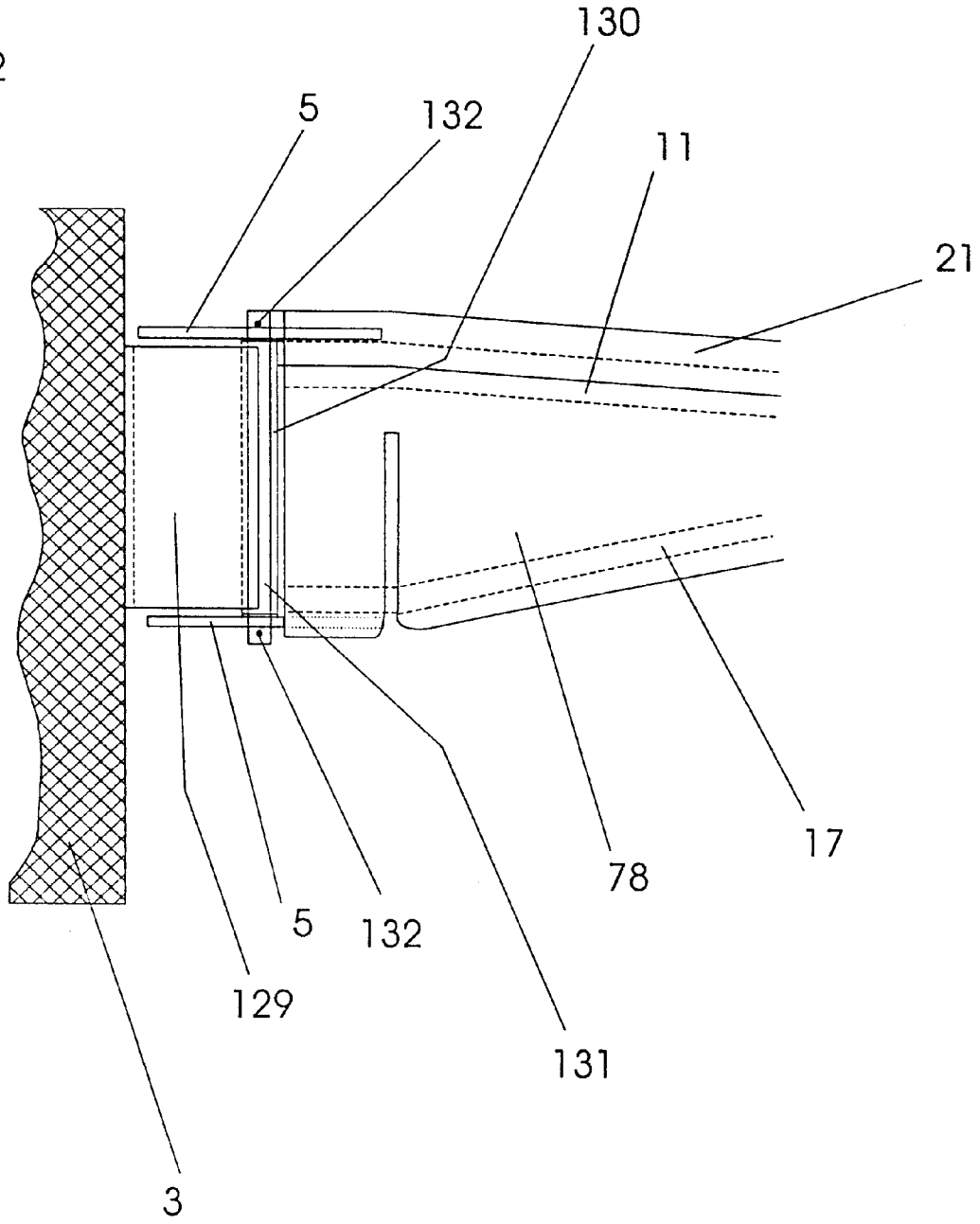
Figure 53:
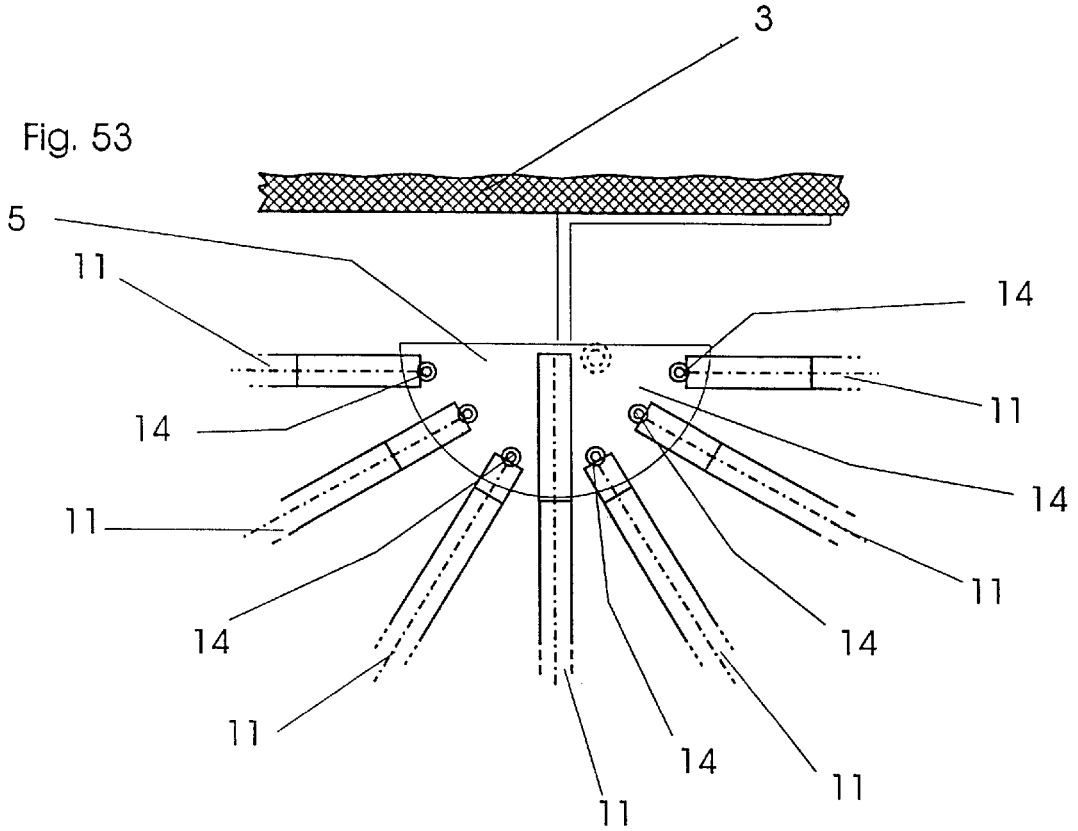
Figure 54:
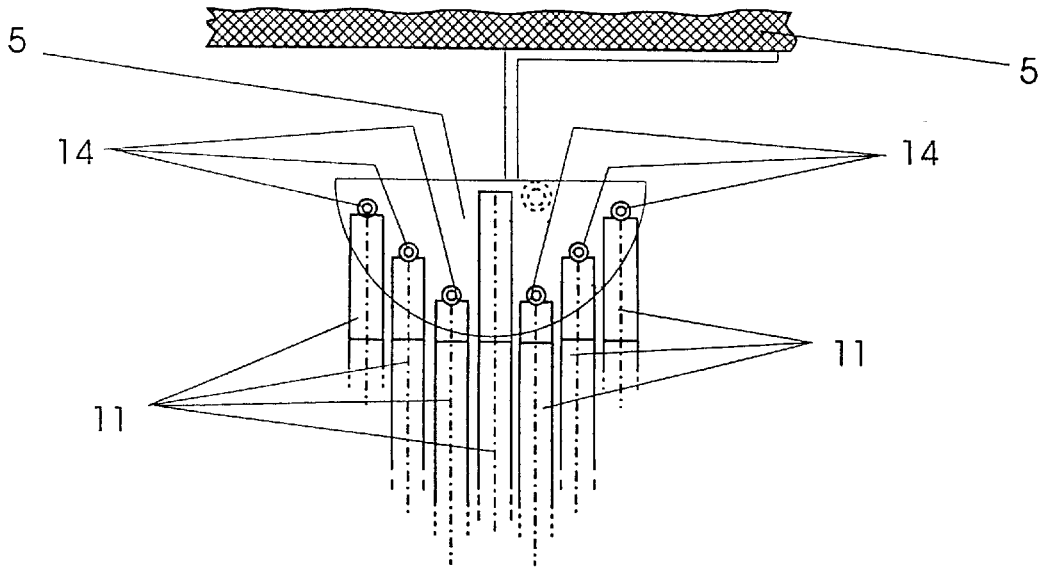
Figure 55:
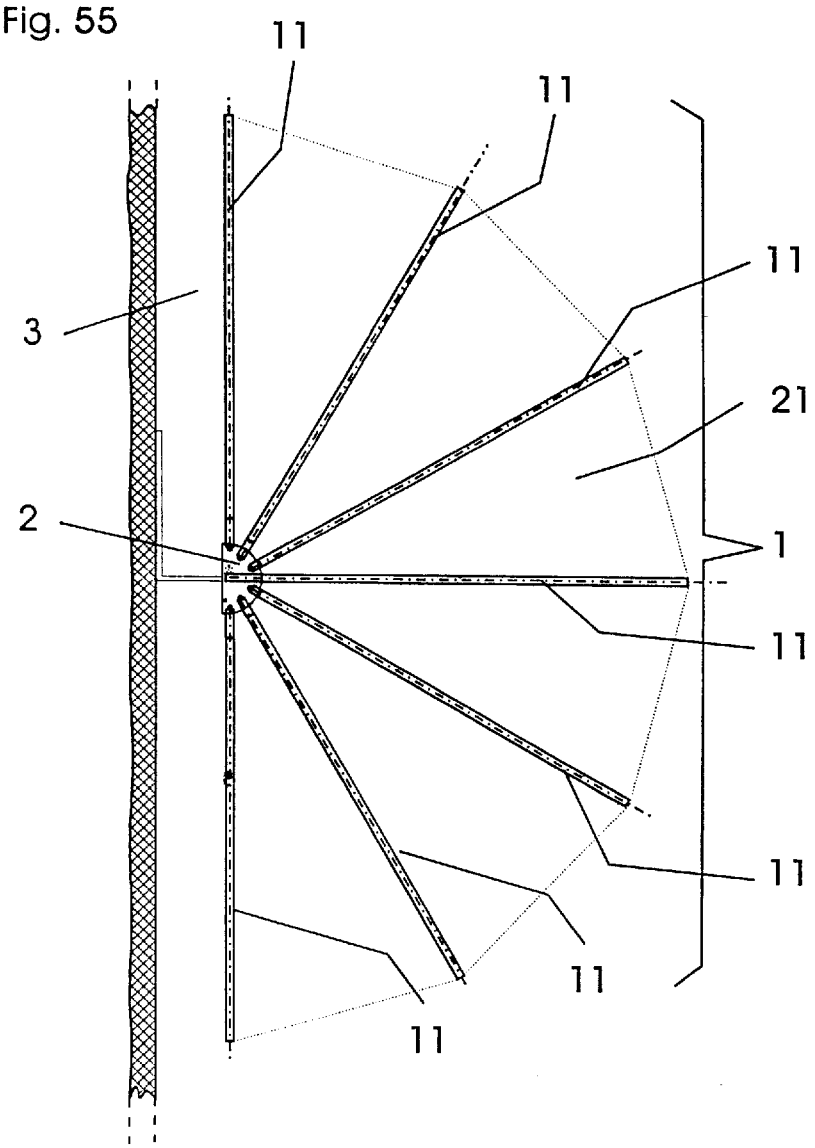
Figure 56:
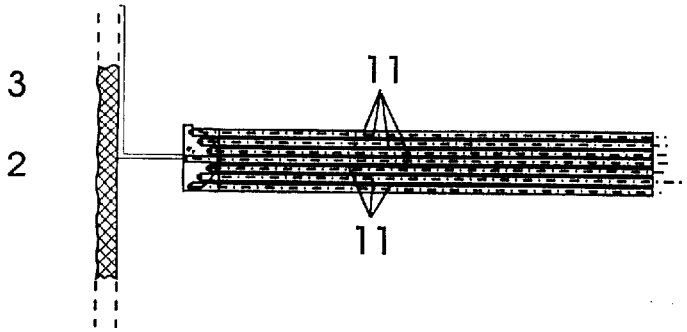
Figure 57:
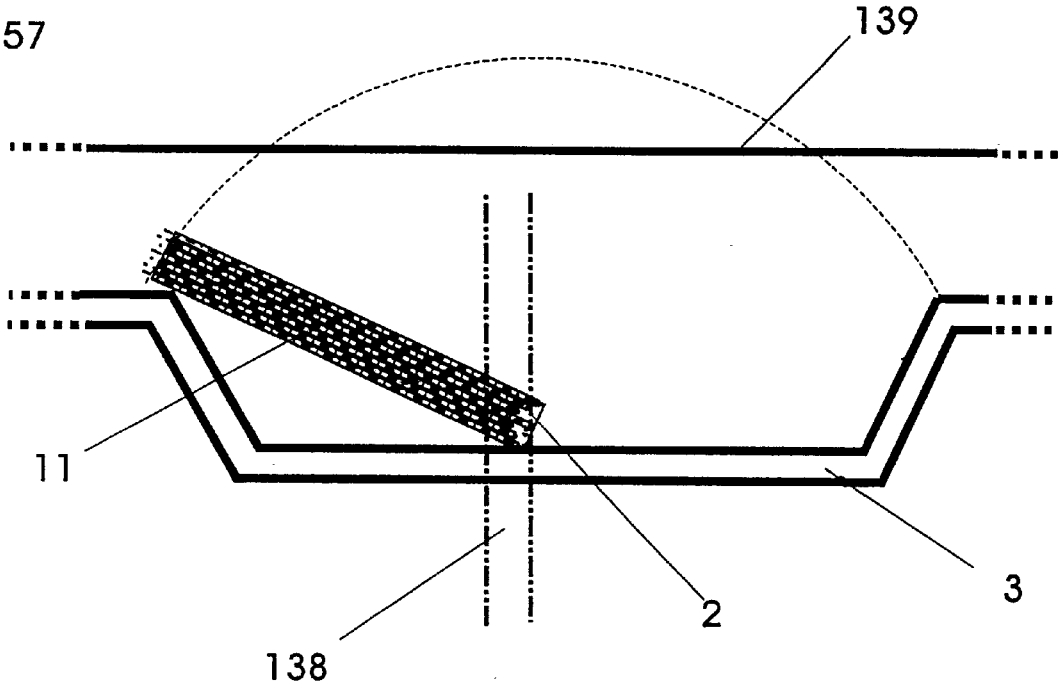
Figure 58:
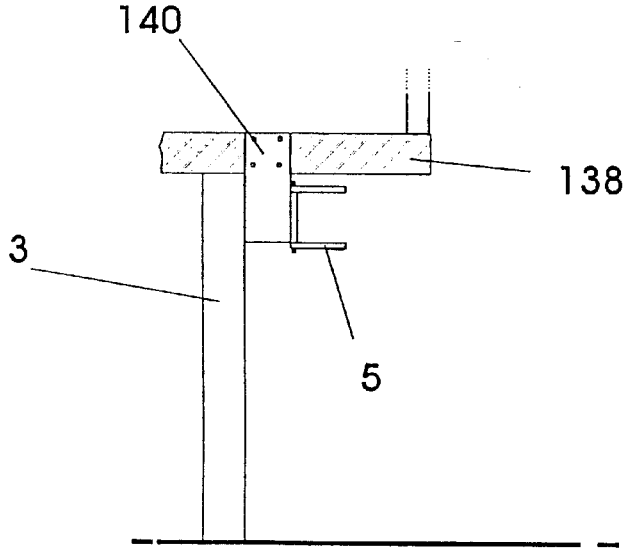

FIG. 38 a top view of a nodal element of a collapsed pavilion with a maximum opening angle of 270°;

FIG. 39 a top view of a nodal element of an extended pavilion with a maximum opening angle of 270°;

FIG. 40 a top view of a collapsed pavilion with a maximum opening angle of 270°;

FIG. 41 a top view of an extended pavilion with a maximum opening angle of 270°;

FIG. 42 a side view of a nodal element as in FIG. 38;

FIG. 43 a top view of a nodal element of an extended pavilion with a maximum opening angle of 360°;

FIG. 44 a top view of a nodal element of a collapsed pavilion with a maximum opening angle of 360°;

FIG. 45 a top view of an extended pavilion with a maximum opening angle of 360°;

FIG. 46 a top view of a collapsed pavilion with a maximum opening angle of 360°;

FIG. 47*a* a side view of a pavilion with a maximum opening angle of 360° attached according to a first design variant to a central mast;

FIG. 47*b* a side view of a pavilion with a maximum opening angle of 360° attached according to a second design variant to an arched steel mast;

FIG. 48 a top view of a circular nodal element of an extended pavilion with a maximum opening angle of greater that 180°;

FIG. 49 a top view of a nodal element of a collapsed pavilion with a maximum opening angle of greater than 180°;

FIG. 50 a top view of an extended pavilion with a maximum opening angle of greater than 180°;

FIG. 51 a top view of a collapsed pavilion with a maximum opening angle of greater than 180°;

FIG. 52 a section through a circular nodal element as in FIG. 48;

FIG. 53 a top view of a nodal element of an extended pavilion with an asymmetrical main pivot;

FIG. 54 a top view of a nodal element of a collapsed pavilion with an asymmetrical main pivot;

FIG. 55 a top view of an extended pavilion with an asymmetrical main pivot;

FIG. 56 a top view of a collapsed pavilion with an asymmetrical main pivot;

FIG. 57 a top view of a collapsed pavilion with an asymmetrical main pivot connected to a beam for covering a balcony and FIG. 58 a side view of a nodal element attached to a beam for a pavilion with an asymmetrical main pivot.

Attention is drawn at the outset to the fact that the wind and weather protection device as claimed in the invention comprises solely embodiments having side supports for the formation of a side wall segment and at least one wall element that at least partly closes the side wall segment.

The wind and weather protection device in the form of a pavilion has a maximum opening angle of 180° and is not equipped with vertical side supports 34 and not with a side wall (cf. FIGS. 1*a* and 2*a* to 3*c*) It is suitable, for example, for mounting on the wall of a building 3.

The central nodal element 2 of the roof 1 has two horizontally positioned support plates 5 in the form of a semicircle positioned vertically at a certain distance above each other. For this embodiment, the radius of the support plates 5 is about 225 mm. Furthermore, the nodal element 2 has a vertically positioned, rectangular, mounting plate 6 (cf. FIGS. 4*a* to 4*c* and 7*a* to 7*c*). The two support plates 5 are connected to the mounting plate 6 via a hinge 7. The hinge 7 is located at one corner of the two support plates 5. It comprises two hinge plates 8 attached to the upper and lower edges of the mounting plate 6 so as to extend sideways from this, and a vertical pivot 9 whose upper and lower ends are each attached to a hinge plate 8. A sleeve 10 is passed over the pivot 9 so as to be rotatable. The two support plates 5 are attached to this sleeve 10. The two support plates 5 can be swiveled out by 90°. When retracted, they may be locked to the mounting plate 6. The nodal element 2, support plates 5 and mounting plate 6 compose elements of the mounting device for the roof 1. The mounting plate 6 can lie at the same side of the hinge 7 as the support plates 5 in the retracted position (cf. FIG. 4*a*) or at the other side (not shown).

Seven roof spars 11 extend radially outwards from the central nodal element 2 (cf. FIGS. 2*a* to 4*c*). For the roof spars 11, various design variants are included. For an unreinforced design variant, each roof spar 11 consists of a single long main stay 12 (cf. FIG. 7*d*).

For the first reinforced design variant (cf. FIGS. 7*h* to 7*i*), a flat plate 133 is welded or screwed under the hollow section of the main stay 12 of a roof spar 11. The distance between the support plates 5 of the nodal element 2 is so chosen that the inner end section of the main stay 12 and the flat plate 133 welded or screwed to it can be inserted between the two support plates 5. For the reinforced roof spars 11 of the first design variant, the upper edge of the main stay 12 is in contact with the lower side of the upper support plate 5, and the lower edge of the flat plate 133 with the upper side of the lower support plate 5.

For the second reinforced design variant, each roof spar 11 comprises a long main stay 12 and a reinforcing framework (cf. FIGS. 7*a* and 7*c*). The framework can be positioned either below (cf. FIGS. 7*a* and 7*b*) or above (cf. FIG. 7*c*) the main stay 12. It has at least one short strut 13. The short strut 13 is attached to the inner section of the main stay 12 and is inclined either upwards or downwards from this. The framework may have additional reinforcing struts 4 connecting the long main stay 12 with the short strut 13.

Both the main stay 12, the strut 13 and the reinforcing struts 4 consist preferentially of hollow bars of square cross-section. The inner end section of the main stay 12 is angled off at an acute angle of 50 for example. The strut 13 is positioned at an acute angle to the underside of the upper section of the main stay 12. For the embodiment, this angle is about 15°. The inner end section of the strut 13 is likewise bent upwards at an acute angle. This angle is about 50. The inner ends of the main stay 12 and the strut 13 of a roof spar 11 lie in the same vertical plane. The length of the strut 13 is about 30% of the length of the main stay 12.

The distance between the support plates 5 of the nodal element 2 is so chosen that the inner end section of the main stay 12 (for unreinforced roof spars 11) or the inner sections of the main stay 12 and the strut 13 of each roof spar 11 (for reinforced. roof spars 11) may be inserted between the two support plates 5. For unreinforced roof spars 11, the lower edge of the main stay 12 is in contact with the lower, and the upper edge of the main stay 12 with the upper, support plate 5. For reinforced roof spars 11 having a framework on their underside, the upper edge of the main stay 12 is in contact with the underside of the upper support plate 5 and the lower edge of the strut 13 with the upper side of the lower support plate 5. For the reinforced roof spars 11 having a framework at their upper side, the lower edge of the main stay 12 is in contact with the upper side of the lower support plate 5 and the upper edge of the support 13 with the lower side of the upper support plate 5.

The main stay 12, or accordingly the main stay 12 and the strut 13, of the central roof spar 11 are rigidly connected to the support plates 5. They are preferentially welded or screwed to this. The fixing points are located on the bisecting radius of the two support plates 5.

The main stay 12, or accordingly the main stay 12 and the struts 13, of the six other roof spars 11 are each connected to the support plates 5 via a hinge 14 so as to be rotatable. Each of these hinges 14 has a vertically positioned pivot 15 attached at right-angles to the corresponding support plate 5 at the side facing the respective roof spar 11. For the reinforced roof spars 11, the pivot 15 of the hinge 14 of the main stay 12, and the pivot 15 of the hinge 14 of the strut 13 of the roof spar 11, are aligned. For fixing, each support plate 5 may have a round hole for each pivot 15. Each of these holes accepts an end section of a pivot 15. A sleeve 16 is fitted over each pivot 15 so as to be rotatable. The end face of each main stay 12 and of each strut 13 is connected to the sleeve 16 of the corresponding hinge 14. The fixing points of the hinges 14 on the support plates 5 are displaced symmetrically with respect to the right-angled end faces and the bisecting radius at regular intervals from the bisecting radius. In this, three roof spars 11 lie at each side of the central, rigidly attached, roof spar 11 so as to be horizontally rotatable. The rotatable roof spars 11 may be swiveled to such an extent towards the rigidly attached roof spar 11 until they lie parallel to this (cf. FIGS. 2*b* and 3*b*). The folded roof spars 11 can then be rotated together by swiveling out the support plates 5. In this position, the roof spars 11 lie parallel to the mounting plate 6 (cf. FIGS. 2*c* and 3*c*). If the mounting plate 6 is screwed to the wall of a building 3, the roof spars 11 can thus be swiveled against the wall of the building 3 when the pavilion is not in use.

To correct for manufacturing tolerances, the length of the struts 13 may be adjusted to a certain extent. This is achieved by dividing each strut 13 into two parts.

For the first design variant, the two parts 17 of the strut are connected by a short metal connecting piece 18 whose diameter corresponds to the internal diameter of the struts 13 (cf. FIG. 7*e*). The connecting piece 18 is inserted in the two adjacent sections of the two parts 17 of the strut. It is rigidly connected to a part 17 of the strut, preferentially by welding or screwing. It is fixed to the other part 17 of the Strut with the aid of two screws 19. The part 17 of the strut has a longitudinal slot 20 providing a passage for the screws 19. The metal connecting piece 18 has two threaded holes in which the screws 19 can be inserted.

In a second design variant, the adjacent sections of the parts 17 of the strut are connected together by a connecting piece 60 with a U-shaped cross-section (cf. FIGS. 7*f* and 7*g*). The two ends and the base area of this connecting piece 60 contain the end sections of the two parts 17 of the strut. The connecting piece 60 is fixed by means of the screws 62 to the two parts 17 of the strut. At least one of the two parts 17 of the strut has a longitudinal slot 61 permitting it to pass over the screws 62. By this means, the part 17 of the strut concerned can be locked at different positions in the axial direction of the strut 13.

In the folded condition, the two outer ends of the roof spars 11 can all have the same distance from the support plate 6 (cf. FIG. 2*b*). In this case, their lengths can vary lightly since their fixing points are at different distances from the support plate 6. In the example shown, their lengths lie approximately between 354.8 cm and 379.6 mm.

However, it is also possible to design two or more adjacent roof spars 11 considerably shorter than the other roof spars 11 (cf. FIGS. 3*a* to 3*c*). By this means, a roof 1 is obtained that is divided into two sections with different radii.

To the hinge plate 8 is attached by means of a vertical stay plate 112, an umbrella roof 70 preferentially in the form of circular segments, for example in aluminum or steel (cf. FIGS. 8*a* to 8*d*), that protrudes beyond the upper fixing point of the roof covering 21 and thus closes the gap between the upper end of the roof covering 21 and the wall 3. The opening angle of the circular segment of the umbrella roof 70 corresponds to the maximum opening angle of the collapsible roof 1.

To enable the hinge plate 8 together with the semicircular umbrella roof 70 attached to it by means of the stay plate 112 to be swiveled against the wall, the umbrella roof 70 is cut off at right-angles to the wall 3 at the side nearest the hinge. For the embodiment, the opening angle of the umbrella roof 70 is thus approximately 120°.

To ensure that when folded the collapsible roof 1 at the wall 3 is protected from the weather, a protective cover 113 in the form of an aluminum cover of length at least equal to that of the roof spars 11 when swiveled against the wall 3 and parallel to the roof spars 11 is mounted on the wall 3 with an inclination of about 5°.

To provide additional weather protection and protection from external view, the protective cover 113 (cf. FIG. 9) has a bent end plate 114 at its lower end that is normal to the wall 3. To protect the ends of the roof spars 11, the remaining area not protected by the protective cover 113 may be covered by a flap 116 and closed by a magnetic or Velcro fastener 115.

A semicircular roof covering 21 is attached to the roof spars 11. The radius of the roof covering 21 corresponds approximately to the length of the roof spars 11.

The roof covering 21 of the roof 1 preferably has a flounce running along its edges concealing the roof spars 11 from view (cf. FIG. 7*c*).

In the first design variant, the main stay 12 of each roof spar 11 has an undercut longitudinal groove 22 on its upper side (cf. FIG. 15) for fixing the roof covering 21. The longitudinal grooves 22 have an approximately circular cross-section. The roof covering 21 is pressed into the longitudinal groove of each main stay 12. This causes a loop to be formed in the roof covering 21 at each longitudinal groove 22. A rod 23 of circular cross-section is inserted into the longitudinal groove 22 at the outer end face of each main stay 12 and through the loop of the roof covering 21. The diameter of the rods is slightly smaller than the diameter of the undercut longitudinal grooves 22. At the same time, it is however greater than the breadth of the undercut longitudinal grooves 22 at the upper side of the main stay 12. Therefore, the rods 23 cannot escape upwards from the undercut longitudinal grooves 22. The roof covering 21 is wedged between each rod 23 and the corresponding longitudinal groove 22.

In a second design variant, a distinction must be made between the method of fixing the roof covering 21 to the two outer roof spars 11 and to the remaining roof spars 11 (cf. FIGS. 10 to 13*b*). In the case of the two outer roof spars 11, the edges of the roof covering are folded upwards and over to form a seam that is then sewn (cf. FIG. 11*b*). At intervals of 40 to 50 cm, the seam is interrupted. On the outer roof spars 11, eyelets 120 are attached at intervals of about 40 to 50 cm. Fixing and pulling tightly upwards of the roof covering 21 is performed in the same way as for the inner roof spars as described below by means of a cord-or stainless steel cable 118 that runs both through the eyelets 120 attached to the roof spar 11, and through the aluminum rods inserted in the seam of the roof covering, that is attached to a further eyelet 120 at the upper end of the spar, and that is deflected at and attached to a tensioning spring 119 that is optionally fixed to the roof spar 11 in the vicinity of the first and second eyelets 120 (cf. FIG. 12), or fixed to the inside at the lower end of the roof spar 11 (cf. FIG. 10). Fixing to the lower end of the roof spar 11 is achieved in that the cable 118 is tied to form a knot having a diameter greater than the diameter of the eyelet 120 and by this means is fixed to the lowest eyelet 120. Radial pretensioning of this kind permits the material to travel between the eyelets attached to the outer roof spars 11 so that any distortions occurring on extending or folding it can be equaled out.

In the case of the inner roof spars 11, a cable 118 is knotted to an eyelet (not shown) in the upper part of the roof covering 21, and led to the interior of the hollow roof spar 11 via a deflecting pulley 117 mounted on the upper section of the roof spar 11 (cf. FIG. 10). Two types of fixing are possible. The tensioning spring can either be attached to the roof spar 11 in the vicinity of the first and second eyelets 120 (cf. FIG. 12) or to the lower end of the inner hollow roof spar 11 (cf. FIG. 10).

In a third design variant, a distinction must likewise be made between the fixing of the roof covering 21 on the two outer roof spars 11 and on the remaining roof spars 11. The main stay 12 of each roof spar 11 has an undercut longitudinal groove 22 on its upper side.

In the case of the two outer roof spars 11, the roof covering 21 is hemmed and slit. Fixing of the cable 118 is also performed as in the second design variant. Contrary to the second design variant, the eyelets 120 are not permanently fixed to the roof spar 11, but are movable. For this purpose, the eyelets 125 are mounted on a pivot 123 on which two rotatable hemispheres are fixed. The diameter of the two hemispheres 125 mounted on the pivot 123 is slightly smaller than the diameter of the undercut longitudinal groove 22. However, at the same time, it is larger than the width of the undercut longitudinal groove 22 on the upper side of the main stay 12. Therefore, although the pivot 123 with the two hemispheres 124 cannot escape upwards from the undercut longitudinal grooves 22, it is nevertheless free to move along the longitudinal axis of the roof spar 11.

In the case of the inner roof spars 11, the roof covering 21 is fixed as in the second design variant.

A tensioning device 24 is used to extend the roof 1 (cf. FIGS. 15 and 16). The tensioning device 24 consists of a tension cable 25, a deflection pulley 26 and a winch 27. At the lower end of one of the outer roof spars 11 a tension cable 25 of a tensioning device 24 is fixed. The other outer roof spar 11 is fixed to the wall of the building with the aid of a fastening bow 28. The tension cable 25 passes to a winch 27 via a deflection pulley 26. The same kind of winch 27 may be used as in sailing ships for tensioning the latch and bulkhead. The winch 27 is preferably operated by a hand lever. Of course a motor-driven winch 27 may also be used. The deflection pulley 26 and the winch 27 of the tensioning device 24 are fixed to a vertical support 29 or wall of a building directly adjacent to the wall of the building 3 on which the mounting plate 6 is fixed. The support 29 can be fixed directly to the wall 3. The deflection pulleys 26 and the winch 27 are positioned at a distance from the mounting plate 6 that is somewhat greater than the width of the roof spars 11. The fastening bow 28 (cf. FIGS. 14*a* and 14*b*) has an almost U-shaped cross-section, whereby however the leg 32 that is attached to the building is higher than the other leg 33. The outermost roof spar 11 is screwed to the fastening bow 28. The baseplate 30 of the fastening bow 28 has a longitudinal slot 31 allowing it to pass over the screw or screws.

In order to extend the roof 1 of the pavilion, the support plates 5 of the nodal element 2 are swiveled inwards until the roof spars 11 are at right-angles to the wall 3 of the building on which the mounting plate 6 is mounted. In addition, the outermost roof spar 11 concerned is swiveled in the direction of the wall 3 of the building. After that, the tension cable 25 is tightened with the aid of the winch 27. By this means, the second outermost roof spar 11 is pulled away from the central rigidly fixed roof spar 11 towards the wall 3 of the building. In this, it pulls the remaining rotatable roof spars 11 with it. The roof covering 21 of the roof 1 is by this means extended.

A gathering device 48 may be used to ensure that when the roof covering 21 is folded, the covering sectors lying between the roof spars 11 do not hang too far down.

The first design variant of the gathering device 48 (cf. FIGS. 18*a* to 21) consists of several deflection pulleys 49, 50 and a shot 51. A single deflection pulley 49 is attached to the upper side of each outer end section of each roof spar 11. Two deflection pulleys 50 are attached to the outer edge of each covering segment bounded by two roof spars 11. A single shot 51 runs over the deflecting pulleys 49, 50. The deflecting pulleys 49 on the roof spars 11 are fitted with a guide bow 71 for the shot 51. They are connected via a hinge 73 with a pedestal 74 fixed to the corresponding roof spar 11. The deflecting pulleys 50 on the roof covering 21 also have a guide bow 72 for the shot 51.

By tightening the shot 51 at two points (i.e. at the fixing points of the deflection pulleys) in the untensioned position, the sectors of the roof covering 21 can be pulled upwards in the direction of the roof spars 11.

A second design variant of the gathering device 48 (cf. FIG. 22) consists of thin rods 75. Two such rods 75 are positioned horizontally so as to be rotatable in the outer section of each roof spar 11. A runner 76 is fitted over each rod 75. The freedom of movement of this runner 76 is restricted by two retainers 77. One of the retainers 77 is fixed to the free end and the other retainer 77 to the inner part of the rod 75. The runner 76 is attached to the outer edge of the covering segment. Each covering segment is attached to-two rods 75.

A third design variant of the gathering device 48 (cf. FIG. 23) consists of a large number of free-running eyelets 80, a large number of small hooks 81 and an extended, elastic expander 79. The free-running eyelets 80 are attached to the underside of one of the outer roof spars 11, and the hooks 81 to the underside of the other outer roof spar 11. Both the free-running eyelets 80 and the hooks 81 are positioned at regular intervals along the length of the spar. In this, the hooks 81 and the free-running eyelets 80 are displaced with respect to one-another. In the untensioned position, the expander 79 passes through all free-running eyelets 80. The two ends of the expander 79 are attached to the innermost and the outermost free-running eyelets 80 or to the roof spar 11. The covering segments lying between the roof spars 11 are gathered upwards when the roof covering 21 is folded, by virtue of extending each of the sections of the expander 79 lying between two free-running eyelets 80 and hanging this over the next hook 81 on the opposite outer roof spar 11. It is also possible to fix each of the sections lying between two free-running eyelets 80 at its center to a rod (not shown). In this case, the rod is suspended on the hook 81.

Another pavilion falling within the scope of the invention has a maximum opening angle of 90° and is fitted neither with vertical side supports nor with a side wall (cf. FIGS. 5*a* to 6*b*). It is for example suitable for mounting on a re-entrant corner of a building. In addition to the example without vertical supports shown in the figures, pavilions are also included with a maximum opening angle of 90° having vertical supports as claimed in the invention.

For the second pavilion, the central nodal element 2 of the roof 1 has two horizontally positioned support plates 5 in the form of circular segments with an opening angle of 90°. For the embodiment, the radius of the support plates 5 is also about 225 mm. Furthermore, the nodal element 2 has one or two vertically positioned rectangular mounting plates 6. The strait edges of the support plates 5 are permanently and rigidly connected to the mounting plates 6. The mounting plates 6 are fixed to the walls 3 of the building that meet at the corner of the building. Four roof spars 11 extend radially outwards from the central nodal element 2. The roof spars 11 are of similar design to those of the first pavilion. The main stays 12, or accordingly the main stays 12 and the struts 13, of all roof spars 11 are each connected to the support plates 5 via a hinge 14 so as to be rotatable. Here, the hinges 14 are of the same design as in the first pavilion. The fixing points of the roof spars 11 on the two support plates 5 are displaced symmetrically with respect to the two straight end faces and the bisecting radius at regular intervals from the bisecting radius. The roof spars 11 may be rotated in the direction of one of the two outer roof spars 11 until they are parallel to this and to the corresponding wall 3 of the building. In the closed position, the outer ends of the roof spars 11 are preferentially at the same distance from the mounting plate 6 to which they are at right-angles. In this case, their length does not vary, since their fixing points are at different distances from the corresponding mounting plate 6 (cf. FIG. 5*b*).

A covering element 21 in the form of a circular segment is attached to the roof spars 11. The opening angle of this covering element 21 is 90°. Its radius corresponds approximately to the length of the roof spars 11. The covering element 21 is fixed to the roof spars 11 in the same way as for the first pavilion. To extend the roof 1, a tensioning device 24 is used that has the same design as the tensioning device 24 in the first pavilion. One of the outer roof spars 11 is rigidly connected to a fastening bow 28 and fixed to the wall 3 of the building. On the other outer roof spar 11, the tension cable of the tensioning device 24 is attached.

To extend the roof 1 of the second pavilion, the tension cable 25 is simply tightened with the aid of the winch 27. By this means the outer roof spar 11 to which the tension cable 25 is attached is pulled away from the roof spar 11 that is rigidly attached to the wall 3 of the building in the direction of the other wall 3 of the building. The covering element 21 of the roof 1 is thereby extended.

A third pavilion has a maximum opening angle of 180° and is fitted with vertical side supports (cf. FIGS. 1*c* and 17) or with a side wall. In the embodiment, the entire pavilion is provided with side supports 34. The design variant with side supports and side wall represents an embodiment as claimed in the invention. The central nodal element 2, the roof spars 11, the roof covering 21 and the tensioning device 24 described here are of similar design to those of the first pavilion.

A vertical side support 34 is attached to the outer end of each roof spar 11. The outer end section of each roof spar 11 is connected to the upper end of a vertical side support 34 (cf. FIGS. 1*c*, 17 and 24). The connection is established via quick fasteners 35 as claimed in the invention that function on the lock and key principle (cf. FIGS. 33*a* to 37*b*).

A quick fastener 35 of this kind consists of a T-shaped connecting element 36, an end plate 37, a guide cylinder 38 and a fixing screw 39. The end plate 37 is attached to the upper end face of the side support 34. The guide cylinder 38 has a central hole extending along its axis. The T-shaped connecting element 36 has two rectangular lugs 53 at the end section of the shaft 52. The shaft 52 is inserted into the axial hole of the guide cylinder 38. The T-shaped connecting element 36 can be displaced vertically within the guide cylinder inside the side support 34. Locking is achieved by means of the fixing screw 39 fitted with a lever 135.

The outer end section of each roof spar 11 has an opening (not shown) on its underside whose form corresponds to the cross-sectional form of the connecting element 36 in the vicinity of the lugs 53. A second, more simple, design variant of the quick fastener 35 is shown in FIGS. 35 and 36. The connecting element 36 of the quick fastener 35 cannot be altered in length. To ensure that the connection is free of play, the roof spar 11 has a bead 56 that serves as a stop for the connecting element 36.

A third design variant of the quick fastener 35 (cf. FIGS. 37*a* and 37*b*) is of similar design to the first design variant (cf. FIG. 33), whereby however the locking of the longitudinally adjustable connecting element is achieved not by a fixing screw 39 but by a tension spring 55 inserted between a locknut 137 and a washer 138. The axially adjustable connecting element consists essentially of a screw 136 milled at one side and whose form is of similar design to the end section of the shaft 52 as in the first design variant. The guide cylinder 38 has a central hole extending along its axis.

To connect the side support 34 with the roof spar 11, the side support 34 is rotated to such a position that the outer end section of the connecting element 36 may be inserted into the opening in the roof spar 11. The side support 34 is then rotated by 180° about its longitudinal axis. The connecting element 36 can then no longer be pulled away from the opening. A securing pin 40 prevents the side support 34 being unintentionally further rotated permitting the connection to come apart. This securing pin 40 is positioned parallel to the shaft 52 of the connecting element 36. The end plate 37 has an through hole at the edge through which the securing pin 40 passes. The lower end section of the securing pin 40 has a lug to one side. This lug passes through a longitudinal slot in one wall of the side support 34. The securing pin 40 can be held by this lug and displaced axially with respect to the side support 34. The outer end section of each roof spar 11 has a through hole on its underside in which the upper end section of the securing pin 40 may be inserted.

For fixing the side supports 34 to the ground, quick fasteners 35 of the type described can likewise be used. For each side support 34, a ground element 41, whose upper end is aligned with the surface of the ground (concrete, gravel, sand, lawn) (cf. FIG. 33*b*) is let into the ground. Holes 134 in the form of a keyhole are provided at the center of the upper end and in the two arms in which the connecting element 36 of a quick fastener 35 may be inserted.

The side supports 34 can also be fitted with a wheel 42 at their lower ends enabling the pavilion to be folded together with ease. The wheels 42 are fixed alternately on the inner and the outer wall of the supports 34 so as to be rotatable (cf. FIG. 17). They extend from the underside of the supports. When all the roof spars 11 and side supports 34 of the pavilion are folded together, all the wheels 42 are initially in contact with the ground. The totality of all side supports 34 therefore occupies an extensive contact area at the ground making it impossible to swivel the side supports 34 together with the roof spars 11 against the wall 3 of the building. This problem is solved as described in the invention in that all lateral side supports 34 are suspended on the central side support 34 so that only the wheel 42 of the central side support 34 is in contact with the ground (cf. FIG. 25). In order to suspend the two neighboring side supports 34, the lower section of each of the side walls of the central side support 34 has a hook 43 extending outwards. The lower end face of each lateral vertical side support 34 is provided with an end plate 44. This end plate 44 has a through hole in which hooks 43, 45 can be inserted. On the side of the end plate 44 facing away from the central side support 34, a hook 45 extends sideways. The side supports 34 immediately adjacent to the central side support 34 are suspended on the central side support 34. Each of the side supports 34 lying further outwards is suspended on the adjacent inward side support 34.

In order to suspend the side supports 34 upon one-another, it is necessary for the roof spars 11 to be swiveled upwards to a certain extent. To enable this, the main stay 12 of each roof spar 11 is parted in its inward section. The parts of the stay so formed are connected together by means of a hinge 46 (cf. FIGS. 25 and 32). The hinge 46 consists of two plates 47 that are inserted in the neighboring sections of the two parts of the stay. The width of the plates 47 is less than that of the main stay 12. The plates 47 lie on the inside of the two side walls of each part of the stay. They are rigidly attached to one of the parts of the stay, preferably by welding. On the other part of the stay, they are fixed with the aid of a screw. The two side walls of this part of the stay and the two plates 47 have through holes that are aligned to accept the screw.

In order to erect a pavilion with vertical side supports 34, the roof spars 11 together with the side supports 34 are first swiveled away from the wall 3 of the building on which the central nodal element 2 is attached until they are at right-angles to it. The side supports 34 are then detached from one-another. Following that, the roof spars 11 and side supports 34 are swiveled apart until each side support 34 is located at its fixing point. In a further step, the side supports 34 are fixed to the ground. The roof 1 is then tensioned with the aid of the tensioning device 24.

To collapse the pavilion, the side supports 34 must first be released from the ground and then swiveled to the middle together with the roof spars 11. The lateral side supports 34 are then suspended on the central side support 34. Finally, the totality of the side supports 34 and roof spars 11 can be swiveled against the wall 3.

The side wall of the pavilion can extend either over the whole periphery or only over part of the periphery of the pavilion. The side wall consists of a fixing rail 82, vertical support 83 with fixing elements 84, transverse supports 85 and wall elements 86 (cf. FIG. 26). The form of the fixing rail 82 corresponds principally to the ground plan of the side wall (cf. FIG. 27). It is therefore divided into several sections positioned at an angle to one-another. The magnitude of the angle between two particular sections depends on the number of roof spars 11, it being clear that when the roof is completely extended, the outer ends of the roof spars 11 form a regular polygon, and each corner of the fixing rail 82 lies vertically below the end of a roof spar 11. The fixing rail 82 that preferentially consists of a hollow metal bar of square cross-section, has three slots positioned behind one-another in the longitudinal direction of the fixing rail. One slot 87 is located precisely below the outer end of the roof spar with the roof extended. The other two slots 88 are located at each side of the central slot 87. A further slot 89 is located in the middle of each strait section. The fixing rail 82 is preferably imbedded in the ground so that its upper edge is level with the surface of the ground.

In the section over which the side wall extends a vertical support 83 is positioned at the outer end of each roof spar 11. The side supports preferentially have a circular cross-section. Each side support is connected to the bolt and slot connection on the fixing rail. The bolt and slot connection consists firstly of a bolt 90 that protrudes from the lower end face of a vertical support 83 and secondly of the central slot 87 at the corner of the fixing rail 82. The attachment of the vertical supports 83 at the outer end of each roof spar 11 is also achieved via a bolt and slot connection. This bolt and slot connection consists firstly of a bolt 91 that protrudes from the upper end face of a vertical support 83 and secondly of a transverse slot on the underside of each roof spar 11.

Each side support 83 carries a fixture 84 (cf. FIGS. 26, 29*a* to 30*b*) at its upper end section. The fixtures 84 serve to fix the wall elements 86 and the transverse supports 85. This type of fixture 84 is divided into two parts 92. Each part 92 consists of a U-profile bar. The two parts 92 are set at an angle to each other. The angle between the two parts 92 corresponds to the angle between the strait sections of the fixing rail 82. To enable the fixture 84 to be attached to a side support 83, a tube is placed at the center of the two parts through which the upper end of a side support 83 may be inserted.

Each side support 83 is connected to the adjacent side support 83 at its upper end section by a transverse support 85. The two ends of a transverse support 85 are fixed to the fixtures 84 of the adjacent side supports 83. The end sections of the transverse supports 85 lie on the horizontal arms of the two fixtures 84 that face each other.

Both of the arms 92 of a fixture 84 have a bar lock 108 mounted on the U-profile bar. The bar lock 108 consists of a bar 109 and a screw knob 110. In addition, the transverse supports 85 have a longitudinal slot 111 near each end. In the second design variant, the transverse support 85 is fixed to a fixture 84 in such a way that the bar 109 is brought into a horizontal position by turning the screw knob 110, so that it fits precisely into the longitudinal slot 111 of the horizontal supports 85 when laid on the fixtures. The horizontal support 85 can then be locked by rotating the screw knob 110 by 90°, so that the bar 109 then lies at right-angles to the longitudinal slot. Furthermore, the underside of the transverse support 85 has longitudinal slots in both end sections and at the center. These three longitudinal slots serve to attach the wall elements 86 as claimed in the invention.

Each wall element 86 (cf. FIG. 28) consists of a rectangular frame 98 and a frame covering 99. The frame covering 99 can be of acrylic glass, textile of other suitable covering material. The frame 98 consists of two vertical bars 100, two horizontal bars 101 and a horizontal tensioning bar 102. The tensioning bar 102 serves to tension the frame covering 99 in the case when this consists of flexible material. The tensioning bar 102 is positioned at the inside of the lower horizontal bar 101 and fixed to this with the aid of two screws 137. The two screws 137 permit the distance between the tensioning bar 102 and the lower horizontal bar 101 to be altered.

The upper horizontal bar 101, the two vertical bars and the tensioning bar are all manufactured from the same profile stock and each has an undercut longitudinal groove 103 at its inner side. These are employed to fix the frame covering 99. If the frame covering 99 is of textile, the edges of the frame cover 99 are pressed into the undercut longitudinal groove 103 and wedged in the longitudinal groove 103 with the aid of a flexible tube 104 that is threaded through the longitudinal groove (cf. FIG. 29).

The frame 98 is fixed to the transverse support 85 with two bolt and groove connections and to the fixing rail 82 likewise with two bolt and groove connections. The bolts 105 are located in the end sections of the vertical bars 100 so as to be displaceable in the vertical direction and may be locked in any desired longitudinal position. Locking is achieved by one or two screws 106 screwed into each of the screw holes passing through the bolt 105. The screws 106 are accessible via longitudinal slots 107 in the vertical bars 100. The screws 106 of the bolts 105 of the two upper bolt and groove connections preferentially each have a lever permitting these screws to be released or tightened by hand.

The vertical supports 34 considerably increase the resistance of the roof 1 against wind loads. The side wall serves as wind protection device. The side wall can also be employed without the roof 1, in which case it serves as a lateral wind protection device.

A fourth pavilion has a maximum opening angle of 270° (cf. FIGS. 38 to 42).

The central nodal element 2 of the roof 1 consists in this case of a large part 63 and a small part 64. These two nodal element parts 63, 64 are connected together by a hinge 65 so as to be rotatable.

The large nodal element part 63 has two horizontally positioned support plates 5 in the form of a semicircle, that are aligned at a certain distance above each other. Furthermore, the large nodal element part 63 has a mounting plate 6. The mounting plate 6 can be positioned on the same side of the hinge 7 as the support plates 5 in the retracted position (cf. FIG. 4*a*) or on the other side (not shown). In the first case, the mounting plate 6 is cut off at right-angles. This mounting plate 6 is fixed to the fixing points of a building. The two support plates 5 of the large nodal element part 63 are connected to the support plate 6 via a hinge 7. The hinge 7 is located at one corner of the two support plates 5. The design is similar to that of the first pavilion proposed. Seven roof spars 11 extend radially outwards from the large nodal element part 63. The roof spars 11 are of similar design to those of the first pavilion. The central roof spar 11 is rigidly connected to the support plates 5. The remaining roof spars 11 are each connected to the support plates 5 via a hinge 14 so as to be rotatable. The hinges 14 are of the same design as for the first pavilion.

The small nodal element part 64 has two horizontally positioned support plates 5 in the form of circular segments with an opening angle of 90°.

Three roof spars 11 extend radially outwards from the small nodal element part 64. The roof spars 11 are of similar design to those of the first pavilion. The roof spar 11 facing away from the large nodal element part 63 is rigidly fixed to the small nodal element part 64. The two other roof spars 11 are each connected to the support plates 5 via a hinge 14 so as to be rotatable.

The two support plates 5 of the small nodal element part 64 are each connected to the free corner of a support plate 5 of the large nodal element part 63 via the hinge 65 so as to be rotatable. The hinge 65 is connected at one side to the corner of each support plate 5 of the small nodal element part 64 and at the other to the free corner of the support plates 5 of the large nodal element part 65.

The hinge 65 has two outer hinge plates 66, two inner hinge plates 67, a sleeve 68 and a pivot 69 (cf. FIG. 42). The two outer hinge plates 66 are each fixed at their outer side to a support plate 5 of the large or small nodal element part 63. They protrude at the side of the support plates 5 that faces the small nodal element part 64. The two inner hinge plates 67 are each connected at their inner side to a support plate 5 of the small or large nodal element part 64. They protrude at the side of the support plate 5 that faces the large nodal element part 63. The protruding sections of the inner and the outer hinge plates 66, 67 overlap each other. The sleeve 68 is positioned at right-angles to these sections and is attached to the inner hinge plate 66 and the outer hinge plate 67. The pivot 69 is located in the sleeve 68.

When the pavilion is collapsed, the large nodal element part 63 is swiveled out at right-angles and the curved edge of the small nodal element part 64 faces the curved edge of the large nodal element part 63. The pavilion is extended in that the large nodal element part 63 is swiveled around the hinge 7 and the small nodal element part 64 around the hinge 65 against the wall of the building. Following this, the roof spars 11 are swiveled out.

A fifth pavilion has a maximum opening angle of 360° and can be equipped as claimed in the invention with vertical side supports or with a side wall (cf. FIGS. 43 to 47*b*). It is suited for example for providing shelter for open areas where no house wall is available.

In this pavilion, the central nodal element 2 has two horizontally positioned, oval, support plates 5 aligned at a certain distance above each other. Fourteen roof spars 11 extend radially outwards from the central nodal element 2, whereby the two roof spars 11 positioned exactly opposite each other are rigidly fixed to the central nodal element 2. The remaining roof spars 11 are each connected via a hinge 14 to the support plates 5 so as to be rotatable. The hinges 14 and the roof spars 11 are of similar design to those of the first pavilion.

When the pavilion is collapsed, six of the freely movable roof spars 11 are folded against each of the two roof spars 11 that are rigidly connected to the central nodal element 2, that is to say the roof spars 11 are grouped into two groups of 7 parallel roof spars 11 facing apart.

In the first design variant, the central nodal element is fixed to a vertical central mast 126 (cf. FIG. 47*a*).

In a second design variant, the central nodal element is fixed to an arched support 127 (cf. FIG. 47*b*). This has the advantage that the room under the pavilion can be fully utilized.

In a third design variant of the pavilion (not shown) with a maximum opening angle of 360°, two semicircular nodal elements as in the first embodiment are attached opposite each other to a bridge girder. The two ends of the bridge girder rest on two vertical steel supports, and the length of the bridge girder is determined by the radius of the pavilion. The roof spars extend radially outwards from the two central nodal elements, whereby the central roof spar is rigidly attached to the central nodal element.

The remaining roof spars are each attached via a hinge to the support plate so as to be rotatable. The hinges and the roof spars are of similar design to those of the first pavilion. In the collapsed position, all roof spars lie parallel to the bridge girder and are protected in this position by an aluminum cover attached to the bridge girder.

A sixth pavilion has a maximum opening angle of greater than 180° and can be equipped as claimed in the invention with vertical side supports or with a side wall (cf. FIGS. 48 to 52). It is suited for example for mounting on a curved concave or convex (not shown) or otherwise angled facade (cf. FIGS. 50 and 51).

For the sixth pavilion, the central nodal element 2 of the roof 1 has two horizontally positioned circular support plates 5 aligned at a certain distance from each other. Seven roof spars 11 extend radially outwards from the central nodal element 2, whereby the central roof spar 11 is rigidly connected to the central nodal element 2.

The remaining roof spars 11 are each connected via a hinge 14 with the support plates 5 so as to be rotatable. The hinges 14 and the roof spars 11 are of similar design to those of the first pavilion. To permit the opening angle to be greater than 180°, all the roof spars 11 within a circular segment of 180° are attached to the nodal element 2.

The rotatable roof spars 11 may be rotated towards the rigidly connected roof spar 11 until they lie parallel to this (cf. FIG. 50). The folded roof spars 11 can then be swiveled together by 90° in that the circular support plate is rotated by 90° about its own axis.

The circular support plates 5 are mounted on a wall fixture 128 so as to be rotatable (cf. FIG. 52). The wall fixture consists of a bracket 129 mounted on the wall of a building and a circular tube 130. A solid round bar 131 is inserted into this circular tube 130, the upper and lower ends of which are inserted into the upper and lower circular support plates 5. This is fixed above and below by splitpins 132 that pass through the solid round bar 131.

A seventh pavilion has a maximum opening angle of 180° and can, be equipped as claimed in the invention with vertical side supports or with a side wall (cf. FIGS. 53 to 58), and has an asymmetrical main pivot. This pavilion may be used whenever the central nodal element cannot be mounted exactly in the center of the area to be covered. In the example shown (cf. FIGS. 57 and 58), the central nodal element had to be mounted on a beam 138 since it could not be mounted on the wall 3 for reasons of stability. To enable the umbrella roof to be symmetrically positioned above the balcony, this had to be fixed to the beam with an asymmetric main pivot as shown.

For the seventh pavilion, the central nodal element has two horizontally positioned semicircular support plates 5 aligned at a certain distance above each other. Seven roof spars 11 extend radially outwards from the central nodal element 2, whereby the central roof spar 11 is rigidly fixed to the central nodal element 2.

The remaining roof spars 11 are each connected via a hinge 14 to the support plates 5 so as to be rotatable. The hinges 14 and the roof spars 11 are of similar design to those of the first pavilion.

In addition to the proposed pavilions having maximum opening angles of 180°,90° and 270°, pavilions with other maximum opening angles are included.

The proposed pavilion is primarily intended for covering and providing wind protection for an outdoor sitting area. It can, however, also be used for covering and providing wind protection for any desired open space.

It has considerable advantages over presently known protection devices:

The proposed pavilion can be left standing in strong winds. It may be erected and taken down with minimum effort. Furthermore, it is of simple construction and can thus be inexpensively manufactured. Moreover, it takes up very little storage space when folded and not in use. None of the presently known protection devices combines all these advantages.

What is claimed is:

1. Wind and weather protection device in the form of a detachable partition or side wall for attachment to a wind and weather protection device in the form of a collapsible roof, whereby the aforesaid wind and weather protection device comprising:

a mounting device having a central nodal element consisting of two horizontal support plates positioned at a certain distance above each other, roof spars fixed to the mounting device so as to be horizontally rotatable, each of which has at least one long main stay, whereby the distance between the support plates is so chosen that the inner end section of each main stay is positioned between the support plates and fixed to at least one of the support plates under all operating conditions, a covering attached to the roof spars and at least one tensioning device for tensioning the roof and whereby the wind and weather protection device has the following attributes:

at least two supports, permanently fixed at a certain distance from each other to form a side wall segment, and at least one wall element that at least partly closes the side wall segment.

2. Wind and weather protection device as under claim 1, comprising each pair of adjacent supports are connected in their upper end section by a transverse support and in their lower end section by a fixing rail, whereby the two ends of the transverse support are fixed to the supports by means of fixtures, that a longitudinal slot is provided for attaching the wall elements, and that the form of the fixing rail corresponds essentially to the base of the side wall segment and is divided into several straight sections at an angle to one another.

3. Wind and weather protection device as under claim 2, comprised in that each wall element has a rectangular frame with two vertical bars and two horizontal bars and a frame covering attached to the frame by means of a horizontal tensioning bar, and that the frame is fixed to the transverse support with the aid of bolt and slot connections and to the fixing rail.

4. Wind and weather protection device as under one of claim 1 or 2 comprising the upper end of the side support is attached to the outer end section of the roof spar by means of a quick fastener based on the lock and key principle having a T-shaped connecting element with a shaft having two rectangular lugs at one end section, an end plate attached to one of the upper end faces of the side support, a guide cylinder having a central hole along its axis to accept the shaft, and a fixing screw provided with a lever to lock the T-shaped connecting element positioned inside the guide cylinder inside the side supports, whereby the outer end section of one of the spars is provided with an opening whose form corresponds to the cross-sectional form of the connecting element in the vicinity of the lugs.

5. Wind and weather protection device as under claim 1 or 2 comprising the upper end of the side support is attached to the outer end section of one of the roof spars by means of a quick fastener based on the lock and key principle, having a connecting element having a shaft having at least one rectangular lug at one of its outer end sections, and an end plate attached to the upper end face of the side support to accept the shaft, and that the roof spar has a bead serving as a stop for the connecting element.

6. Wind and weather protection device as under one of claim 1 or 2 comprising the side supports are anchored to the ground by means of quick fasteners operating on the lock and key principle, whereby for each side support a ground element having a plate with an opening in the form of a keyhole that covers the upper end let into the ground, or fixed by means of a threaded bush having a threaded screw at its upper side having a keyhole that accepts a connecting element and is closed at its underside with a baseplate.

7. Wind and weather protection device as under one of claim 1 or 2 comprising the side support carries a rotatable wheel at its lower end that protrudes from the underside of the support, and that the wheels of adjacent side supports are fixed alternately to the inner and outer wall of the side supports, whereby for a collapsed roof the lateral side supports that are situated adjacent to one another are suspendable on the central side support so that only the wheel of the central side support is in contact with the ground, and in addition an outward facing hook is provided in the lower section of each of the two side wall segments attached to the central side support, the lower end face of each lateral side support is provided with an end plate having a through hole for attaching a hook, and a hook that faces sideways is provided at the side of the end plate facing away from the central side support, so that the side supports directly adjacent to the central side support are suspendable on the central side support, and each side support lying further outwards is suspendable on the adjacent inward side support.

8. Wind and weather protection device in the form of a collapsible roof, with a mounting device, roof spars connected to it so as to be rotatable, a roof covering fixed to the roof spars and at least one tensioning device to extend the roof, whereby the mounting device having a central nodal element consisting in two horizontally positioned support plates situated at a certain distance above each other, each roof spar having at least one long main stay and whereby the distance between the support plates being so chosen that the inner end section of the main stay is positioned between the support plates and is attached to at least one of the support plates under all operating conditions, comprising the main stay of each roof spar has a radial tensioning device that is spring tensioned for tensioning the roof covering in the longitudinal direction of the roof spar, and one end of the radial tensioning device is attached to the main stay and the other end of the radial tensioning device to the roof covering, whereby the edges of the roof covering next to the two outermost roof spars are turned upwards and over and sewn to form a seam that is at least partly interruped, that eyelets are positioned at intervals on the outermost roof spars, and that fixing and raising of the roof covering are achieved by means of a cable passing through the eyelets and the seam, attached to and deflected by a tensioning spring fixed to the relevant roof spar and fixed to the lower end of the relevant roof spar.

9. Wind and weather protection device as under claim 8 comprising each tensioning device has a tension cable fixed to the lower end of one of the outermost roof spars, having a deflecting pulley and a winch, whereby the deflecting pulley and the winch of each tensioning device are fixed to a vertical support or to a wall, and the other outermost roof spar is attached to a wall with the aid of a fastening bow screwed to it.

10. Wind and weather protection device in the form of a collapsible roof, with a mounting device, roof spars connected to it so as to be rotatable, a roof covering fixed to the roof spars and at least one tensioning device to extend the roof, whereby the mounting device having a central nodal element consisting in two horizontally positioned support plates situated at a certain distance above each other, each roof spar having at least one long main stay and whereby the distance between the support plates being so chosen that the inner end section of the main stay is positioned between the support plates and is attached to at least one of the support plates under all operating conditions, comprising a gathering device with several deflection pulleys and a shot passing over the deflection pulleys, whereby a single deflection pulley is attached to the outer end section of each roof spar and two deflection pulleys to the outer edge of each covering segment bounded by two roof spars, and each deflection pulley is provided with a guide bow for the shot.

11. Wind and weather protection device in the form of a collapsible roof, with a mounting device, roof spars connected to it so as to be rotatable, a roof covering fixed to the roof spars and at least one tensioning device to extend the roof, whereby the mounting device having a central nodal element consisting in two horizontally positioned support plates situated at a certain distance above each other, each roof spar having at least one long main stay and whereby the distance between the support plates being so chosen that the inner end section of the main stay is positioned between the support plates and is attached to at least one of the support plates under all operating conditions, comprising a gathering device consisting of thin rods attached to the outer section of each roof spar so as to be horizontally rotatable and runners fitted over each of the rods and fixed to the outer edge of a covering segment, the path of travel of the runners being limited by two stops attached to the rod.

12. Wind and weather protection device in the form of a collapsible roof, with a mounting device, roof spars connected to it so as to be rotatable, a roof covering fixed to the roof spars and at least one tensioning device to extend the roof, whereby the mounting device having a central nodal element consisting in two horizontally positioned support plates situated at a certain distance above each other, each roof spar having at least one long main stay and whereby the distance between the support plates being so chosen that the inner end section of the main stay is positioned between the support plates and is attached to at least one of the support plates under all operating conditions, comprising a gathering device consisting of several free-running eyelets on the underside of one of the outermost roof spars, several hooks on the underside of the other outermost roof spar and a stretched elastic expander passing through all free-running eyelets in the released position whose ends are attached to the innermost or the outermost free-running eyelet or to the roof spar.

* * * * *